US012006793B2

(12) United States Patent
Watkins et al.

(10) Patent No.: US 12,006,793 B2
(45) Date of Patent: Jun. 11, 2024

(54) DEVICES, SYSTEMS, AND METHODS FOR SELECTIVELY ENGAGING DOWNHOLE TOOL FOR WELLBORE OPERATIONS

(71) Applicant: ADVANCED UPSTREAM LTD., Calgary (CA)

(72) Inventors: Tom Watkins, Calgary (CA); Jeyhun Najafov, Calgary (CA); Ratish Suhas Kadam, Calgary (CA); Henryk Kozlow, Calgary (CA)

(73) Assignee: Advanced Upstream Ltd., Calgary (CA)

( * ) Notice: Subject to any disclaimer, the term of this patent is extended or adjusted under 35 U.S.C. 154(b) by 0 days.

(21) Appl. No.: 17/586,536

(22) Filed: Jan. 27, 2022

(65) Prior Publication Data

US 2022/0145749 A1 May 12, 2022

Related U.S. Application Data

(63) Continuation-in-part of application No. 17/163,067, filed on Jan. 29, 2021, now Pat. No. 11,746,612.
(Continued)

(51) Int. Cl.
*E21B 34/14* (2006.01)

(52) U.S. Cl.
CPC ..... *E21B 34/142* (2020.05); *E21B 2200/04* (2020.05); *E21B 2200/06* (2020.05)

(58) Field of Classification Search
CPC . E21B 34/142; E21B 2200/04; E21B 2200/06
See application file for complete search history.

(56) References Cited

U.S. PATENT DOCUMENTS 1,624,742 A 4/1927 Kadel
2,152,306 A 3/1939 Grebe
(Continued)

FOREIGN PATENT DOCUMENTS

CA 2786784 A1 7/2011
CA 2799940 C 6/2015
(Continued)

OTHER PUBLICATIONS

Office Action issued on Canadian Application No. 3149077 dated Apr. 25, 2022.
(Continued)

*Primary Examiner* — D. Andrews
(74) *Attorney, Agent, or Firm* — Smart & Biggar LP

(57) ABSTRACT

A device for wellbore operations is configured to self-determine its downhole location in a wellbore in real-time and to self-activate upon arrival at a preselected target location. In embodiments, the device is configured to self-determine its direction of travel and self-deactivates if the device determines that it is not travelling in the downhole direction. In embodiments, the device has a flowback valve that blocks fluid flow therethrough when the device is inactivated but permits fluid flow through the device to exit at the device's trailing end when the device is activated. In embodiments, at least a portion of the device is dissolvable in the presence of wellbore fluids. In embodiments, at least a portion of the device is coated with a protective coating to shield the device from treatment fluids. A downhole tool having a pass-through constriction configured to be overcome by the device is also disclosed.

7 Claims, 25 Drawing Sheets

Related U.S. Application Data

(60) Provisional application No. 62/968,074, filed on Jan. 30, 2020.

(56) References Cited

U.S. PATENT DOCUMENTS

| | | | | |
|---|---|---|---|---|
| 3,061,013 | A | 10/1962 | Thomas, Jr. | |
| 3,623,551 | A | 11/1971 | Randermann, Jr. | |
| 3,631,925 | A | 1/1972 | Nutter | |
| 3,819,850 | A | 6/1974 | Perry et al. | |
| 3,991,826 | A | 11/1976 | Baugh | |
| 4,098,334 | A | 7/1978 | Crowe | |
| 4,457,379 | A * | 7/1984 | McStravick | E21B 34/14 166/373 |
| 5,720,345 | A | 2/1998 | Price | |
| 6,598,672 | B2 | 7/2003 | Bell et al. | |
| 7,252,152 | B2 | 8/2007 | LoGiudice et al. | |
| 7,363,967 | B2 | 4/2008 | Burris, II et al. | |
| 7,503,398 | B2 | 3/2009 | LoGiudice et al. | |
| 7,622,916 | B2 | 11/2009 | Meeten et al. | |
| 8,215,411 | B2 | 7/2012 | Flores et al. | |
| 8,322,426 | B2 | 12/2012 | Wright | |
| 8,487,626 | B2 | 7/2013 | Khan et al. | |
| 8,505,632 | B2 | 8/2013 | Guerrero et al. | |
| 8,505,639 | B2 | 8/2013 | Robison et al. | |
| 9,441,470 | B2 | 9/2016 | Guerrero et al. | |
| 9,534,471 | B2 | 1/2017 | Etzel | |
| 9,567,832 | B2 | 2/2017 | Hofman et al. | |
| 9,587,477 | B2 | 3/2017 | Lafferty et al. | |
| 9,598,672 | B2 | 3/2017 | Sugino et al. | |
| 9,611,709 | B2 | 4/2017 | O'Malley | |
| 9,631,468 | B2 | 4/2017 | Miller | |
| 9,650,851 | B2 | 5/2017 | Whitsitt et al. | |
| 9,683,419 | B2 | 6/2017 | Coon | |
| 9,822,610 | B2 | 11/2017 | Delzell et al. | |
| 9,822,611 | B2 | 11/2017 | Delzell et al. | |
| 10,100,612 | B2 | 10/2018 | Lisowski et al. | |
| 10,138,713 | B2 | 11/2018 | Tolman et al. | |
| 10,301,910 | B2 | 5/2019 | Whitsitt et al. | |
| 10,301,927 | B2 | 5/2019 | Sallwasser | |
| 10,316,645 | B2 | 6/2019 | Ingraham | |
| 10,370,917 | B2 | 8/2019 | Coon | |
| 10,392,910 | B2 | 8/2019 | Walton et al. | |
| 10,435,982 | B2 | 10/2019 | Shkurti et al. | |
| 10,436,017 | B2 | 10/2019 | Coss et al. | |
| 10,465,499 | B2 | 11/2019 | Budler | |
| 10,519,765 | B2 | 12/2019 | Budler | |
| 10,544,670 | B2 | 1/2020 | Hay | |
| 10,570,695 | B2 | 2/2020 | Fitzhugh et al. | |
| 10,598,002 | B2 | 3/2020 | Sites | |
| 10,662,732 | B2 | 5/2020 | Frazier | |
| 10,704,362 | B2 | 7/2020 | Themig et al. | |
| 2003/0117134 | A1 | 6/2003 | Almaguer | |
| 2007/0107908 | A1* | 5/2007 | Vaidya | C09K 8/80 166/376 |
| 2007/0221384 | A1 | 9/2007 | Murray | |
| 2009/0084546 | A1 | 4/2009 | Ekseth | |
| 2011/0227564 | A1 | 9/2011 | Martin et al. | |
| 2011/0308817 | A1 | 12/2011 | Ravensbergen | |
| 2012/0226443 | A1 | 9/2012 | Cresswell et al. | |
| 2012/0085538 | A1 | 12/2012 | Guerrero et al. | |
| 2013/0264056 | A1 | 10/2013 | Stout | |
| 2014/0002071 | A1 | 1/2014 | Martin | |
| 2014/0076542 | A1 | 3/2014 | Whitsitt | |
| 2015/0025805 | A1 | 1/2015 | Hanak | |
| 2015/0167428 | A1 | 6/2015 | Hofman et al. | |
| 2015/0218904 | A1 | 8/2015 | Chauffe et al. | |
| 2015/0226035 | A1 | 8/2015 | Jani | |
| 2015/0247375 | A1 | 9/2015 | Stout | |
| 2015/0361747 | A1 | 12/2015 | Lafferty et al. | |
| 2016/0084075 | A1 | 3/2016 | Ingraham et al. | |
| 2016/0108722 | A1 | 4/2016 | Whitsitt | |
| 2016/0160600 | A1 | 6/2016 | Silva | |
| 2016/0258260 | A1 | 9/2016 | Walton et al. | |
| 2016/0298422 | A1 | 10/2016 | Hyde, Jr. | |
| 2016/0376869 | A1 | 12/2016 | Rochen | |
| 2017/0191340 | A1 | 7/2017 | Deng et al. | |
| 2017/0342794 | A1 | 11/2017 | Silva et al. | |
| 2017/0342806 | A1 | 11/2017 | Themig et al. | |
| 2017/0342823 | A1 | 11/2017 | Shah et al. | |
| 2017/0370176 | A1 | 12/2017 | Frazier | |
| 2018/0094495 | A1 | 4/2018 | Wardley et al. | |
| 2018/0135378 | A1 | 5/2018 | Budde | |
| 2018/0371894 | A1 | 12/2018 | Wang et al. | |
| 2019/0323316 | A1 | 1/2019 | Brown | |
| 2019/0085685 | A1 | 3/2019 | McBride | |
| 2019/0136685 | A1 | 5/2019 | Adetola et al. | |
| 2019/0153816 | A1 | 5/2019 | Campbell | |
| 2019/0332089 | A1 | 10/2019 | Deffenbaugh et al. | |
| 2019/0352998 | A1 | 11/2019 | Wolf et al. | |
| 2020/0063553 | A1 | 2/2020 | Zemla et al. | |
| 2020/0165893 | A1 | 5/2020 | Varhaug et al. | |
| 2020/0270960 | A1 | 8/2020 | Watkins et al. | |
| 2020/0347693 | A1 | 11/2020 | Wood et al. | |

FOREIGN PATENT DOCUMENTS

| | | | |
|---|---|---|---|
| CA | 2909574 | A1 | 10/2015 |
| CA | 2839010 | C | 3/2016 |
| CA | 2995420 | A1 | 8/2016 |
| CA | 2882582 | C | 5/2017 |
| CA | 2819372 | C | 7/2017 |
| CA | 2799618 | C | 9/2017 |
| CA | 3030223 | A1 | 1/2019 |
| CA | 3071108 | A1 | 1/2019 |
| CA | 2813645 | C | 10/2019 |
| CA | 3013446 | A1 | 2/2020 |
| WO | 2016028154 | A1 | 2/2016 |
| WO | 2019165291 | A1 | 8/2019 |
| WO | 2019229521 | A1 | 12/2019 |
| WO | 2020024057 | A1 | 2/2020 |
| WO | 2020086892 | A1 | 4/2020 |
| WO | 2020086961 | A1 | 4/2020 |

OTHER PUBLICATIONS

Office Action issued on Canadian Application No. 3149077 dated Jun. 21, 2022.

WO—ISR/WO issued in PCT/CA2022/050112 dated May 3, 2022.

Office Action issued in Canadian Application No. 3149077 dated Nov. 20, 2023.

Extended European Search Report issued in EP 21747248.9, dated Dec. 19, 2023.

* cited by examiner

DEVICES, SYSTEMS, AND METHODS FOR SELECTIVELY ENGAGING DOWNHOLE TOOL FOR WELLBORE OPERATIONS

CROSS-REFERENCE TO RELATED APPLICATIONS

This application is a continuation-in-part of U.S. patent application Ser. No. 17/163,067, filed Jan. 29, 2021, which claims priority from U.S. Provisional Patent Application Ser. No. 62/968,074, filed Jan. 30, 2020, the contents of both applications are hereby incorporated by reference in their entireties.

FIELD

The invention relates to devices, systems, and methods for performing downhole operations, and in particular to selectively activatable devices for actuating downhole tools in a wellbore, and downhole tools, systems, and methods related thereto.

BACKGROUND

Many wellbore systems require actuation of downhole tools, some of which may comprise sliding sleeves. In some instances, a plug (also referred to as a ball or a dart) is launched to land in the sleeve and pressure uphole from the plug is employed to move the sleeve from one position to another. Movement of the sleeve may open ports in the downhole tool, communicate tubing pressure to a hydraulically actuated mechanism, or effect a cycle in an indexing mechanism such as a counter. A sliding sleeve-based downhole tool may be employed alone in a wellbore string or in groups. For example, some wellbore treatment strings are designed for introducing fluid along a length of a well and may include a number of intermittently positioned sliding sleeve-based downhole tools along the length thereof. Fracturing is an example of a wellbore operation that can employ a wellbore string with a plurality of spaced apart sliding sleeve-based downhole tools. The sliding sleeves are moveable to open ports through which wellbore treatment fluid can be introduced from the wellbore string to the wellbore to treat (e.g., frack) the formation. The sleeves can be opened in groups or one at a time, depending on the desired treatment to be effected.

Many sliding sleeve-based downhole tools employ constrictions in the sleeve to catch the plug. The constriction protrudes into the inner diameter of the string and catches the plug when it attempts to pass. The constriction, or a sealing area adjacent thereto, creates a seal with the plug and forms a piston-like structure that permits a pressure differential to be developed relative to the ends of the sleeve and the sleeve is driven to the lower pressure side. While some plugs actuate one sliding sleeve only, sometimes it is desirable to have a plug that actuates a plurality of sleeves as it moves through a string. Thus, some constrictions have been developed that are able to be overcome: to catch a plug, be actuated by the plug, and then release the plug. Such constrictions, which may be referred to herein as "pass-through" constrictions, may employ collets which require the corresponding downhole tool to be of a certain length, for example, a minimum of 2 meters, to accommodate the length of the collets. As a result, the maximum number of such downhole tools that can be installed on the same wellbore string is limited. Other pass-through constrictions employ radially inwardly protruding retractable dogs or pins, which could damage the plug as the plug passes therethrough. Further, the retractable dogs or pins are prone to erosion caused by the high volume of fluid flowing therepast during wellbore treatment operations.

In staged well treatment operations, a plurality of isolated zones within a well are created and the wellbore string may have a plurality of spaced apart sliding sleeve-based downhole tools along its length to provide a system of ports that are openable to provide selective access to each such isolated zone. One or more of the sleeves of the downhole tools may have a sealable seat formed in its inner diameter and each seat can be formed to accept a plug of a selected diameter while allowing plugs of smaller diameters to pass therethrough. As such, a port can be selectively opened by launching a particular sized plug, which is selected to seal against the seat of that port. Unfortunately, in such a wellbore treatment system, the number of zones that may be accessed is limited. In particular, limitations with respect to the inner diameter of wellbore tubulars, often due to the inner diameter of the well itself, restrict the number of different sized seats that can be installed in any one wellbore string. For example, if the well diameter dictates that the largest sleeve seat in a well can at most accept a 3¾" plug, then the wellbore string will generally be limited to approximately eleven sleeves and, therefore, treatment can only be effected in eleven stages. Further, the seats that are configured to catch smaller plugs have smaller inner diameters, which may limit the flow volume of the eventual production fluid.

In other wellbore treatment systems, the sleeve seats of all the downhole tools in the wellbore string are identical and the plug can be activated to transition from an initial position to an activated position. In the initial position, the plug can pass through the sleeve seat without shifting the sleeve. In the activated position, the plug is transformed, for example, to increase in size to engage the sleeve seat to shift the sleeve. An advantage of using the same size sleeve seats throughout the tubing string is that the resulting wellbore treatment system can have more than eleven stages. Also, if all the sleeve seats in the wellbore string are identical, the downhole tools do not have to be installed in any particular order on the string, thereby minimizing installation errors. In such systems, however, the plugs have to be removed, e.g., by milling, after the wellbore treatment operation to allow wellbore fluid to flow up the inner bore of the wellbore string unobstructed.

Sometimes during a wellbore treatment operation, for example, when there is a screen out, an activatable plug could flow inadvertently backwards (i.e., uphole) towards the surface rather than downhole as intended. If the plug is activated while flowing backwards or after having flowed backwards, the plug could engage or miscount a sleeve in error, causing unnecessary blockage in the wellbore string or navigation errors.

The present disclosure thus aims to address the above-mentioned issues.

SUMMARY

According to a broad aspect of the present disclosure, there is provided a method comprising: deploying a device into a wellbore, the device being in an inactivated position and the device being actuable to transition from the inactivated position to an activated position, wherein in the activated position, the device is configured to engage a downhole tool in the wellbore; determining, by the device, a direction of travel of the device; and upon determining that the direction of travel is uphole, deactivating the device to prevent the device from transitioning into the activated position.

In some embodiments, determining the direction of travel comprises determining an acceleration of the device, and the direction of travel is determined is based at least in part on the acceleration of the device.

In some embodiments, the direction of travel is uphole when the acceleration is negative for at least a predetermined timespan.

According to another broad aspect of the disclosure, there is provided a dart for deployment into a wellbore, the dart comprising: a body having a leading end, a trailing end, a ball seat defined therein, and an inner flow path defined therein, the inner flow path having: one or more inlets, each inlet of the one or more inlets extending radially in the body and opening to a respective circumferential location at a lengthwise side of the body, the respective circumferential location being between the leading end and the trailing end; and an outlet at the trailing end of the body, the ball seat being positioned between the one or more inlets and the outlet; a ball releasably receivable in the ball seat, wherein when the ball is received in the ball seat, the ball blocks fluid communication between the one or more inlets and the outlet, and when the ball is released from the ball seat, fluid communication is permitted between the one or more inlets and the outlet; and an engagement mechanism slidably supported on an outer surface of the body, the engagement mechanism being movable relative to the body from a first position to a second position, wherein in the first position, the engagement mechanism blocks the one or more inlets at the respective circumferential locations, and in the second position, the one or more inlets are unblocked by the engagement mechanism, the dart being actuable to transition from an inactivated position to an activated position, wherein: in the inactivated position, the engagement mechanism is in the first position and the ball is received in the ball seat; and in the activated position, the engagement mechanism is in the second position to permit fluid flow into the one or more inlets at the respective circumferential locations for releasing the ball from the ball seat.

In some embodiments, the ball is configured to exit the body at the trailing end when released from the ball seat.

In some embodiments, at least a portion of an outer surface of the dart is coated with a protective coating.

In some embodiments, the protective coating is a ceramic coating or a polymer coating.

In some embodiments, at least a portion of the dart is made of a material that dissolves in the presence of one or more of: flowback fluids, frac fluids, wellbore treatment fluids, load fluids, and production fluids.

In some embodiments, at least a portion of the dart is made of one or more of: aluminum, a brass alloy, a steel alloy, an aluminum alloy, a magnesium alloy.

In some embodiments, at least a portion of the dart is made of one or more of: polyglycolic acid (PGA), polyvinyl acetate (PVA), polylactic acid (PLA), and a copolymer comprising PGA and PLA.

According to another broad aspect of the present disclosure, there is provided a method comprising: pumping a treatment fluid into an inner passageway of a tubing string in wellbore, the tubing string having installed therein a first downhole tool; deploying a first dart into the inner passageway; activating the first dart prior to encountering the first downhole tool; engaging, by the first dart, the first downhole tool; opening one or more ports in the first downhole tool by increasing a fluid pressure above the first dart; stopping the pumping of the treatment fluid; initiating flowback to surface; and opening a flowback valve in the first dart to permit fluid communication between a trailing end of the dart and one or more circumferential locations of the dart via an inner flow path defined in the dart, each of the one or more circumferential locations being at a lengthwise side of the dart and positioned at an axial location between the trailing end and a leading end of the dart.

In some embodiments, activating the first dart comprises unblocking one or more inlets of the inner flow path.

In some embodiments, opening the flowback valve comprises releasing a ball from a ball seat defined in the inner flow path.

In some embodiments, the method comprises removing the ball from the first dart via an outlet of the inner flow path.

In some embodiments, the method comprises, after initiating flowback to surface, monitoring a salinity of a flowback fluid at surface.

In some embodiments, the method comprises dissolving at least a portion of the first dart in the inner passageway; and estimating a rate of dissolution of the first dart based, at least in part, on the salinity.

In some embodiments, the method comprises prior to initiating flowback to surface, detecting a screen out.

In some embodiments, the method comprises, after opening the flowback valve in the first dart, resuming the pumping of the treatment fluid.

In some embodiments, the method comprises closing the flowback valve in the first dart.

In some embodiments, the method comprises, prior to detecting a screen out, deploying a second dart into the inner passageway; and after initiating flowback to surface, deactivating the second dart to prevent the second dart from transitioning into an activated position.

According to another broad aspect the present disclosure, there is provided a pass-through tool for coupling to a downhole tubing string, the pass-through tool comprising: an outer housing having an upper end, a lower end, and an inner surface defining an inner axial bore extending between the upper end and the lower end, the inner surface having defined thereon a shoulder; an actuable mechanism movably coupled to the inner surface, the actuable mechanism having a wall, the actuable mechanism being configured to transition from a first position to a second position, wherein the actuable mechanism is closer to the upper end in the first position than in the second position; a pass-through constriction comprising: a plurality of retractable dogs, at least a portion of each retractable dog of the plurality of retractable dogs being radially movably received in the wall of the actuable mechanism, the plurality of retractable dogs being circumferentially spaced apart from one another in the wall; and a C-ring positioned in between and circumferentially supported by the plurality of retractable dogs, the C-ring being expandable from a closed position to an open position and the C-ring being spring-biased to expand radially to the open position, wherein in the closed position and the open position, the C-ring has defined therethrough a restricted opening and an expanded opening, respectively, the expanded opening being larger than the restricted opening, wherein when the actuable mechanism is in the first position, the plurality of retractable dogs are positioned above the shoulder and the C-ring is held in the closed position by the plurality of dogs, and when the actuable mechanism is in the second position, the plurality of retractable dogs are positioned below the shoulder and the C-ring is radially expanded into the open position.

In some embodiments, the restricted opening is sized to allow a device to engage the C-ring and the expanded opening is sized to permit passage of the device through the C-ring.

According to another broad aspect of the present disclosure, there is provided a downhole tubing string comprising a plurality of consecutively positioned pass-through tools.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

FIGS. 2A to 2C may be collectively referred to herein as FIG. 2.

FIGS. 3A, 3B, and 3C may be collectively referred to herein as FIG. 3.

FIGS. 7A to 7C may be collectively referred to herein as FIG. 7.

FIGS. 8A to 8C may be collectively referred to herein as FIG. 8.

FIGS. 9A to 9C may be collectively referred to herein as FIG. 9.

FIGS. 10A to 10C may be collectively referred to herein as FIG. 10.

FIGS. 11A and 11B may be collectively referred to herein as FIG. 11.

FIGS. 12A and 12B may be collectively referred to herein as FIG. 12.

FIGS. 16A and 16B may be collectively referred to herein as FIG. 16.

FIGS. 20A and 20B may be collectively referred to herein as FIG. 20.

FIGS. 21A and 21B may be collectively referred to herein as FIG. 21.

DETAILED DESCRIPTION

Figure 1A:
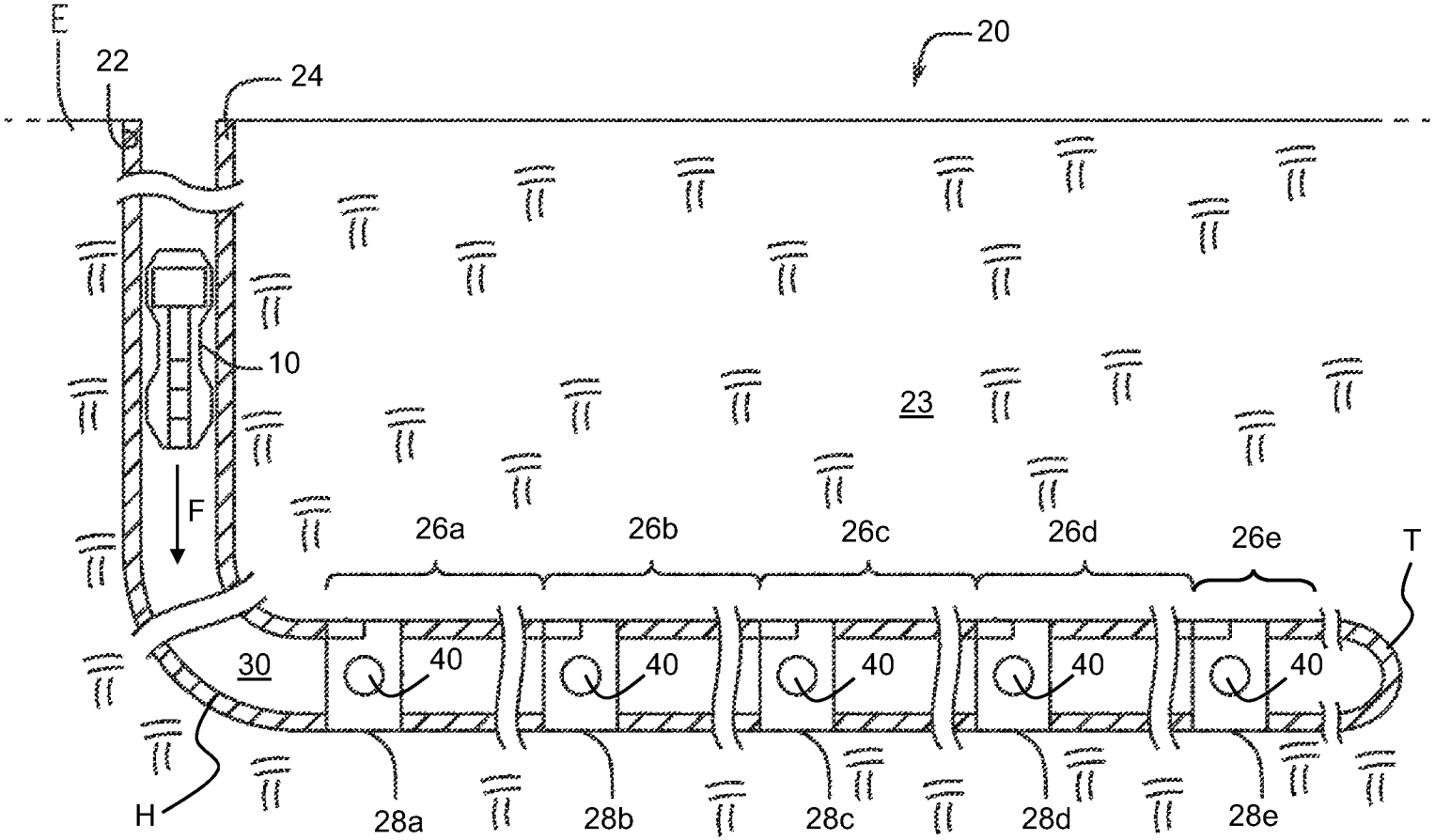
FIG. 1A is a schematic drawing of a multiple stage well according to one embodiment of the present disclosure.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

In general, methods are disclosed herein for purposes of deploying a device into a wellbore that extends through a subterranean formation, and using an autonomous operation of the device to perform a downhole operation that may or may not involve actuation of a downhole tool. In some embodiments, the device is an untethered object sized to travel through a passageway (e.g. the inner bore of a tubing string) and various tools in the tubing string. The device may also be referred to as a dart, a plug, a ball, or a bar and may take on different forms. The device may be pumped into the tubing string (i.e., pushed into the well with fluid), although pumping may not be necessary to move the device through the tubing string in some embodiments.

In some embodiments, the device is deployed into the passageway, and is configured to autonomously monitor its position in real-time as it travels in the passageway, and upon determining that it has reached a given target location in the passageway, autonomously operates to initiate a downhole operation. In some embodiments, the device is deployed into the passageway in an initial inactivated position and remains so until the device has determined that it has reached the predetermined target location in the passageway. Once it reaches the predetermined target location, the device is configured to selectively self-activate into an activated position to effect the downhole operation.

As just a few examples, the downhole operation may be one or more of: a stimulation operation (a fracturing operation or an acidizing operation as examples); an operation performed by a downhole tool (the operation of a downhole valve, the operation of a packer the operation of a single shot tool, or the operation of a perforating gun, as examples); the formation of a downhole obstruction; the diversion of fluid (the diversion of fracturing fluid into a surrounding formation, for example); the pressurization of a particular stage of a multiple stage well; the shifting of a sleeve of a downhole tool; the actuation of a downhole tool; and the installation of a check valve in a downhole tool. A stimulation operation includes stimulation of a formation, using stimulation fluids, such as for example, acid, water, oil, $CO_2$ and/or nitrogen, with or without proppants.

In some embodiments, the preselected target location is a position in the passageway that is uphole from a target tool in the passageway to thereby allow the device to determine its impending arrival at the target tool. By determining its real-time location, the device can self-activate in anticipation of its arrival at the target tool downhole therefrom. In some embodiments, the target location may be a specific distance downhole relative to, for example, the surface opening of the wellbore. In other embodiments, the target location is a downhole position in the passageway somewhere uphole from the target tool.

As disclosed herein, in some embodiments, the device may monitor and/or determine its position based on physical contact with and/or physical proximity to one or more features in the passageway. Each of the one or more features may or may not be part of a tool in the passageway. For example, a feature in the passageway may be a change in geometry (such as a constriction), a change in physical property (such as a difference in material in the tubing string), a change in magnetic property, a change in density of the material in the tubing string, etc. In alternative or additional embodiments, the device may monitor and/or determine its downhole location by detecting changes in magnetic flux as the device travels through the passageway. In alternative or additional embodiments, the device may monitor and/or determine its position in the passageway by calculating the distance the device has traveled based, at least in part, on acceleration data of the device.

In some embodiments, the device comprises a body, a control module, and an actuation mechanism. In the inactivated position, the body of the device is conveyable through the passageway to reach the target location. The control module is configured to determine whether the device has reached the target location, and upon such determination, cause the actuation mechanism to operate to transition the device into the activated position. In embodiments where the device is employed to actuate a target tool, the device in its activated position may actuate the target tool by deploying an engagement mechanism to engage with the target tool and/or create a seal in the tubing string adjacent the target tool to block fluid flow therepast, to for example divert fluids into the subterranean formation.

In some embodiments, in the inactivated position, the device is configured to pass through downhole constrictions (valve seats or tubing connectors, for example), thereby allowing the device to be used in, for example, multiple stage applications in which the device is used in conjunction with seats of the same size so that the device may be selectively configured to engage a specific seat. The device and related methods may be used for staged injection of treatment fluids wherein fluid is injected into one or more selected intervals of the wellbore, while other intervals are closed. In some embodiments, the tubing string has a plurality of port subs along its length and the device is configured to contact and/or detect the presence of at least some of the features along the tubing string to determine its impending arrival at a target tool (e.g. a target port sub). Upon such determination, the device self-activates to open the port of the target port sub such that treatment fluid can be injected through the open port to treat the interval of the subterranean formation that is accessible through the port.

In some embodiments, the device is configured to autonomously determine its direction of travel in real-time and self-deactivates when it is determined that the device is travelling uphole in the wellbore. By self-deactivating, the device remains in the initial position and prevents itself from transforming into the activated position. The ability to self-deactivate may be useful, for example, during a screen out, when the device is travelling uphole instead of downhole as intended. By deactivating and remaining in the initial position, the device is prevented from inadvertently engaging the wrong tool in the tubing string as a result of any errors in the device's determination of its real-time downhole location caused by the device's temporary movement in the uphole direction. In some embodiments, once the device is deactivated, a second device can be launched and activated to complete the intended task.

In some embodiments, at least a portion of the device is dissolvable under certain conditions, for example, when exposed to wellbore fluid (sometimes also referred to as production fluid), and the device has a mechanism to help control and/or speed up the rate of the dissolution of the device. In some embodiments, at least a portion of the outer surface of the device is initially covered with a protective coating when the device is deployed into the wellbore to prevent premature dissolution of the device, for example, where the device may be exposed to treatment fluid (e.g., acid) prior to its activation. In some embodiments, the device is configured to begin dissolution after the device has been transformed into the activated position and/or has effected the intended downhole operation. In some embodiments, the dissolution of at least part of the device allows the undissolved parts of the device to be removed from the wellbore by, for example, flowback fluids that are pumped to surface, such that it is not necessary to perform any post-treatment intervention (e.g., milling) to remove the device from the tubing string.

In some embodiments, one or more of the downhole tools in the tubing string comprise a respective pass-through constriction, which is configured to engage with the activated device momentarily, for example, to shift a sleeve, but thereafter allow the activated device to pass through the downhole tool to travel further downhole. A downhole tool having a pass-through constriction may be referred to herein as a pass-through tool. In some embodiments, the pass-through constriction comprises a mechanism that is shorter in length than the convention collets, so that the corresponding sleeve and accordingly the corresponding downhole tool can be shorter in length. By using shorter downhole tools in the tubing string, adjacent downhole tools may be spaced more closely together along the length of the tubing string, thereby allowing more downhole tools to be placed downhole for accessing more areas along the wellbore. In some embodiments, the mechanism may be more erosion-resistant and cause less damage to the device passing therepast than conventional dogs or pins.

In some embodiments, the tubing string may have a plurality (or "cluster") of consecutively positioned pass-through tools such that a single activated device can engage the cluster of pass-through tools as the device travels downhole, for example, to sequentially shift a plurality of sleeves and opening multiple ports. In some embodiments, the cluster of pass-through tools are positioned uphole from a non-pass-through tool, i.e., a downhole tool that is configured to catch the activated device.

The devices and methods described herein may be used in various borehole conditions including open holes, cased holes, vertical holes, horizontal holes, straight holes or deviated holes.

Referring to FIG. 1A, in accordance with some embodiments, a multiple stage ("multistage") well 20 includes a wellbore 22, which traverses one or more subterranean formations 23 (hydrocarbon bearing formations, for example). In some embodiments, the wellbore 22 may be lined, or supported, by a tubing string 24. The tubing string 24 may be cemented to the wellbore 22 (such wellbores typically are referred to as "cased hole" wellbores); or the tubing string 24 may be secured to the formation 23 by packers (such wellbores typically are referred to as "open hole" wellbores). In general, the wellbore 22 extends through one or multiple zones, or stages. In a sample embodiment, as shown in FIG. 1A, wellbore 22 has five stages 26*a*,26*b*,26*c*,26*d*,26*e*. In other embodiments, wellbore 22 may have fewer or more stages. In some embodiments, the well 20 may contain multiple wellbores, each having a tubing string that is similar to the illustrated tubing string 24. In some embodiments, the well 20 may be an injection well or a production well.

In some embodiments, multiple stage operations may be sequentially performed in well 20, in the stages 26*a*,26*b*,26*c*,26*d*,26*e* thereof in a particular direction (for example, in a direction from the toe T of the wellbore 22 to the heel H of the wellbore 22) or may be performed in no particular direction or sequence, depending on the particular multiple stage operation.

In the illustrated embodiment, the well 20 includes downhole tools 28*a*,28*b*,28*c*,28*d*,28*e* that are located in the respective stages 26*a*,26*b*,26*c*,26*d*,26*e*. Each tool 28*a*,28*b*,28*c*,28*d*,28*e* may be any of a variety of downhole tools, such as a valve (a circulation valve, a casing valve, a sleeve valve, and so forth), a seat assembly, a check valve, a plug assembly, and so forth, depending on the particular embodiment. Moreover, all the tools 28*a*,28*b*,28*c*,28*d*,28*e* may not necessarily be the same and the tools 28*a*,28*b*,28*c*,28*d*,28*e* may comprise a mixture and/or combination of different tools (for example, a mixture of casing valves, plug assemblies, check valves, etc.). While the illustrated embodiment shows one tool 28*a*,28*b*,28*c*,28*d*,28*e* in each stage 26*a*,26*b*,26*c*,26*d*,26*e*, each stage may comprise a plurality of tools in other embodiments. Where a stage has more than one tool, the tools within that stage may or may not be identical to one another.

Each tool 28*a*,28*b*,28*c*,28*d*,28*e* may be selectively actuated by a device 10, which in the illustrated embodiment is a dart, deployed through the inner passageway 30 of the tubing string 24. In general, the dart 10 has an inactivated position to permit the dart to pass relatively freely through the passageway 30 and through one or more tools 28*a*,28*b*,28*c*,28*d*,28*e*, and the dart 10 has an activated position, in which the dart is transformed to thereby engage a selected one of the tools 28*a*,28*b*,28*c*,28*d*, or 28*e* (the "target tool") or be otherwise secured at a selected downhole location, for example, for purposes of performing a particular downhole operation. Engaging a downhole tool may include one or more of: physically contacting, wirelessly communicating with, and landing in (or "being caught by") the downhole tool.

In the illustrated embodiment shown in FIG. 1A, dart 10 is deployed from the opening of the wellbore 22 at the Earth surface E into passageway 30 of tubing string 24 and propagates along passageway 30 in a downhole direction F until the dart 10 determines its impending arrival at the target tool, for example tool 28*d* (as further described hereinbelow), transforms from its initial inactivated position into the activated position (as further described hereinbelow), and engages the target tool 28*d*. It is noted that the dart 10 may be deployed from a location other than the Earth surface E. For example, the dart 10 may be released by a downhole tool. As another example, the dart 10 may be run downhole on a conveyance mechanism and then released downhole to travel further downhole untethered.

In some embodiments, each stage 26*a*,26*b*,26*c*,26*d*,26*e* has one or more features 40. Any of the features 40 may be part of the tool itself 28*a*,28*b*,28*c*,28*d*,28*e* or may be positioned elsewhere within the respective stage 26*a*,26*b*,26*c*,26*d*,26*e*, for example at a defined distance from the tool within the stage. In some embodiments, a feature 40 may be another downhole tool, such as a port sub, that is separate from tool 28*a*,28*b*,28*c*,28*d*,28*e* and positioned within the corresponding stage. In some embodiments, a feature 40 may be positioned between adjacent tools or at an intermediate position between adjacent tools, such as a joint between adjacent segments of the tubing string. In some embodiments, a stage 26*a*,26*b*,26*c*,26*d*,26*e* may contain multiple features 40 while another stage may not contain any features 40. In some embodiments, the features 40 may or may not be evenly/regularly distributed along the length of passageway 30. As a person in the art can appreciate, other configurations are possible. In some embodiments, the downhole locations of the features 40 in the tubing string 24 are known prior to the deployment of the dart 10, for example via a well map of the wellbore 22.

In some embodiments, the dart 10 autonomously determines its downhole location in real-time, remains in the inactivated position to pass through tool(s) (e.g. 28*a*,28*b*, 28*c*) uphole of the target tool 28*d*, and transforms into the activated position before reaching the target tool 28*d*. In some embodiments, the dart 10 determines its downhole location within the passageway by physical contact with one or more of the features 40 uphole of the target tool. In alternative or additional embodiments, the dart 10 determines its downhole location by detecting the presence of one or more of the features 40 when the dart 10 is in close proximity with the one or more features 40 uphole of the target tool. In alternative or additional embodiments, the dart 10 determines its downhole location by detecting changes in magnetic field and/or magnetic flux as the dart travels through the passageway 30. In alternative or additional embodiments, the dart 10 determines its downhole location by calculating the distance the dart has traveled based on real-time acceleration data of the dart. The above embodiments may be used alone or in combination to ascertain the (real-time) downhole location of the dart. The results obtained from two or more of the above embodiments may be correlated to determine the downhole location of the dart more accurately. The various embodiments will be described in detail below.

Figure 2A:
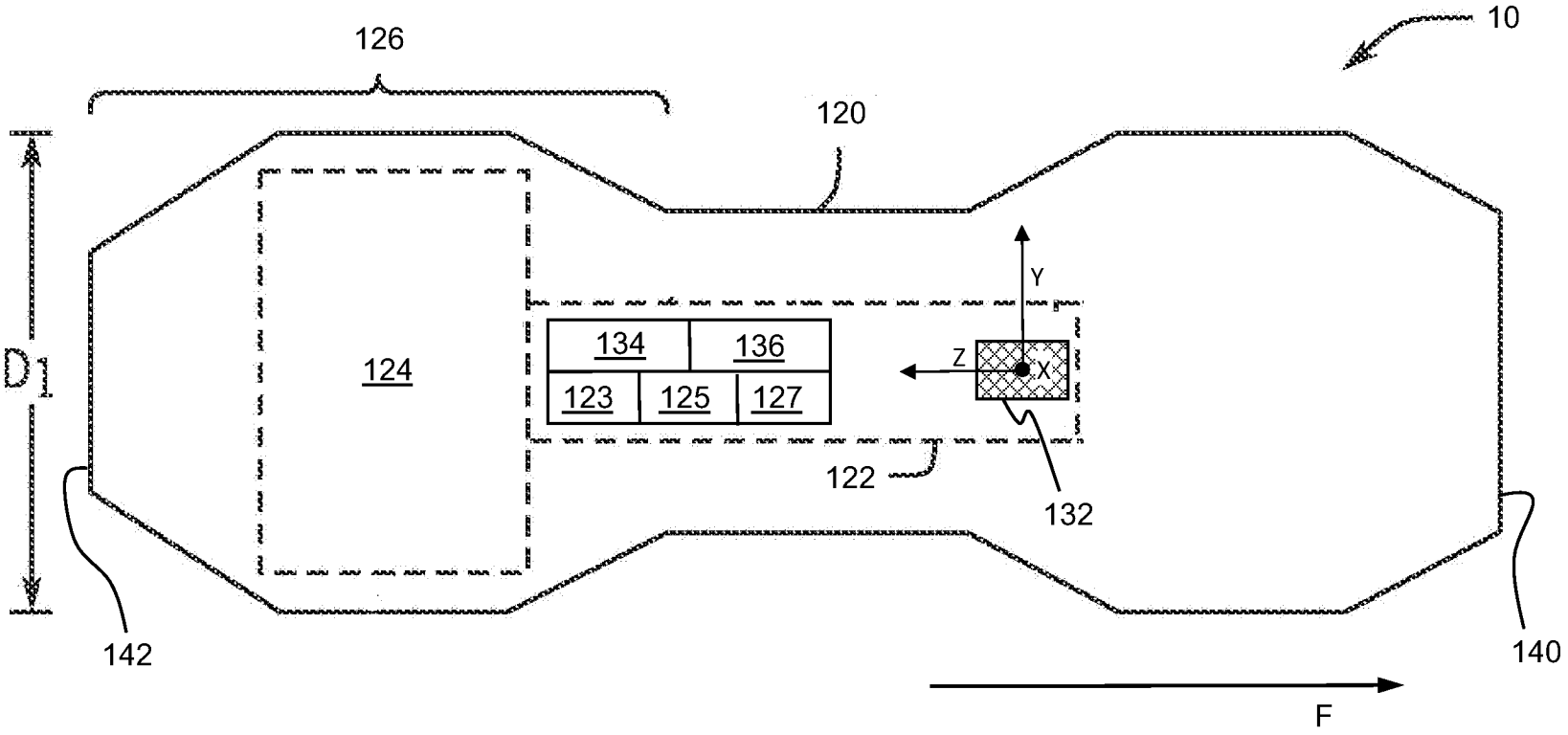
FIG. 2A is a schematic axial cross-sectional view of a dart according to an embodiment of the present disclosure.

A sample embodiment of dart 10 is shown in FIG. 2A. In the illustrated embodiment, dart 10 comprises a body 120, a control module 122, an actuation mechanism 124. The body 120 has an engagement section 126. The body 120 has a leading end 140 and a trailing end 142 between which the actuation mechanism 124, the engagement section 126, and the control module 122 are positioned. The body 120 is configured to allow the dart, including the engagement section 126, to travel freely through the passageway 30 and the features 40 therein when the dart 10 is in the inactivated position. In its inactivated position, the dart 10 has a largest outer diameter $D_1$ that is less than the inner diameter of the features 40 to allow the dart 10 to pass therethrough. When the dart 10 is in the activated position, the engagement section 126 is transformed by the actuation mechanism 124 for the purpose of, for example, causing the next encountered tool (i.e., the target tool) to engage the engagement section 126 to catch the dart 10. For example, when activated, the engagement section 126 is deployed to have an outer diameter that is greater than $D_1$ and the inner diameter of a seat in the target tool.

In some embodiments, the control module 122 comprises a controller 123, a memory module 125, and a power source 127 (for providing power to one or more components of the dart 10). In some embodiments, the control module 122 comprises one or more of: a magnetometer 132, an accelerometer 134, and a gyroscope 136, the functions of which will be described in detail below.

In some embodiments, the controller 123 comprises one or more of: a microcontroller, microprocessor, field programmable gate array (FPGA), or central processing unit (CPU), which receives feedback as to the dart's position and generates the appropriate signal(s) for transmission to the actuation mechanism 124. In some embodiments, the controller 123 uses a microprocessor-based device operating under stored program control (i.e., firmware or software stored or imbedded in program memory in the memory module) to perform the functions and operations associated with the dart as described herein. According to other embodiments, the controller 123 may be in the form of a programmable device (e.g. FPGA) and/or dedicated hardware circuits. The specific implementation details of the above-mentioned embodiments will be readily within the understanding of one skilled in the art. In some embodiments, the controller 123 is configured to execute one or more software, firmware or hardware components or functions to perform one or more of: analyze acceleration data and gyroscope data; calculate distance using acceleration data and gyroscope data; and analyze magnetic field and/or flux signals to detect, identify, and/or recognize a feature 40 in the tubing string based on physical contact with the feature and/or proximity to the feature.

In some embodiments, the dart 10 is programmable to allow an operator to select a target location downhole at which the dart is to self-activate. The dart 10 is configured such that the controller 123 can be enabled and/or preprogrammed with the target location information during manufacturing or on-site by the operator prior to deployment into the well. In some embodiments, the dart 10 may be preprogrammed during manufacturing and subsequently reprogrammed with different target location information on site by the operator. In some embodiments, the control module 122 is configured with a communication interface, for example, a port for connecting a communication cable or a wireless port (e.g. Radio Frequency or RF port) for receiving (transmitting) radio frequency signals for programming or configuring the controller 123 with the target location information. In some embodiments, where the controller 123 is disposed within an RF shield enclosure such as an aluminum and/or magnesium enclosure, modulation of magnetic field, sound, and/or vibration of the enclosure can be used to communicate with the controller 123 to program the target location. In some embodiments, the control module 122 is configured with a communication interface that is coupled (wireless or cable connection) to an input device (e.g., computer, tablet, smart phone or like) and/or includes a user interface that queries the operator for information and processes inputs from the operator for configuring the dart and/or functions associated with the dart or the control module. For example, the control module 122 may be configured with an input port comprising one or more user settable switches that are set with the target location information. Other configurations of the control module 122 are possible.

In some embodiments, the target location information comprises a specific number of features 40 in the tubing string 24 through which the dart 10 passes prior to self-activation. For example, dart 10 may be programmed with target location information specifying the number "five" so the dart remains inactivated until the controller 123 registers five counts, indicating that the dart has passed through five features 40, and the dart self-activates before reaching the next (sixth) feature in its path. In this embodiment, the sixth feature is the target tool. In an alternative embodiment, the target location information comprises the actual feature number of the target tool in the tubing string. For example, if the target tool is the sixth feature in the tubing string, the dart 10 can be programmed with target location information specifying the number "six" and the controller 123 in this case is configured to subtract one from the number of the target location information and triggers the dart 10 to self-activate after passing through five features.

In some embodiments, the controller maintains a count of each registered feature (via an electronics-based counter, for example), and the count may be stored in memory 125 (a volatile or a non-volatile memory) of the dart 10. The controller 123 thus logs when the dart 10 passes a feature 40 and updates the count accordingly, thereby determining the dart's downhole position based on the count. When the dart 10 determines that the count (based on the number of features 40 registered) matches the target location information programmed into the dart, the dart self-activates.

In other embodiments, the target location information comprises a specific distance from surface E at which the dart 10 is to self-activate. For example, a dart may be programmed with target location information specifying a distance of "100 meters" so the dart remains inactivated until the controller 123 determines that the dart 10 has travelled 100 meters in the passageway 30. When the controller 123 determines that the dart has reached the target location, the dart 10 self-activates. In this embodiment, the target tool is the next tool in the dart's path after self-activation.

In some embodiments, the well map may be stored in the memory 125 and the controller 123 may reference the well map to help determine the real-time location of the dart.

Physical Contact

Figure 1B:
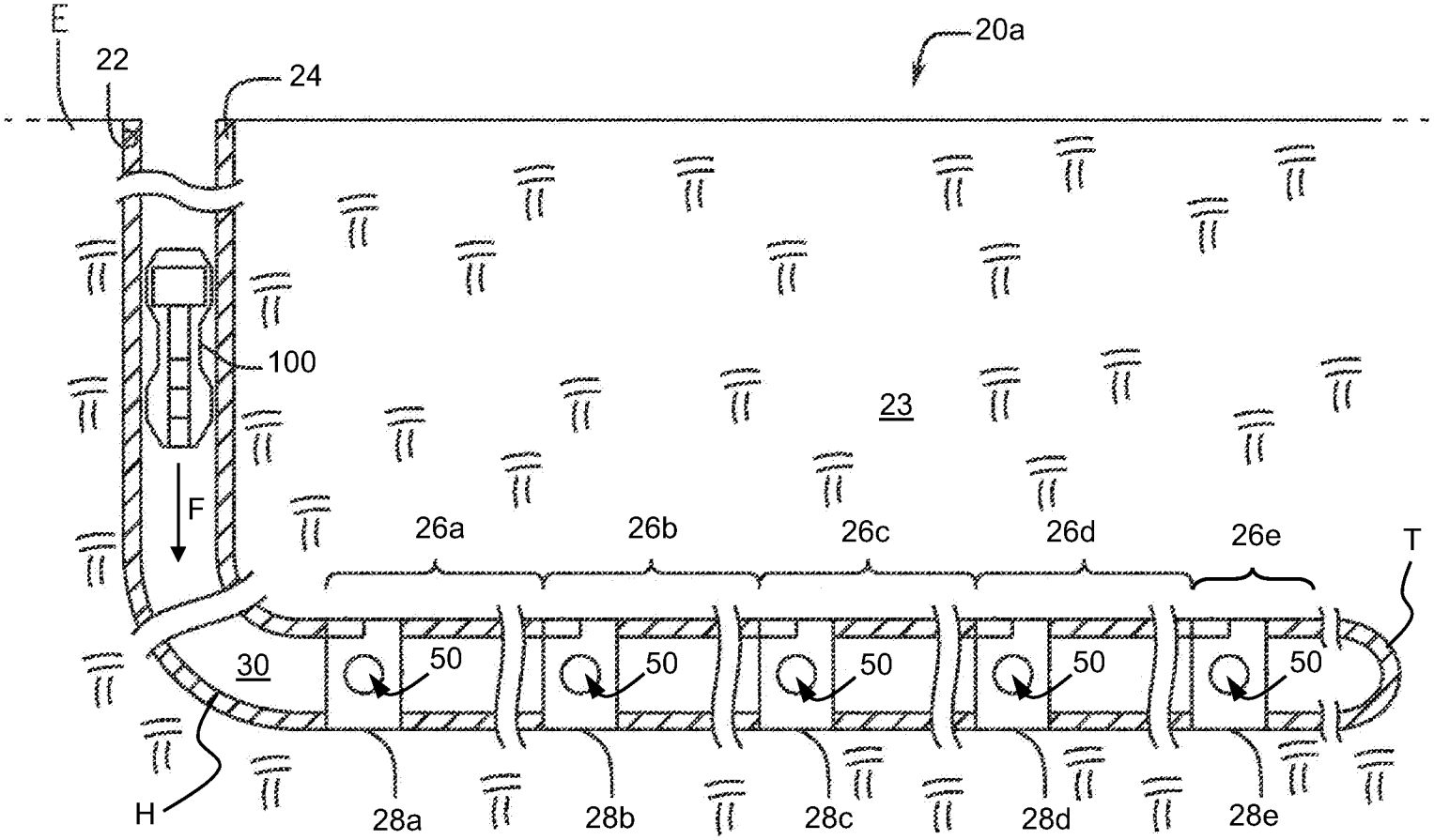
FIG. 1B is a schematic drawing of a multiple stage well according to another embodiment of the present disclosure, wherein the well comprises one or more constrictions.

FIG. 1B illustrates a multistage well 20*a* similar to the multistage well 20 of FIG. 1A, except at least one feature in each stage 26*a*,26*b*,26*c*,26*d*,26*e* of the well 20*a* is a constriction 50, i.e., an axial section that has a smaller inner diameter than that of the surrounding segments of the tubing string. The inner diameter of the constriction 50 is sized such that the dart, in its inactivated position, can pass therethrough but at least one part of the dart is in physical contact with the constriction 50 in order to pass therethrough. The inner diameter of each of the constrictions 50 may be substantially the same throughout the tubing string. In some embodiments, the constriction 50 may be a valve seat or a joint between adjacent segments of the tubing string or adjacent tools.

Figure 2B:
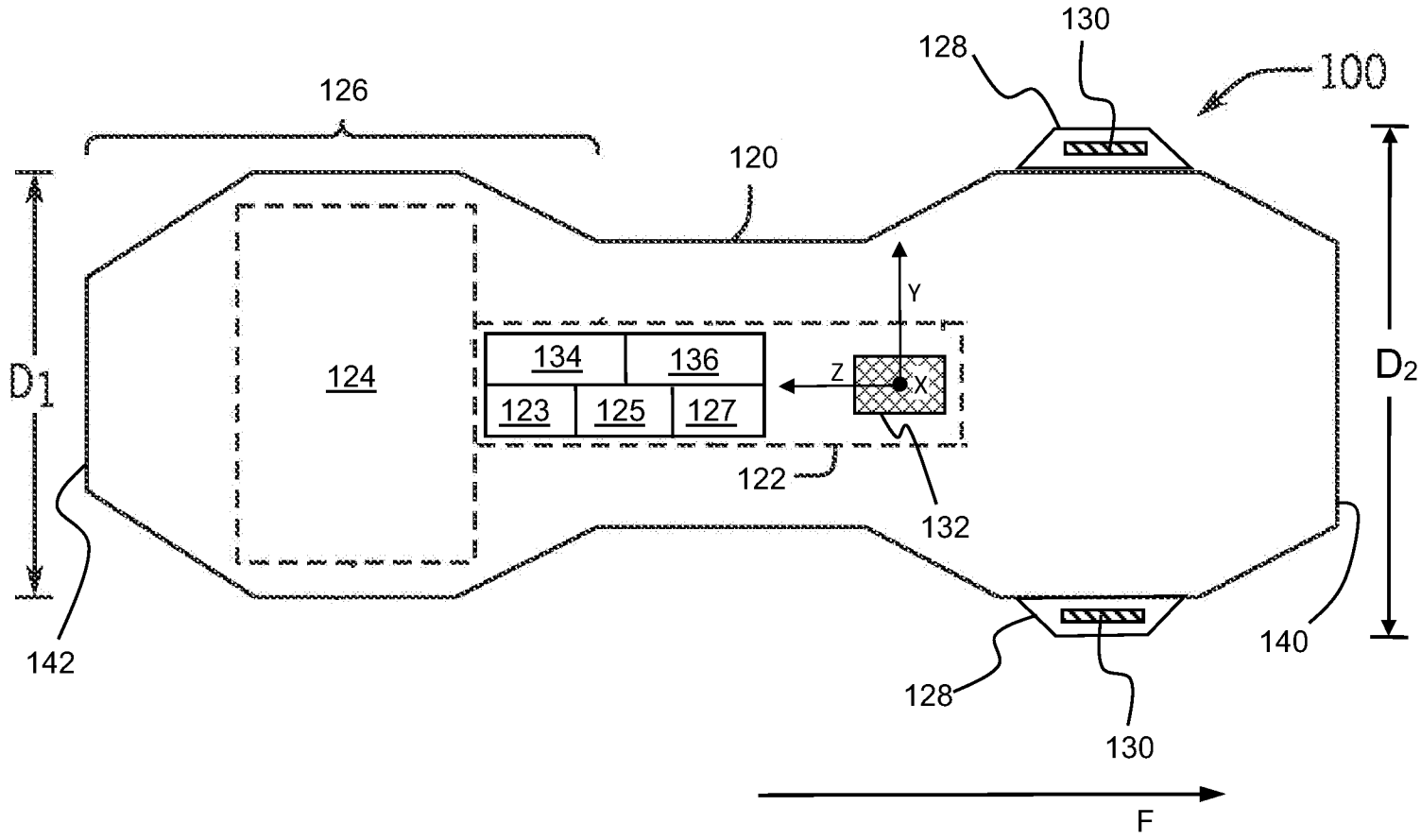
FIG. 2B is a schematic axial cross-sectional view of a dart according to another embodiment of the present disclosure, wherein the dart comprises protrusions.

FIG. 2B shows a sample embodiment of a dart 100 configured to physically contact one or more features in the passageway to determine the dart's downhole location in relation to a target location. Dart 100 has a body 120, a control module 122, an actuation mechanism 124, and an engagement section 126, which are the same as or similar to the like-numbered components described above with respect to dart 10 in FIG. 2A. With reference to both FIGS. 1B and 2B, in some embodiments, the dart 100 comprises one or more retractable protrusions 128 that are positioned on the body 120 to be acted upon, for example depressed, by a constriction 50 in the passageway 30 as the dart passes the constriction. In the illustrated embodiment, the protrusions 128 are shown in an extended (or undepressed) position wherein protrusions 128 extend radially outwardly from the outer surface of body 120 to provide an effective outer diameter $D_2$ that is greater than the largest outer diameter $D_1$ of the body 120 when the dart 100 is in the inactivated position. The largest outer diameter $D_1$ is less than the inner diameter of the constrictions 50 to allow the dart 100 to pass through the constrictions when the dart is inactivated. Dart 100 is configured such that outer diameter $D_2$ is slightly greater than the inner diameter of the constrictions 50 in the passageway 30. When the dart 100 travels through a constriction 50, the protrusions 128 are depressed by the inner surface of the constriction into a retracted position whereby the dart 100 can pass through the constriction 50 without hinderance. In embodiments, the protrusions 128 are spring-biased or otherwise configured to extend radially outwardly from the body 120 (i.e. the extended position), to retract when depressed by a constriction 50 when passing therethrough (i.e. the retracted position), and to recoil and re-extend radially outwardly from the body 120 after passing through a constriction back into the extended position. In some embodiments, the protrusions 128 allow the control module 122 to register and count each instance of the dart 100 passing a constriction 50, which will be described in more detail below.

The protrusions 128 are positioned on the body 120 somewhere between the leading end 140 and the trailing end 142. In embodiments, the leading end 140 has a diameter less than $D_1$ such that the dart 100 initially, easily passes through the constriction 50, allowing the dart 100 to be more centrally positioned and substantially coaxial with the constriction as protrusions 128 approach the constriction. While the protrusions 128 are shown in FIG. 2 to be spaced apart axially from the engagement section 126, it can be appreciated that in other embodiments the dart 100 may be configured such that protrusions 128 coincide or overlap with the engagement section 126.

In some embodiments, the dart 100 uses electronic sensing based on physical contact with one or more constrictions 50 in the passageway 30 to determine whether it has reached the target location. In this embodiment, each protrusion 128 has a magnet 130 embedded therein and the control module 122 is configured to detect changes in the magnetic fields and/or flux associated with magnets 130 that are caused by movement of the magnets.

In some embodiments, magnets 130 may be made from a material that is magnetized and creates its own persistent magnetic field. In some embodiment, the magnets 130 may be permanent magnets formed, at least in part, from one or more ferromagnetic materials. Suitable ferromagnetic materials useful with the magnets 130 described herein may include, for example, iron, cobalt, rare-earth metal alloys, ceramic magnets, alnico nickel-iron alloys, rare-earth magnets (e.g., a Neodymium magnet and/or a Samarium-cobalt magnet). Various materials useful with the magnets 130 may include those known as Co-netic AA®, Mumetal®, Hipernon®, Hy-Mu-80®, Permalloy®, each of which comprises about 80% nickel, 15% iron, with the balance being copper, molybdenum, and/or chromium. In the embodiment described with respect to FIGS. 2 and 3, magnet 130 is a rare-earth magnet. Each of magnets 130 may be of any shape including, for example, a cylinder, a rectangular prism, a cube, a sphere, a combination thereof, or an irregular shape. In some embodiments, all of the magnets in dart 100 are substantially identical in shape and size.

In the embodiment illustrated in FIGS. 2B and 3, the control module 122 comprises the magnetometer 132, which may be a three-axis magnetometer that is configured to detect the magnitude of magnetic flux in three axes, i.e., the x-axis, the y-axis, and the z-axis. A three-axis magnetometer is a device that can measure the change in anisotropic magnetoresistance caused by an external magnetic field. Using a magnetometer to measure magnetic field and/or flux allows directional and vector-specific sensing. Further, since it does not operate under the principles of Lenz's law, a magnetometer does not require movement to measure magnetic field and/or flux. A magnetometer can detect magnetic field even when it is stationary. In some embodiments, as best shown in FIG. 3, the magnetometer 132 is positioned at or about the central longitudinal axis of the dart 100 such that the magnetometer's z-axis is substantially parallel to the direction of travel of the dart (i.e., direction F). In the illustrated embodiment, the x-axis and the y-axis of the magnetometer are substantially orthogonal to direction F, and the x-axis and y-axis are substantially orthogonal to the z-axis and to one another. In the illustrated embodiment, the y-axis is substantially parallel to the direction in which the magnets 130 are moved as the protrusions 128 are being depressed. In further embodiments, the magnetometer 132 is positioned substantially equidistance from each of the magnets 130 when the protrusions 128 are not depressed.

While the dart 100 may operate with only one protrusion 128, the dart in some embodiments may comprise two or more protrusions 128 azimuthally spaced apart on the dart's the outer surface, at about the same axial location of the dart's body 120, to provide corroborating data in order to help the controller 123 differentiate the dart's passage through a constriction 50 versus a mere irregularity in the passageway 30. For example, when the dart passes through a constriction 50, the depression of the two or more protrusions 128 occurs almost simultaneously so the controller 123 registers the incident as a constriction because all the protrusions are depressed at about the same time. In contrast, when the dart passes an irregularity (e.g. a bump or impact) on the inner surface of the tubing string, only one or two of the plurality of protrusions may be depressed, so the controller 123 does not register the incident as a constriction 50 because not all of the protrusions are depressed at about the same time. Accordingly, the inclusion of multiple protrusions 128 in the dart may help the controller 123 differentiate irregularities in the passageway from actual constrictions.

With reference to the sample embodiment shown in FIGS. 2B and 3, dart 100 has two protrusions 128, each having a magnet 130 embedded therein. The magnets 130 are azimuthally spaced apart by about 180° and are positioned at about the same axial location on the body 120 of the dart 100. Each magnet 130 is a permanent magnet having two opposing poles: a north pole (N) and a south pole (S), and a corresponding magnetic field M. In some embodiments, the magnets 130 in the dart 100 are positioned such that the same poles of the magnets 130 face one another. For example, as shown in the illustrated embodiment, magnets 130 are positioned in dart 100 such that the north poles N of the magnets face radially inwardly, while the south poles S of the magnets 130 face radially outwardly. In other embodiments, the north poles N may face radially outwardly while the south poles S face radially inwardly. It can be appreciated that, in other embodiments, dart 100 may have fewer or more protrusions and/or magnets and each protrusion may have more than one magnet embedded therein, and other pole orientations of the magnets 130 are possible.

Figure 3A:
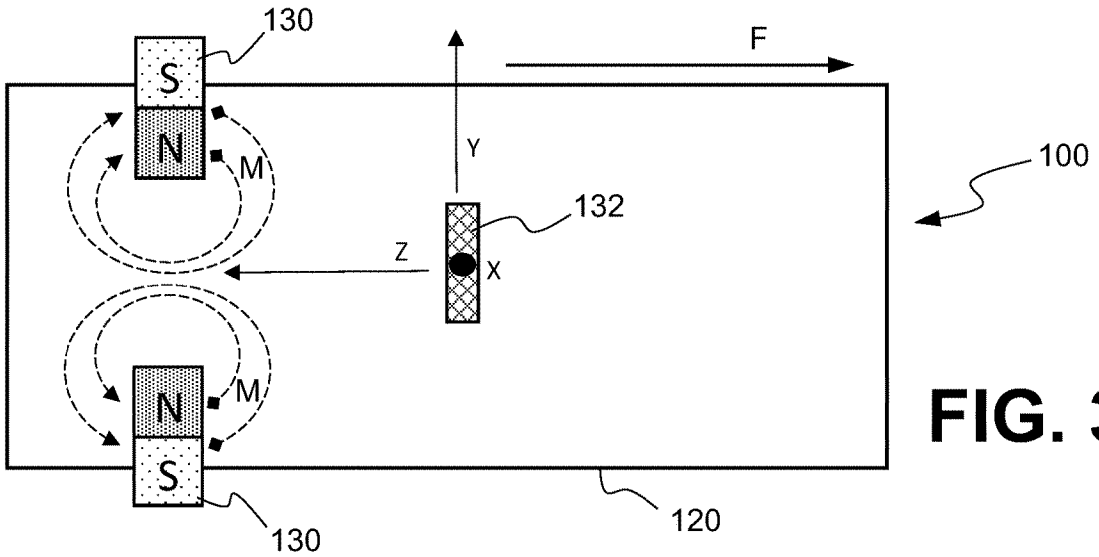
FIG. 3A is a schematic axial cross-sectional view of a dart according to one embodiment of the present disclosure, illustrating magnets in the dart and their corresponding magnet fields. Some parts of the dart in FIG. 3A are omitted for simplicity.
Figure 3B:
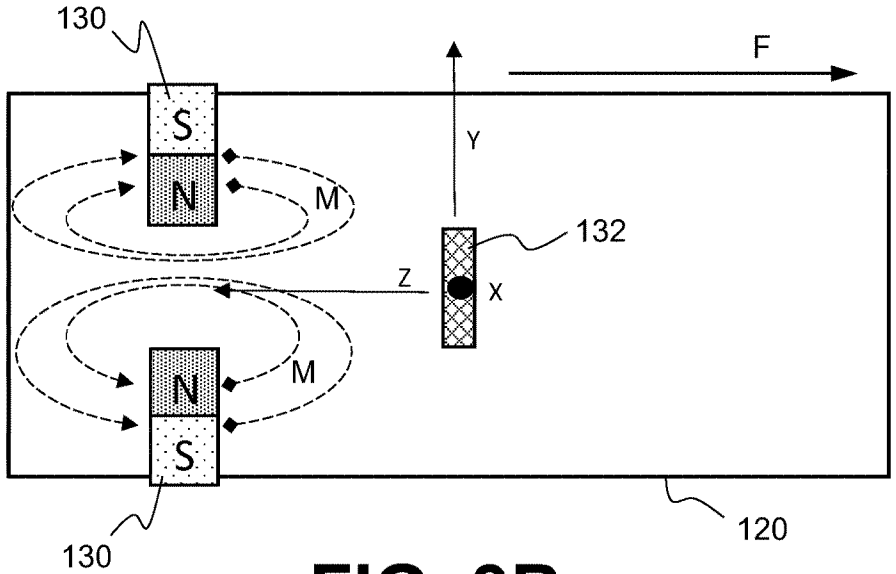
FIGS. 3B and 3C are a schematic axial cross-sectional view and a schematic lateral cross-sectional view, respectively, of the dart shown in FIG. 3A, illustrating magnetic fields of the magnets in the dart when the magnets are in a different position than that of the magnets in the dart of FIG. 3A.
Figure 3C:
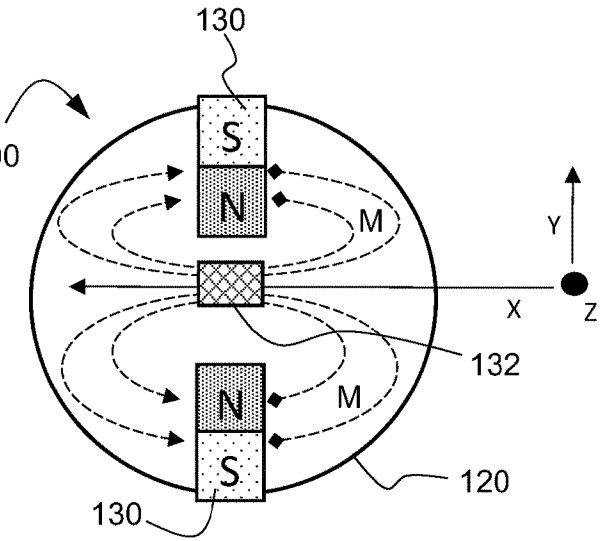

FIG. 3A shows the positions of the magnets 130 relative to one another when the protrusions (in which at least a portion of the magnets are disposed) are in the extended position where the protrusions are not depressed. FIGS. 3B and 3C show the positions of the magnets 130 relative to one another when the protrusions are in the retracted position where the protrusions are depressed, for example, by a constriction 50. Some parts of the dart 100 are omitted in FIG. 3 for clarity.

With reference to FIGS. 2B and 3, when the protrusions 128 are depressed and the magnets 130 therein are moved by some distance radially inwardly (as shown for example in FIGS. 3B and 3C), the movement of the magnets 130 changes the gradient of the vector of the magnetic field inside the dart 100. When the relative positions of the magnets 130 change, the magnetic fields M associated with the magnets 130 also change. For example, as the protrusions 128 and the magnets 130 therein move from the extended position (FIG. 3A) to the retracted position (FIGS. 3B and 3C), the positions of the magnets 130 change relative to one another (i.e., the distance between magnets 130 is decreased). In the illustrated embodiment shown in FIGS. 3B and 3C, the north poles N of the magnets 130 are closer to each other when the protrusions are depressed. The shortened distance between the magnets 130 causes the corresponding magnetic fields M to change, which in this case, to distort. The change (e.g., the distortion) of the magnetic fields of magnets 130 can be detected by measuring magnetic flux in each of the x-axis, y-axis, and z-axis using the magnetometer 132.

Based on the magnetic flux detected by the magnetometer 132, the magnetometer can generate one or more signals. In some embodiments, the controller 123 is configured to process the signals generated by the magnetometer 132 to determine whether the changes in magnetic field and/or magnetic flux detected by the magnetometer 132 are caused by a constriction 50 and, based on the determination, the controller 123 can determine the dart's downhole location relative to the target location and/or target tool by counting the number of constrictions 50 that the dart has encountered and/or referencing the known locations of the constrictions 50 in the well map of the tubing string with the counted number of constrictions. In some embodiments, the controller 123 uses a counter to maintain a count of the number of constrictions the controller registers.

Figure 4:
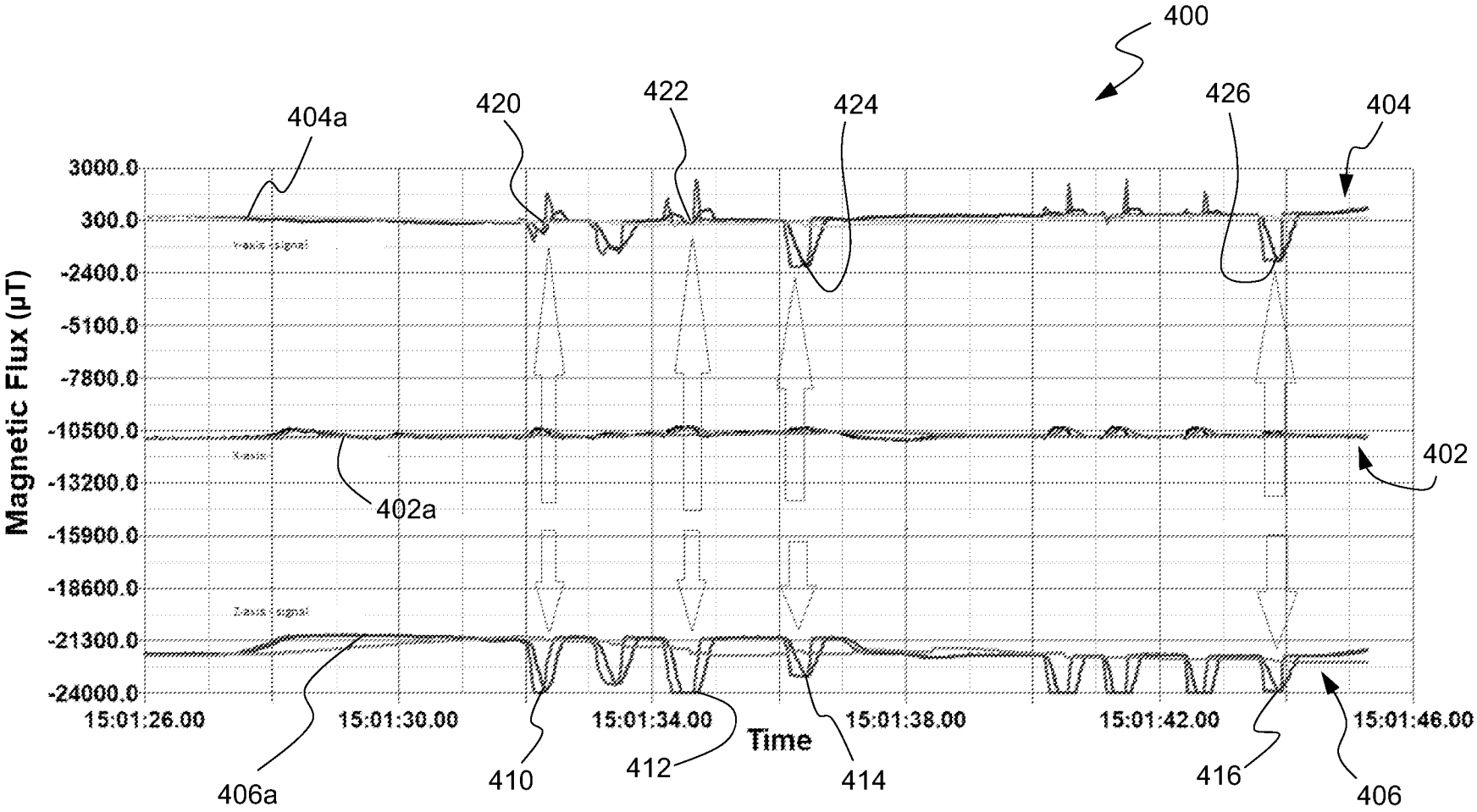
FIG. 4 is a sample graphical representation of the x-axis, y-axis, and z-axis components of magnetic flux over time, as measured by a magnetometer of a dart, as the dart is travelling through a passageway, according to one embodiment of the present disclosure.

FIG. 4 shows a sample plot 400 of signals generated by the magnetometer 132. In plot 400, the x-axis, the y-axis, and the z-axis components of the magnetic flux measured over time as the dart 100 is traveling down the tubing string are represented by lines 402,404,406, respectively, and they correspond respectively to the x-axis, y-axis, and z-axis directions indicated in FIG. 3. In some embodiments, the magnetometer 132 continuously measures the magnetic flux components in the three axes as the dart 100 travels. When the dart 100 moves freely in the passageway without any interference, the magnetometer 132 detects a baseline magnetic flux 402*a*,404*a*,406*a* in each of the x-axis, y-axis, and z-axis, respectively. In the illustrated embodiment, the baseline 402*a* of the x-axis component is about −10500.0 μT; the baseline 404*a* of the y-axis component is about 300.0 μT; and the baseline 406*a* of the z-axis component is about −21300.0 μT. In some embodiments, each of the x-axis, y-axis, and z-axis components 402,404,406 of the magnetic flux detected by the magnetometer 132 can provide the controller 123 with a different type of information.

In one example, a change in magnitude of the z-axis component 406 of the magnetic flux from the baseline 406*a* may indicate the dart's passage through a constriction 50. In some embodiments, the z-axis component 406 is associated with the distance by which the magnets 130 are moved, which helps the controller 123 determine, based on the magnitude of the detected magnetic flux relative to the baseline 406*a*, whether the change in magnetic flux in the z-axis is caused by a constriction 50 or merely an irregularity (e.g. a random impact or bump) in the tubing string.

In another example, the y-axis component 404 of the detected magnetic flux may help the controller 123 distinguish the passage of the dart 100 through a constriction 50 from mere noise downhole. In some embodiments, the y-axis component 404 helps the controller 123 identify and disregard signals that are caused by asymmetrical magnetic field fluctuations. Asymmetrical magnetic field fluctuations occur when the protrusions are not depressed almost simultaneously, which likely happens when the dart 100 encounters an irregularity in the passageway. When the magnetic field fluctuation is asymmetrical, the detected magnetic flux in the y-axis 404 deviates from the baseline 404*a*. In contrast, when the dart 100 passes through a constriction, wherein all the protrusions are depressed almost simultaneously such that the radially inward movements of magnets 130 are substantially synchronized, the resulting magnetic field fluctuation of the magnets 130 is substantially symmetrical. When the resulting magnetic field fluctuation is substantially symmetrical, the y-axis component of the measured magnetic flux 404 is the same as or close to the baseline 404*a*, because the distortion of the magnetic fields of magnets 130 substantially cancels out one another in the y-axis.

Together, the z-axis and y-axis components 406,404 provide the information necessary for the controller 123 to determine whether the dart 100 has passed a constriction 50 rather than just an irregularity in the passageway. Based on the change in magnetic flux detected in the z-axis and the y-axis relative to baseline values 406*a*,404*a*, the controller 123 can determine whether the magnets 130 have moved a sufficient distance, taking into account any noise downhole (e.g. asymmetrical magnetic field fluctuations), to qualify the change as being caused by a constriction rather than an irregularity.

In some embodiments, the x-axis component 402 of the detected magnetic flux is not attributed to the movement of the magnets 130 but rather to any residual magnetization of the materials in the tubing string. Residual magnetization has a similar effect on the y-axis component 404 of the magnetic flux and may shift the y-axis component out of its detection threshold window. By monitoring the x-axis component 402, the controller 123 can use the x-axis component signal to dynamically adjust the baseline 404*a* of the y-axis component to compensate for the effects of residual magnetization and/or to correct any magnetic flux reading errors related to residual magnetization.

In some embodiments, controller 123 monitors the magnetic flux signals to identify the dart's passage through a constriction 50. With specific reference to FIG. 4, a change in magnetic flux in the z-axis component 406 relative to the baseline 406*a* can be detected by the magnetometer when at least one of the magnets 130 moves in the y-axis direction as shown in FIG. 3, i.e., when at least one of the protrusions is depressed, and such a change in z-axis magnetic flux is shown for example by pulses 410, 412, 414, and 416. When a change in the z-axis component is detected, the controller 123 checks whether the y-axis component 404 of the magnetic flux is at or near the baseline 404*a* when the change in the z-axis is at its maximum value (i.e., the peak or trough of a pulse in the z-axis signal, for example, the amplitude of pulses 410, 412, 414, and 416 in FIG. 4) to determine if both protrusions are depressed substantially simultaneously, as described above. In some embodiments, the controller 123 may only check the y-axis magnetic flux signal 404 if the maximum of a z-axis pulse is greater than a predetermined threshold magnitude. The controller 123 may disregard any change in the z-axis magnetic flux signal below the predetermined threshold magnitude as noise.

Points 420 and 422 in FIG. 4 are examples of baseline readings of the y-axis component 404 of the detected magnetic flux that occur at substantially the same time as the maximum of a z-axis pulse (i.e., points 410 and 412, respectively). A "baseline reading" in the y-axis component refers to a signal that is at the baseline 404*a* or close to the baseline 404*a* (i.e., within a predetermined window around the baseline 404*a*). It is noted that the positive or negative change in the y-axis magnetic flux 404 detected immediately prior to or after the baseline readings 420,422 may be caused by one or more protrusions being depressed just before the other protrusion(s) as the dart 100 may not be completely centralized in the passageway as it is passing through the constriction.

In some embodiments, when the maximum of a pulse in the z-axis signal coincides with a baseline reading in the y-axis signal (e.g. the combination of point 420 in the y-axis signal 404 and the trough of pulse 410 in the z-axis signal 406; and the combination of point 422 in the y-axis signal 404 and the trough of pulse 412 in the z-axis signal 406), the controller 123 can conclude that the dart 100 has passed through a constriction 50. In some embodiments, where a baseline reading in the y-axis substantially coincides with a change in magnetic flux detected in the z-axis, the controller 123 may be configured to qualify the baseline reading only if the baseline reading lasts for at least a predetermined threshold timespan (for example, 10 μs) and disqualifies the baseline reading as noise if the baseline reading is shorter than the predetermined period of time. This may help the controller 123 distinguish between noise and an actual reading caused by the dart's passage through a constriction.

When the dart 100 passes through an irregularity in the passageway instead of a constriction 50, often only one protrusion is depressed, which results in a magnetic field fluctuation that is asymmetrical. Such an event is indicated by a change in z-axis magnetic flux signal 406, as shown for example by each of pulses 414 and 416, which coincides with a positive or negative change the y-axis magnetic flux 404 relative to the baseline 404*a*, as shown for example by each of pulses 424 and 426, respectively. Therefore, when the controller 123 detects a change in the z-axis magnetic flux relative to baseline 406*a* but also sees a substantially simultaneous deviation of the y-axis magnetic flux from baseline 404*a* beyond the predetermined window, the controller 123 can ignore such changes in the y-axis and z-axis signals and disregard the event as noise.

Figure 13:
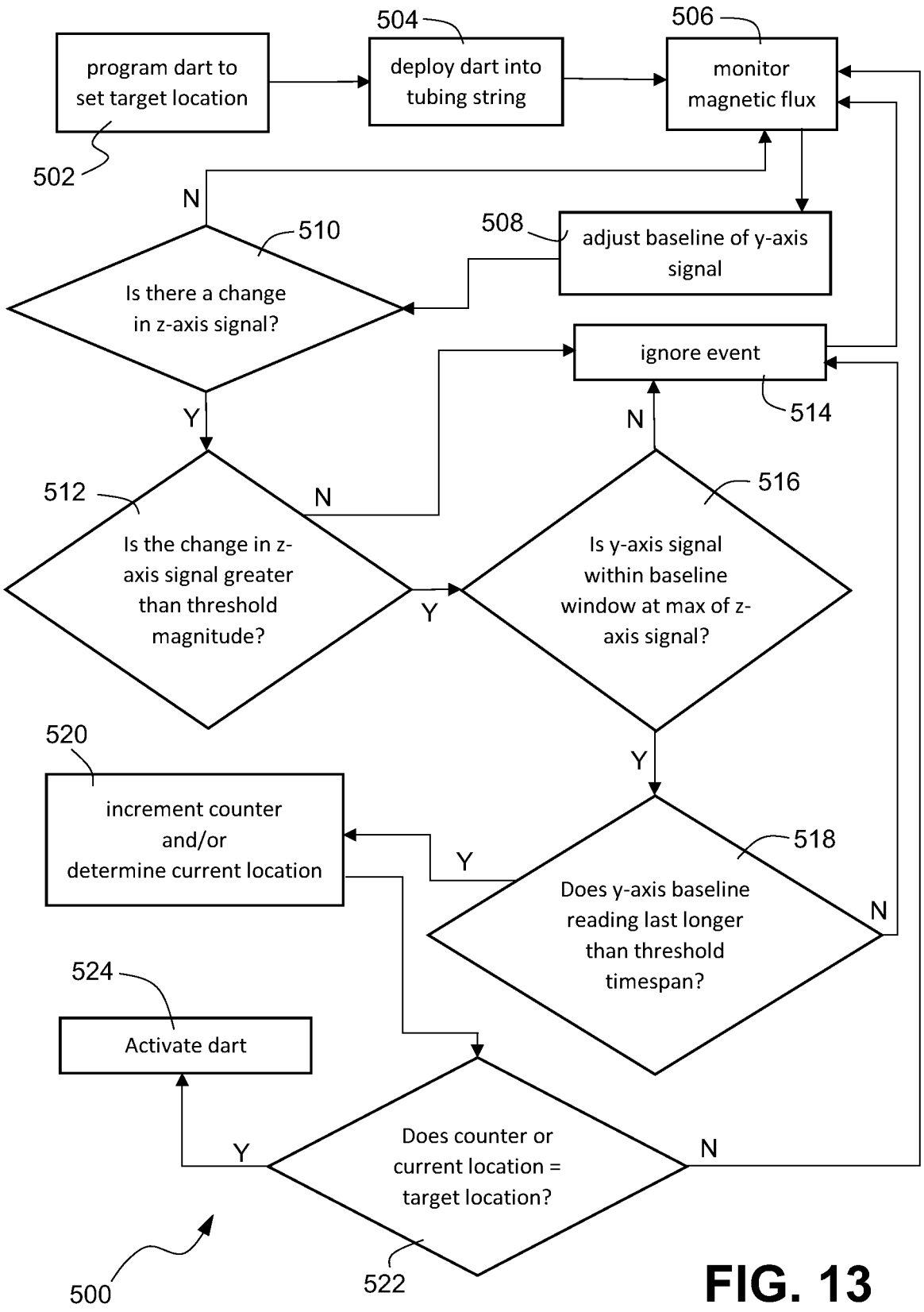
FIG. 13 is a flowchart of a method of determining a location of a dart in a wellbore, according to one embodiment.

FIG. 13 is a flowchart illustrating a sample process 500 for determining the real-time location of the dart 100 via physical contact, according to one embodiment. At step 502, the controller 123 of dart 100 is programmed with the desired target location, which may be a number or a distance. At step 504, the dart 100 is deployed into the tubing string. At step 506, as the dart 100 travels down the tubing string, the magnetometer 132 continuously measures the magnetic flux in the x-axis, the y-axis, and the z-axis and sends signals of same to the controller 123 so that the controller 123 can monitor the magnetic flux in all three axes.

In some embodiments, at step 508, the controller 123 uses the x-axis signal of the detected magnetic flux to adjust the baseline of the y-axis signal, as described above. At step 510, the controller 123 continuously checks for a change in the z-axis magnetic flux signal. If there is no change in the z-axis signal, the controller continues to the monitor the magnetic flux signals (step 506). If there is a change in the z-axis signal, the controller 123 compares the change with the predetermined threshold magnitude (step 512). If the change in the z-axis signal is below the threshold magnitude, the controller 123 ignores the event (step 514) and continues to monitor the magnetic flux signals (step 506).

If the change in the z-axis signal is at or above the threshold magnitude, the controller 123 checks whether y-axis signal is a baseline reading (i.e., the y-axis signal is within a predetermined baseline window) when the change in z-axis signal pulse is at its maximum (step 516). If the y-axis signal is not within the baseline window, the controller 123 ignores the event (step 514) and continues to monitor the magnetic flux signals (step 506). If the y-axis signal is within the baseline window, the controller 123 checks if the y-axis baseline reading lasts for at least the threshold timespan (step 518). If the y-axis baseline reading lasts less than the threshold timespan, the controller 123 ignores the event (step 514) and continues to monitor the magnetic flux signals (step 506). If the y-axis baseline reading lasts for at least the threshold timespan, the controller 123 registers the event as the passage of a constriction 50 and increments (e.g., adds one to) the counter (step 520). At step 520, the controller 123 may also determine the current downhole location of the dart based on the number of the counter and the known locations of the constrictions 50 on the well map.

The controller 123 then proceeds to step 522, where the controller 123 checks whether the updated counter number or the determined current location of the dart has reached the preprogrammed target location. If the controller determines that the dart has reached the target location, the controller 123 sends a signal to the actuation mechanism 124 to activate the dart 100 (step 524). If the controller determines that the dart has not yet reached the target location, the controller 123 continues to monitor the magnetic flux signals (step 506).

Ambient Sensing

In some embodiments, no physical contact is required for a dart to monitor its location in the passageway 30. As the dart travels through the tubing string, the magnetic field in the around the dart changes due to, for example, residual magnetization in the tubing string, variations in thickness of the tubing string, different types of formations traversed the tubing string (e.g., ferrite soil), etc. In some embodiments, by monitoring the change in magnetic field in the dart's surroundings, the downhole location of the dart can be determined in real-time.

Figure 1C:
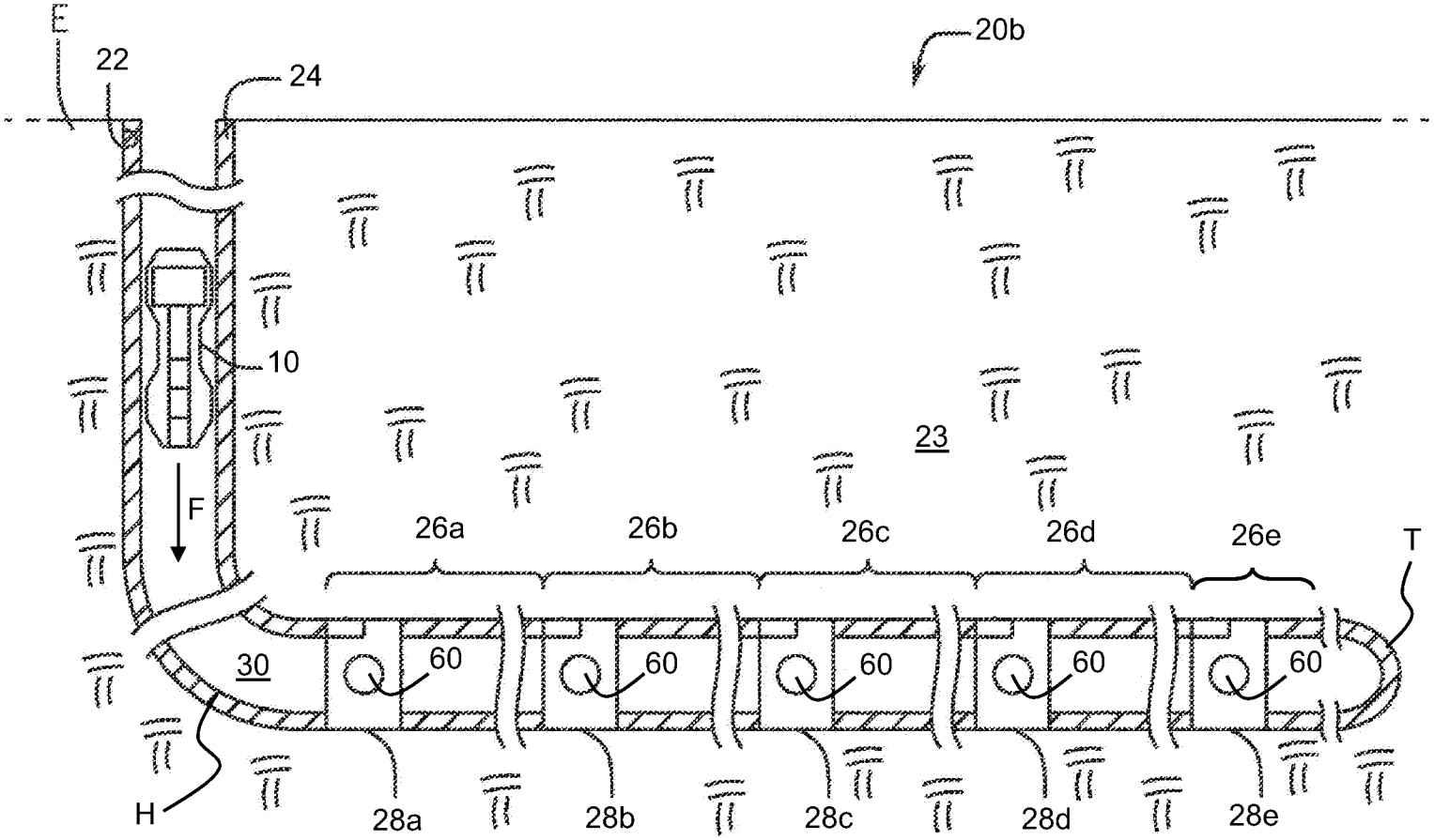
FIG. 1C is a schematic drawing of a multiple stage well according to yet another embodiment of the present disclosure, wherein the well comprises one or more magnetic features.

FIG. 1C illustrates a multistage well 20*b* similar to the multistage well 20 of FIG. 1A, except at least one feature in each stage 26*a*,26*b*,26*c*,26*d*,26*e* of the well 20*b* is a magnetic feature 60. A magnetic feature 60 comprises ferromagnetic material or is otherwise configured to have different magnetic properties than those of the surrounding segments of the tubing string 24. A "different" magnetic property may refer to a weaker magnetic field (or other magnetic property) or a stronger magnetic field (or other magnetic property). In one example, a magnetic feature 60 may comprise a magnet to render the magnetic property of that magnetic feature 60 different than those of the surrounding tubing segments. In another example, magnetic features 60 may include "thicker" features in the tubing string 24 such as joints, since joints are usually thicker than the surrounding segments and thus contain more metallic material than the surrounding segments. Tubing string joints are spaced apart by a known distance, as they are intermittently positioned along the tubing string 24 to connect adjacent tubing segments. In yet another example, a magnetic feature 60 may include any of tools 28*a*,28*b*,28*c*,28*d*,28*e* because a tool may contain more metallic material (i.e., tools may have thicker metallic materials than their surrounding segments) or be formed of a material having different magnetic properties than the surrounding segments of the tubing string.

In some embodiments, with reference to FIGS. 1C and 2A, the magnetometer 132 of dart 10 is configured to continuously sense the magnetometer's ambient magnetic field and/or magnetic flux as the dart 10 travels down the tubing string 24 and accordingly send one or more signals to the controller 123. While the dart 10 travels down the tubing string, the magnetic field and/or magnetic flux measured by the magnetometer 132 varies in strength due to the influence of the magnetic features 60 in the tubing string as the dart 10 approaches, coincides with, and passes each magnetic feature 60. In some embodiments, a magnet may be disposed in one or more of magnetic features 60 to help further differentiate the magnetic properties of the magnetic features 60 from those of the surrounding tubing string segments, which may enhance the magnetic field and/or flux detectable by the magnetometer 132.

Based on the signals generated by the magnetometer 132, the controller 123 detects and logs when the dart 10 nears a magnetic feature 60 in the tubing string so that the controller 123 may determine the dart's downhole location at any given time. For example, a change in the signal of the magnetometer may indicate the presence of a magnetic feature 60 near the dart 10. In some embodiments, the magnetometer 132 measures directional magnetic field and is configured to measure magnetic field in the x-axis direction and the y-axis direction as the dart 10 travels in direction F. In the illustrated embodiment shown in FIG. 2A, the magnetometer 132 is positioned at the central longitudinal axis of the dart 10, which may help minimize directional asymmetry in the measurement sensitivity of the magnetometer. The x-axis and the y-axis of the magnetometer 132 are substantially orthogonal to direction F and to one another.

In some embodiments, the magnetic field M of the environment around the magnetometer (the "ambient magnetic field") can be determined by:

$$M = \sqrt{(x+c)^2 + (y+d)^2} \qquad \text{(Equation 1)}$$

where x is the x-axis component of the magnetic field detected by the magnetometer 132, c is an adjustment constant for the x-axis component, y is the y-axis component of the magnetic field detected by the magnetometer 132, and d is an adjustment constant for the y-axis component. The purpose of constants c and d is to compensate for the effects of any component and/or materials in the dart on the magnetometer's ability to sense evenly in the x-y plane around the perimeter of the magnetometer. The values of constants c and d depend on the components and/or configuration of the dart 10 and can be determined through experimentation. When the appropriate constants c and d are used in Equation 1, the calculated ambient magnetic field M is independent of any rotation of the dart 10 about its central longitudinal axis relative to the tubing string 24 because any imbalance in measurement sensitivity between the x-axis and the y-axis of the magnetometer is taken into account. Considering only the x-axis and y-axis components of the magnetic field detected by the magnetometer when calculating the ambient magnetic field M may help reduce noise (e.g., minimize any influence of the z-axis component) in the calculated ambient magnetic field M.

The controller 123 interprets the magnetic field and/or magnetic flux signal provided by the magnetometer 132 in the x-axis and the y-axis to detect a magnetic feature 60 in the dart's environment as the dart 10 travels. In some embodiments, each magnetic feature 60 is configured to provide a magnetic field strength detectable by the magnetometer between a predetermined minimum value ("min M threshold") and a predetermined maximum value ("max M threshold"). Also, the magnetic strength and/or length of the magnetic feature 60 may be chosen such that, when dart 10 is travelling at a given speed in the tubing string, the magnetometer 132 can detect the magnetic field of the magnetic feature 60, at a value between the min M threshold and max M threshold, for a time period between a predetermined minimum value ("min timespan") and a predetermined maximum value ("max timespan"). For example, for a magnetic feature, the min M threshold is 100 mT, the max M threshold is 200 mT, the min timespan is 0.1 second, the max timespan is 2 seconds. Collectively, the min M threshold, max M threshold, min timespan, and max timespan of each magnetic feature 60 constitute the parameters profile for that specific magnetic feature.

When the dart 10 is not close to a magnetic feature 60, the magnitude of the magnetic field M determined by the controller 123 based on the x-axis and y-axis signals from the magnetometer 132 can fluctuate but is below the min M threshold. When the dart 10 approaches an object with a different magnetic property (e.g., a magnetic feature 60) in the tubing string, the magnitude of the detected magnetic field M changes and may rise above the min M threshold. In some embodiments, when the detected magnetic field M falls between the min M threshold and the max M threshold for a time period between the min timespan and max timespan, the controller 123 identifies the event as being within the parameters profile of a magnetic feature 60 and logs the event as the dart's passage through the magnetic feature 60. The controller 123 may use a timer to track the time elapsed while the magnetic field M stayed between the min and max M thresholds.

In some embodiments, all the magnetic features 60 in the tubing string 24 have the same parameters profile. In other embodiments, one or more magnetic features 60 have a distinct parameters profile such that when dart 10 passes through the one or more magnetic features 60, the change in magnetic field and/or magnetic flux detected by the magnetometer 132 is distinguishable from the change detected when the dart passe through other magnetic features in the tubing string. In some embodiments, at least one magnetic feature in the tubing string has a first parameters profile and at least one magnetic feature of the remaining magnetic features in the tubing string has a second parameters profile, wherein the first parameters profile is different from the second parameters profile.

By logging the presence of magnetic features 60 in the tubing string, the controller 123 can determine the downhole location of the dart in real-time, either by cross-referencing the detected magnetic features 60 with the known locations thereof on the well map or by counting the number of magnetic features (or the number of magnetic features with specific parameters profiles) dart 10 has encountered. In some embodiments, the counter of the controller 123 maintains a count of the detected magnetic features 60. The controller 123 compares the current location of dart 10 with the target location, and upon determining that the dart has reached the target location, the controller 123 signals the actuation mechanism 124 to transform the dart into the activated position.

Figure 14:
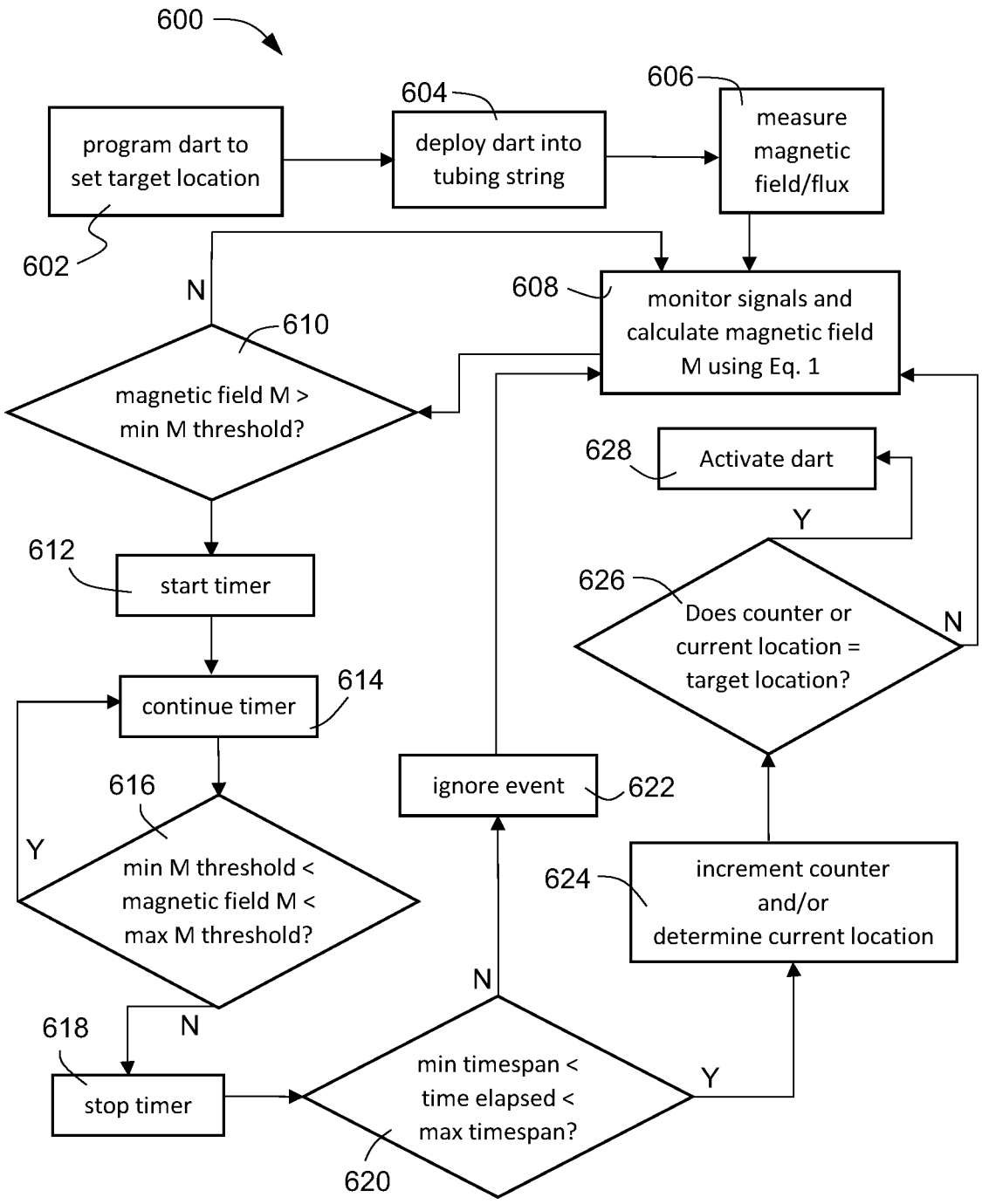
FIG. 14 is a flowchart of a method of determining a location of a dart in a wellbore, according to another embodiment.

FIG. 14 is a flowchart illustrating a sample process 600 for determining the downhole location of the dart 10 in multistage well 20*b*. At step 602, the dart 10 is programed with a desired target location. The dart 10 is then deployed in the tubing string (step 604). The magnetometer 132 of dart 10 continuously measures the magnetic field and/or flux in the x-axis, y-axis, and z-axis (step 606) and sends an x-axis signal, a y-axis signal, and (optionally) a z-axis signal to the controller 123. Based on at least the x-axis signal, the y-axis signal, and constants c and d, the controller 123 determines the ambient magnetic field M using Equation 1 above (step 608). If the dart 10 is not close to a magnetic feature, the magnitude of ambient magnetic field M may fluctuate but is generally below the min M threshold. As ambient magnetic field M is continuously updated based on the signals received from the magnetometer 132, the controller 123 monitors the real-time value of the ambient magnetic field M to see whether the ambient magnetic field M rises above the min M threshold (step 610).

If ambient magnetic field M remains below min M threshold, the controller 123 does nothing and continues to interpret the x-axis and y-axis signals from the magnetometer 132 (step 608). If ambient magnetic field M rises above the min M threshold, the controller 123 starts the timer (step 612). The controller 123 continues to run the timer (step 614) while monitoring the magnetic field M to check whether the real-time ambient magnetic field M is between the min M threshold and the max M threshold (step 616). If the ambient magnetic field M stays between the min M threshold and the max M threshold, the controller 123 continues to run the timer (step 614). If the ambient magnetic field M falls outside the min and max M thresholds, the controller 123 stops the timer (step 618). The controller 123 then checks whether the time elapsed between the start time of the timer at step 612 and the end time of the timer at step 618 is between the min timespan and the max timespan (step 620). If the time elapsed is not between the min and max timespans, the controller 123 ignores the event (step 622) and continues to monitor the magnetic field M (step 608). If the time elapsed is between the min and max timespans, the controller 123 registers the event as the dart's passage of a magnetic feature and increments the counter (step 624). At step 624, the controller 123 may also determine the current downhole location of the dart 10 based on the number of the counter and the known locations of the magnetic features on the well map.

The controller 123 then proceeds to step 626, where the controller 123 checks whether the updated counter number or the determined current location of the dart 10 has reached the preprogrammed target location. If the controller determines that the dart has reached the target location, the controller 123 sends a signal to the actuation mechanism 124 to activate the dart 10 (step 628). If the controller determines that the dart 10 has not yet reached the target location, the controller 123 continues to monitor the ambient magnetic field M (step 608).

Proximity Sensing

Figure 2C:
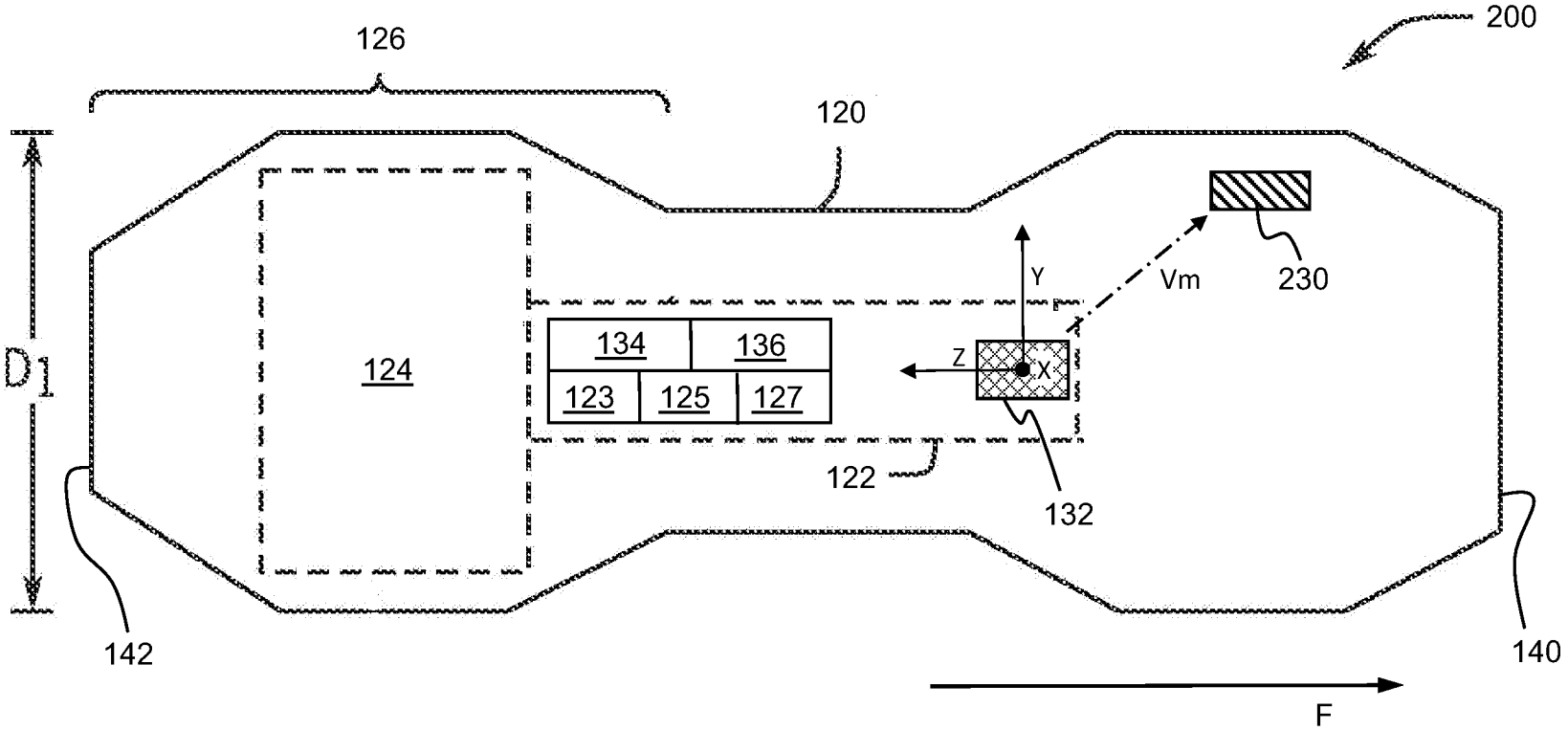
FIG. 2C is a schematic axial cross-sectional view of a dart according to yet another embodiment of the present disclosure, wherein the dart has a magnet embedded therein.

FIG. 2C shows a sample embodiment of a dart 200 configured to determine its downhole location in relation to a target location without physical contact with the tubing string. Dart 200 has a body 120, a control module 122, an actuation mechanism 124, and an engagement section 126, which are the same as or similar to the like-numbered components described above with respect to dart 10 in FIG. 2A. In some embodiment, the dart 200 comprises a magnet 230, and the magnet 230 may have the same or similar characteristics as those described above with respect to magnet 130 in FIG. 2B. In the illustrated embodiment, magnet 230 is embedded in the body 120 of the dart 200 and is rigidly installed in the dart such that the magnet 230 is stationary relative to the body 120 regardless of the motion of the dart.

Figure 1D:
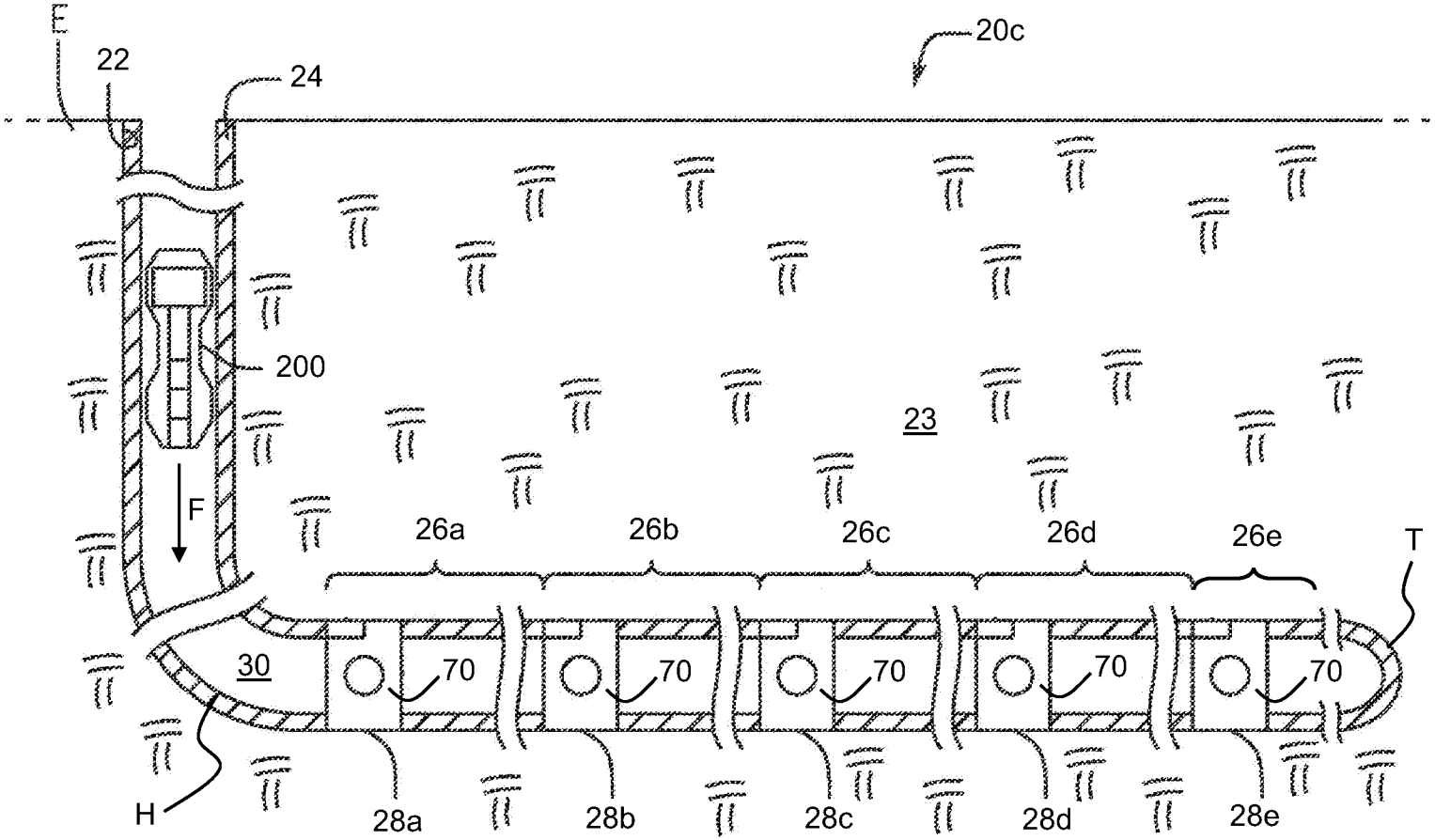
FIG. 1D is a schematic drawing of a multiple stage well according to yet another embodiment of the present disclosure, wherein the well comprises one or more thicker features.

FIG. 1D illustrates a multistage well 20*c* similar to the multistage well 20 of FIG. 1A, except at least one feature in each stage 26*a*,26*b*,26*c*,26*d*,26*e* of the well 20*c* is a thicker feature 70. The thicker features 70 are sections of increased thicknesses (or increased amounts of metallic material) in the tubing string 24, such as tubing string joints and/or any of tools 28*a*,28*b*,28*c*,28*d*,28*e*. The downhole location of features 70 is known via, for example, the well map prior to the deployment of the dart 200. In other embodiments, features 70 are magnetic features that are the same as or similar to magnetic features 60 described above with respect to FIG. 1C.

With reference to FIGS. 1D and 2C, the magnetometer 132 of dart 200 is configured to continuously measure the magnetic field and/or magnetic flux of the magnet 230 as the dart 200 travels down the tubing string 24 and accordingly send one or more signals to the controller 123. While the dart 200 travels down the tubing string, the strength of the magnetic field and/or magnetic flux of the magnet 230 can be affected by the dart's environment (e.g., proximity to different materials and/or thicknesses of materials in the tubing string). In some embodiments, magnetometer 132 of dart 200 is configured to detect variations in strength (e.g., distortions) of the magnet's magnetic field and/or flux due to the influence of the features 70 in the tubing string as the dart 200 approaches, coincides with, and passes each feature 70. In other embodiments, in addition to or in lieu of an increased thickness, one or more features 70 may have magnetic properties, which may enhance the magnetic field and/or flux detectable by the magnetometer 132 when the dart 200 is near such features. By monitoring the change in magnetic field and/or flux of the magnet 230 as the dart 200 travels along passageway 30, the downhole location of the dart 200 may be determined in real-time.

In some embodiments, based on the signals generated by the magnetometer 132, the controller 123 detects and logs when the dart 200 is close to a feature 70 in the tubing string so that the controller 123 may determine the dart's downhole location at any given time. For example, a change in the signal of the magnetometer may indicate the presence of a feature 70 near the dart 200. In some embodiments, the magnetometer 132 is configured to measure the x-axis, y-axis, and z-axis components of the magnetic field and/or flux of the magnetic 230 as seen by the magnetometer 132, as the dart 200 travels in direction F. In the illustrated embodiment shown in FIG. 2C, the magnetometer 132 is positioned at the central longitudinal axis of the dart 200, with its z-axis parallel to direction F, and its x-axis and y-axis substantially orthogonal to the z-axis and to one another.

In this embodiment, the magnetic field M of the magnet 230 sensed by the magnetometer 132 can be determined by:

$$M = \sqrt{(x+p)^2 + (y+q)^2 + (z+r)^2} \qquad \text{(Equation 2)}$$

where x is the x-axis component of the magnetic field detected by the magnetometer 132; p is an adjustment constant for the x-axis component; y is the y-axis component of the magnetic field detected by the magnetometer 132; q is an adjustment constant for the y-axis component; z is the z-axis component of the magnetic field detected by the magnetometer 132; and r is an adjustment constant for the z-axis component. Magnetic field M, as calculated using Equation 2, provides a measurement of a vector-specific magnetic field and/or flux as seen by magnetometer 132 in the direction of the magnet 230. In the illustrated embodiment, the vector from the magnetometer 132 to the magnet 230 is denoted by arrow Vm. In some embodiments, constants p, q, and r are determined based, at least in part, on one or more of: the magnetic strength of magnet 230, the dimensions of the dart 200; the configuration of the components inside the dart 200; and the permeability of the dart material. In some embodiments, constants p, q, and r are determined through calculation and/or experimentation.

By monitoring the magnetic field strength at the magnetometer 132 (i.e., in direction Vm), distortions of the magnet's magnetic field can be detected. In some embodiments, the controller 123 interprets the magnetic field and/or magnetic flux signal provided by the magnetometer 132 in the x, y, and z axes to detect a feature 70 in the dart's environment (i.e., near the magnet 230) as the dart 200 travels. In some embodiments, based on the signals from the magnetometer, the controller determines the value of magnetic field M using Equation 2 in real-time and checks for changes in the value of magnetic field M. In some embodiments, the magnetic field of the magnet 230 as detected by the magnetometer is stronger when the dart 200 coincides with a feature 70, because there is less absorption and/or deflection of the magnet's magnetic field while the dart 200 is in the feature than in the surrounding thinner segments of the tubing string 24. When the dart 200 exits the feature 70 and enters a thinner section of the tubing string, the magnetic field of the magnet 230 becomes weaker. In this embodiment, the controller 123 may check for an increase in magnetic field M to identify the dart's entrance into a feature 70 and a corresponding decrease in magnetic field M to confirm the dart's exit from the feature into a thinner section of the tubing string. In other embodiments, the controller 123 may detect a further increase in magnetic field M from the initial increase, which may indicate the dart's exit from the feature 70 into a thicker section of the tubing string.

Depending on its material and configuration, each feature 70 may cause an increase in the magnetic strength of the magnet 230, wherein the magnitude of the increased magnetic field is between a minimum value ("min M threshold") and a maximum value ("max M threshold"). Also, the length of the feature 70 may be selected such that, when dart 200 is travelling at a given speed in the tubing string, the increase in magnetic field strength caused by feature 70 is detectable for a time period between a minimum value ("min timespan") and a maximum value ("max timespan"). For example, for a feature 70, the min M threshold is 100 mT, the max M threshold is 200 mT, the min timespan is 0.1 second, the max timespan is 2 seconds. Collectively, the min M threshold, max M threshold, min timespan, and max timespan of each feature 70 constitute the parameters profile for that specific feature.

When the dart 200 is not close to a feature 70, the magnitude of the magnetic field M determined by the controller 123 based on the x-axis, y-axis, and z-axis signals from the magnetometer 132 can fluctuate but is below the min M threshold. When the dart 200 approaches a feature 70 in the tubing string, the magnitude of the detected magnetic field M rises above the min M threshold. In some embodiments, when the detected magnetic field M falls between the min M threshold and the max M threshold for a time period between the min timespan and max timespan, the controller 123 identifies the event as being within the parameters profile of the feature 70 and logs the event as the dart's passage through the feature 70. The controller 123 may use a timer to track the time elapsed while the magnetic field M stayed between the min and max M thresholds.

In some embodiments, all the features 70 in the tubing string 24 have the same parameters profile. In other embodiments, one or more features 70 have a distinct parameters profile such that when dart 200 passes through the one or more features 70, the change in magnetic field and/or magnetic flux detected by the magnetometer 132 is distinguishable from the change detected when the dart passe through other features in the tubing string. In some embodiments, at least one feature 70 in the tubing string has a first parameters profile and at least one feature 70 of the remaining features in the tubing string has a second parameters profile, wherein the first parameters profile is different from the second parameters profile.

By logging the dart's passage through one or more features 70 in the tubing string, the controller 123 can determine the downhole location of the dart 200 in real-time, either by cross-referencing the detected features 70 with the known locations thereof on the well map or by counting the number of features 70 (or the number of features 70 with specific parameters profiles) dart 200 has encountered. In some embodiments, the counter of the controller 123 maintains a count of the detected features 70. The controller 123 compares the current location of dart 200 with the target location, and upon determining that the dart has reached the target location, the controller 123 signals the actuation mechanism 124 to transform the dart into the activated position.

Figure 15:
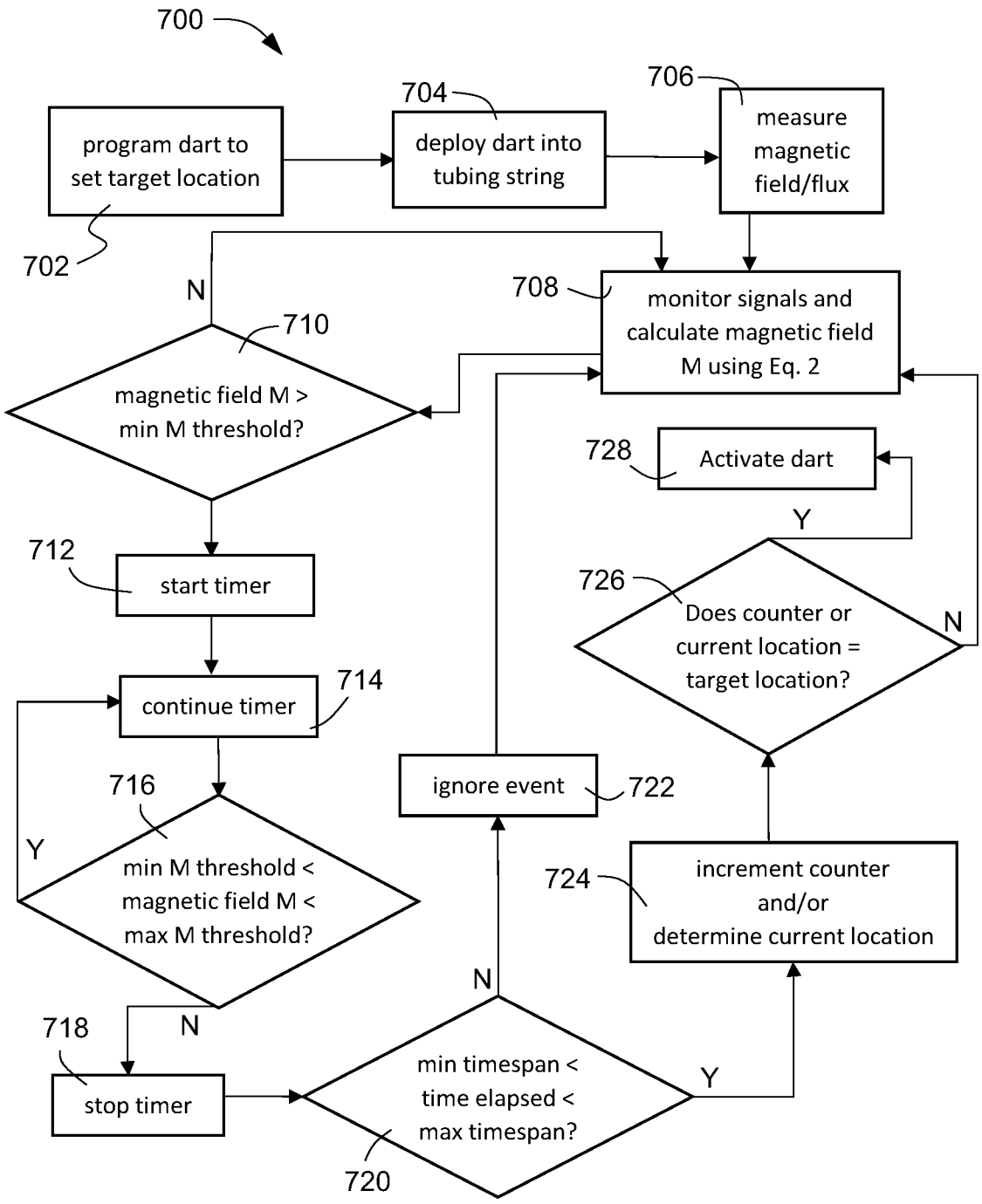
FIG. 15 is a flowchart of a method of determining a location of a dart in a wellbore, according to yet another embodiment.

FIG. 15 is a flowchart illustrating a sample process 700 for determining the downhole location of the dart 200 in multistage well 20*c*. At step 702, the dart 200 is programed with a desired target location. The dart 200 is then deployed in the tubing string (step 704). The magnetometer 132 of dart 200 continuously measures the magnetic field and/or flux in the x-axis, y-axis, and z-axis (step 706) and sends an x-axis signal, a y-axis signal, and a z-axis signal to the controller 123. Based on the x-axis signal, the y-axis signal, and the z-axis signal, and constants p, q, and r, the controller 123 determines magnetic field M using Equation 2 above (step 708). If the dart 200 is not close to a feature 70, the magnitude of magnetic field M may fluctuate but is generally below the min M threshold. As magnetic field M is continuously updated based on the signals received from the magnetometer 132, the controller 123 monitors the real-time value of magnetic field M to see whether the magnetic field M rises above the min M threshold (step 710).

If magnetic field M remains below min M threshold, the controller 123 does nothing and continues to interpret the x-axis, y-axis, and z-axis signals from the magnetometer 132 (step 708). If magnetic field M rises above the min M threshold, the controller 123 starts the timer (step 712). The controller 123 continues to run the timer (step 714) while monitoring the magnetic field M to check whether the real-time magnetic field M is between the min M threshold and the max M threshold (step 716). If the magnetic field M stays between the min M threshold and the max M threshold, the controller 123 continues to run the timer (step 714). If the magnetic field M falls outside the min and max M thresholds, the controller 123 stops the timer (step 718). The controller 123 then checks whether the time elapsed between the start time of the timer at step 712 and the end time of the timer at step 718 is between the min timespan and the max timespan (step 720). If the time elapsed is not between the min and max timespans, the controller 123 ignores the event (step 722) and continues to monitor the magnetic field M (step 708). If the time elapsed is between the min and max timespans, the controller 123 registers the event as the dart's passage of a feature 70 and increments the counter (step 724). At step 724, the controller 123 may also determine the current downhole location of the dart 200 based on the number of the counter and the known locations of the features 70 on the well map.

The controller 123 then proceeds to step 726, where the controller 123 checks whether the updated counter number or the determined current location of the dart 200 has reached the preprogrammed target location. If the controller determines that the dart has reached the target location, the controller 123 sends a signal to the actuation mechanism 124 to activate the dart 200 (step 728). If the controller determines that the dart 200 has not yet reached the target location, the controller 123 continues to monitor the magnetic field M (step 708).

Distance Calculation Based on Acceleration

In some embodiments, the real-time downhole location of the dart can be determined by analyzing the acceleration data of the dart. With reference to FIG. 2, according to one embodiment, dart 10,100,200 may comprise an accelerometer 134, which may be a three-axis accelerometer. Accelerometer 134 measures the dart's acceleration as the dart travels through passageway 30. Using the collected acceleration data, the distance travelled by the dart 10,100,200 can be calculated by double integration of the dart's acceleration at any given time. For example, in general, distance s at any given time t can be calculated by the following equation:

$$s(t) = s_0 + \int^t v(t)dt = s_0 + v_0 t + \int^t \int^\tau a(\tau)d\tau dt \qquad \text{(Equation 3)}$$

where v is the velocity of the dart, a is the acceleration of the dart, and τ is time.

Equation 3 can be used when the dart is traveling in a straight line and the acceleration a of the dart is measured along the straight travel path. However, the dart typically does not travel in a straight line through passageway 30 so the measured acceleration is affected by the Earth's gravity (1 g). If the effects of gravity are not taken into consideration, the distance s calculated by Equation 3 based on the detected acceleration may not be accurate. In some embodiments, the dart 10,100,200 comprises a gyroscope 136 to help compensate for the effects of gravity by measuring the rotation of the dart. Prior to deployment of dart 10,100,200, when the dart is stationary, the reading of the gyroscope 136 is taken and an initial gravity vector (e.g., 1 g) is determined from the gyroscope reading. After deployment, the rotation of the dart 10,100,200 is continuously measured by the gyroscope 136 as the dart travels downhole and the rotation measurement is adjusted using the initial gravity vector. Then, to take gravity into account, the real-time acceleration measured by the accelerometer 134 is corrected with the adjusted rotation measurement to provide a corrected acceleration. Instead of the detected acceleration, the corrected acceleration is used to calculate the distance traveled by the dart.

For example, to simplify calculations, the initial gravity vector is set as a constant that is used to adjust the rotation measurements taken by the gyroscope 136 while the dart is in motion. Further, while the dart 10,100,200 is moving in direction F, the z-axis component of acceleration (with the z-axis being parallel to direction F) as measured by the accelerometer 134 is compensated by the adjusted rotation measurements to generate the corrected acceleration $a_C$. Using the corrected acceleration $a_C$, the velocity v of the dart at a given time t can be calculated by:

$$v(t) = v_0 + \int^{t} a_c(t)dt \quad \text{(Equation 4)}$$

where $a_C(t)$ is the corrected acceleration at time t and $v_o$ is the initial velocity of the dart. In some embodiments, $v_o$ is zero. Based on the velocity v calculated using Equation 4, the distance s traveled by the dart at time t can then be calculated by:

$$s(t) = s_0 + \int^{\tau} v(\tau)d\tau \quad \text{(Equation 5)}$$

Further, the error in the distance s calculated from the corrected acceleration $a_c$ using Equations 4 and 5 may grow as the magnitude of the acceleration increases. Therefore, in some embodiments, changes in magnetic field and/or flux as detected by magnetometer 132, as described above, can be used for corroboration purposes for correcting any errors in the distance s calculated using data from the accelerometer 134 and the gyroscope 136 to arrive at a more accurate determination of the dart's real-time downhole location.

In some embodiments, the dart's real-time downhole location as determined by the controller 123 based, at least in part, on the acceleration and rotation data is compared to the target location. When the controller 123 determines that the dart 10,100,200 has arrived at the target location, the controller 123 sends a signal to the actuation mechanism 124 to effect activation of the dart to, for example, perform a downhole operation.

Travel Direction Detection

In some embodiments, the real-time downhole travel direction of the dart can be determined by analyzing the acceleration data of the dart. With reference to FIG. 2, according to one embodiment, the accelerometer 134 of dart 10,100,200 may be configured to measure the dart's acceleration as the dart travels through passageway 30. Using the collected acceleration data, the controller 123 can determine whether the dart 10,100,200 is travelling in the downhole direction at any given time.

For example, as the dart 10,100,200 travels downhole at a substantially constant velocity, the acceleration measured by the accelerometer may be around zero. If the dart slows down and/or reverses direction (i.e., flowing in the uphole direction), the accelerometer outputs a negative acceleration. In some embodiments, if negative acceleration is detected for longer than a predetermined timespan, the controller 123 may deactivate the dart 10,100,200 to prevent the dart from transitioning to the activated position. This function may be useful in detecting screen out events to thereby prevent the dart from self-activating and inadvertently engaging the wrong downhole tool.

Dart Actuation Mechanism

Figure 5A:
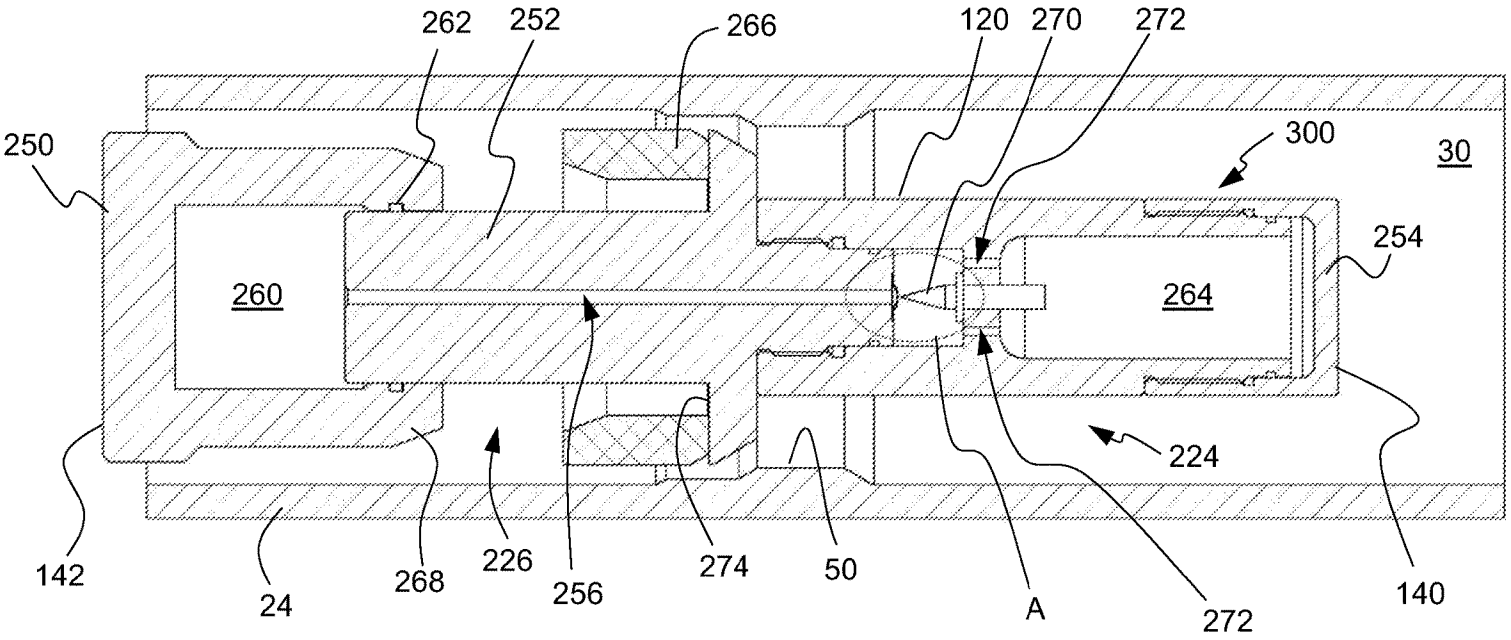
FIG. 5A is a schematic axial cross-sectional view of a dart, shown in an inactivated position, according to one embodiment of the present disclosure.

FIG. 5A shows one embodiment of a dart 300 having an actuation mechanism configured to transform the dart into the activated position, when the dart's controller determines that the dart has reached the target location. The dart 300 is shown in the inactivated position in FIGS. 5A and 5B. For simplicity, some components such as the control module and magnets of the dart 300 are not shown in FIG. 5A. Dart 300 comprises an actuation mechanism 224 having a first housing 250 defining therein a hydrostatic chamber 260, a piston 252, and a second housing 254 defining therein an atmospheric chamber 264. The hydrostatic chamber 260 contains an incompressible fluid, while the atmospheric chamber 264 contains a compressible fluid (e.g., air) that is at about atmospheric pressure. In other embodiments, the atmospheric chamber is a vacuum.

Figure 5B:
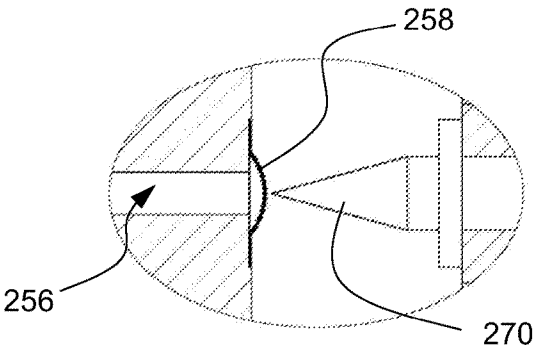
FIG. 5B is a magnified view of area "A" of FIG. 5A, showing an intact burst disk.

One end of the piston 252 extends axially into the hydrostatic chamber 260 and the interface between the outer surface of the piston 252 and the inner surface of the chamber 260 is fluidly sealed, for example via an o-ring 262. The piston 252 is configured to be axially slidably movable, in a telescoping manner, relative to the first housing 250; however, such axial movement of the piston 252 is restricted when the hydrostatic chamber 260 is filled with incompressible fluid. The piston 252 has an inner flow path 256 and, as more clearly shown in FIG. 5B, one end of the flow path 256 is fluidly sealed by a valve 258 when the dart 300 is in the inactivated position. The valve 258 controls the communication of fluid between the chambers 260, 264. The valve 258 in the illustrated embodiment is a burst disk. The burst disk 258, when intact (as shown in FIG. 5B), blocks fluid communication between the chambers 260,264 by blocking fluid flow through the flow path 256. In the sample embodiment shown in FIG. 5A, the actuation mechanism 224 comprises a piercing member 270 operable to rupture the burst disk 258. When the dart 300 is not activated, as shown in FIG. 5B, the piercing member 270 is adjacent to but not in contact with the burst disk 258.

In the illustrated embodiment in FIG. 5A, the dart 300 comprises an engagement mechanism 266 positioned at an engagement section 226 of the dart. The engagement mechanism 266 is actuable from an inactivated position to an activated position. The actuation mechanism 224 is configured to selectively actuate the engagement mechanism 266 to transition the mechanism 266 to the activated position, thereby placing the dart in the activated position. In the illustrated embodiment, engagement mechanism 266 comprises expandable slips 266 supported on the outer surface of the piston 252. The first housing 250 has a frustoconically-shaped end 268 adjacent the slips 266 for matingly engaging same. Frustoconically-shaped end 268 is also referred to herein as cone 268. When the slips 266 in the inactivated (or "initial") position, as shown in FIG. 5A, the slips 266 are retracted and are not engaged with the cone 268. When activated, slips 266 are expanded radially outwardly by engaging the cone 268, as described in more detail below.

Upon receiving an activation signal from the controller of the dart, the actuation mechanism 224 operates to actuate the engagement mechanism 266 by opening valve 258. In some embodiments, the actuation mechanism 224 comprises an exploding foil initiator (EFI) that is activated upon receipt of the activation signal, and a propellant that is initiated by the EFI to drive the piercing member 270 into the burst disk 258 to rupture same. As a skilled person in the art can appreciate, other ways of driving the piercing member 270 to rupture burst disk 258 are possible.

Figure 6A:
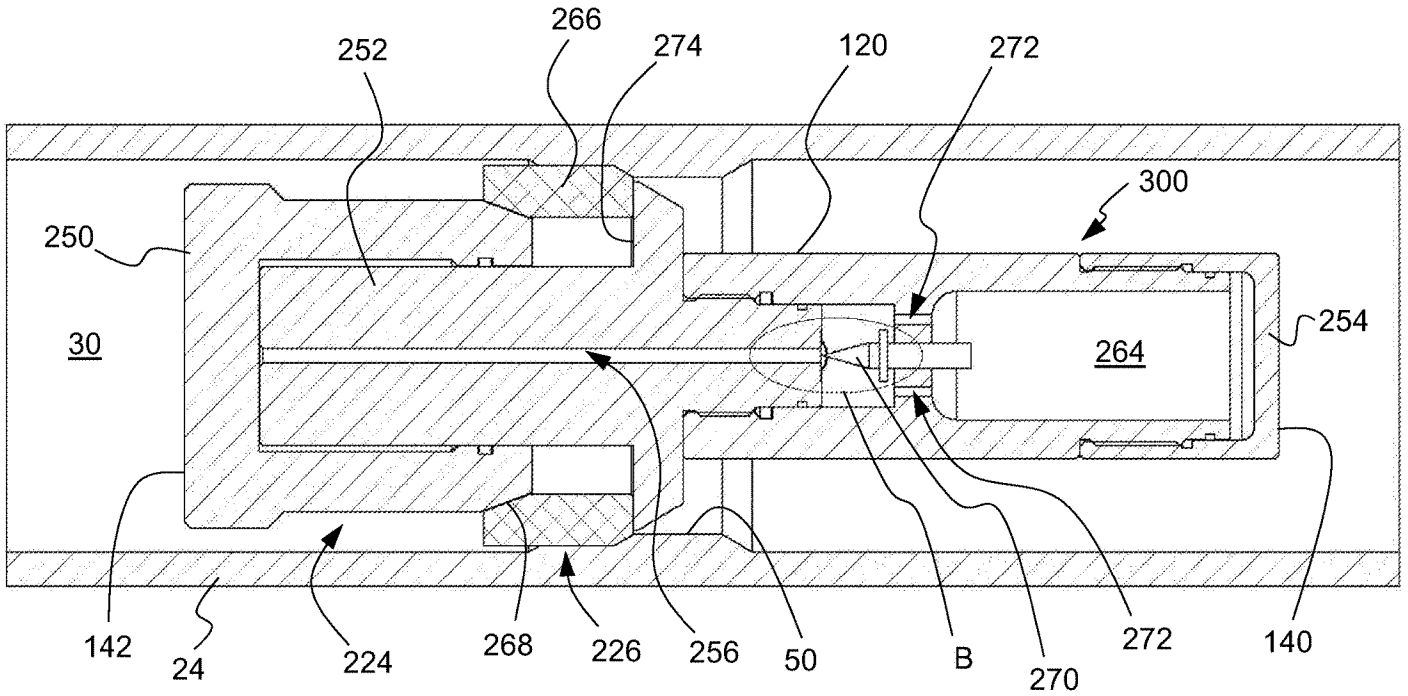
FIG. 6A is a schematic axial cross-sectional view of the dart of FIG. 5A, shown in an activated position, according to one embodiment of the present disclosure.
Figure 6B:
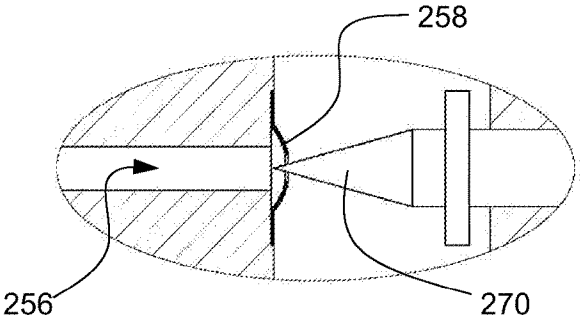
FIG. 6B is a magnified view of area "B" of FIG. 6A, showing a ruptured burst disk.

FIG. 6A shows the dart 300 in its activated position, according to one embodiment. As shown in FIGS. 6A and 6B, the burst disk 258 is ruptured by the piercing member 270. Once the burst disk 258 is ruptured, the flow path 256 is unblocked. The unblocking of flow path 256 establishes fluid communication between the hydrostatic chamber 260 and the atmospheric chamber 264, whereby incompressible fluid from chamber 260 can flow to chamber 264 via flow path 256 and ports 272 to equalize the pressures in the chambers 260,264. The equalization of pressure causes the piston 252 to further extend axially into the hydrostatic chamber 260, which in turn shifts the first housing 250, along with cone 268, axially towards the slips 266, causing the cone to slide (further) under the slips, thereby forcing the slips to expand radially outwardly to place the engagement mechanism 266 into the activated (or "expanded") position. In some embodiments, once the engagement mechanism 266 is activated, the dart 300 is placed in the activated position.

In some embodiments, the engagement mechanism 266 is configured such that its effective outer diameter in the inactivated (or initial) position is less than the inner diameter of the tubing string and the features in the tubing string. In the activated (or expanded) position, the effective outer diameter of the engagement mechanism 266 is greater than the inner diameter of a feature (e.g., a constriction 50) in tubing string 24. When activated, the engagement mechanism 266 can engage the feature so that the activated dart 300 can be caught by the feature. Where the feature is a downhole tool and the dart 300 is caught by the tool, the dart may act as a plug and the tool may be actuated by the dart by the application of fluid pressure in the tubing string from surface E, to cause pressure uphole from the dart 300 to increase sufficiently to move a component (e.g., shift a sleeve) of the tool.

While in some embodiments the activated dart 300 is configured to operate as a plug in the tubing string 24, which may be useful for wellbore treatment, the dart's continued presence downhole may adversely affect flowback of fluids, such as production fluids, through tubing string 24. Thus, in some embodiments, dart 300 may be removeable with flowback back toward surface E. In alternative embodiments, the dart 300 may include a valve openable in response to flowback, such as a one-way valve or a bypass port openable sometime after the dart's plug function is complete. In other embodiments, at least a portion of the dart 300 is formed of a material dissolvable in downhole conditions. For example, a portion of the dart (e.g., the body 120) may be formed of a material dissolvable in hydrocarbons such that the portion dissolves when exposed to a back flow of production fluids. In another example, the dissolvable portion of the dart may break down at above a certain temperature or after prolonged contact with water, saline, etc. In this embodiment, for example, after some residence time during hydrocarbon production, a major portion of the dart is dissolved leaving only small components such as the control module, magnets, etc. that can be produced to surface with the flowbacking produced fluids. Alternatively, the activated dart 300 can be drilled out.

FIGS. 7 to 10 show an alternative engagement mechanism 366. Instead of slips, engagement mechanism 366 comprises a seal 310, such as an elastomeric seal, a first support ring 330 and a second support ring 350, all supported on the outer surface of cone 268 or alternatively the outer surface of the piston 252 (shown in FIG. 5). For simplicity, in FIGS. 7 to 10, engagement mechanism 366 is shown without the other components of dart 300. The engagement mechanism 366 has an initial position, shown in FIG. 7 (with cone 268) and FIG. 8 (without cone 268), and an expanded position, shown in FIG. 9 (with cone 268) and FIG. 10 (without cone 268). In some embodiments, when the dart 300 is in the inactivated position, the engagement mechanism 366 is in the initial position, and when the dart is in the activated position, engagement mechanism 366 is in the expanded position.

In the illustrated embodiment, the seal 310 is an annular seal having an outer surface 312 and an inner surface 314, the latter defining a central opening for receiving a portion of the cone 268 therethrough. In some embodiments, the inner surface of the seal 310 is frustoconically shaped for matingly abutting against the outer surface of cone 268. The seal 310 is expandable radially to allow the seal 310 to be slidably movable from a first axial location of the cone 268 to a second axial location of the cone 268, wherein the outer diameter of the second axial location is greater than that of the first axial location. In some embodiments, the seal 310 is formed of an elastic material that is expandable to accommodate the greater outer diameter of the second axial location, while maintaining abutting engagement with the outer surface of cone 268 (as shown for example in FIG. 9A). In the illustrated embodiment, a first support ring 330 is disposed in between the seal 310 and a second support ring 350.

Figure 10C:
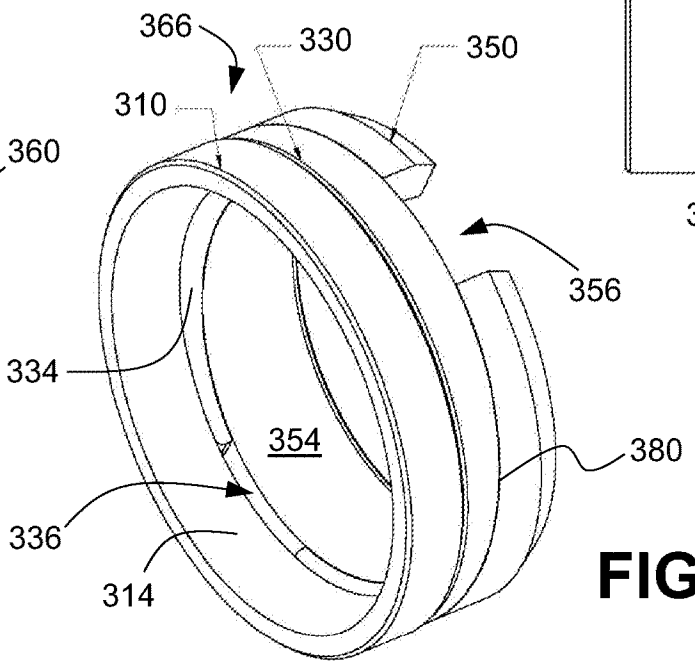
Figure 12A:
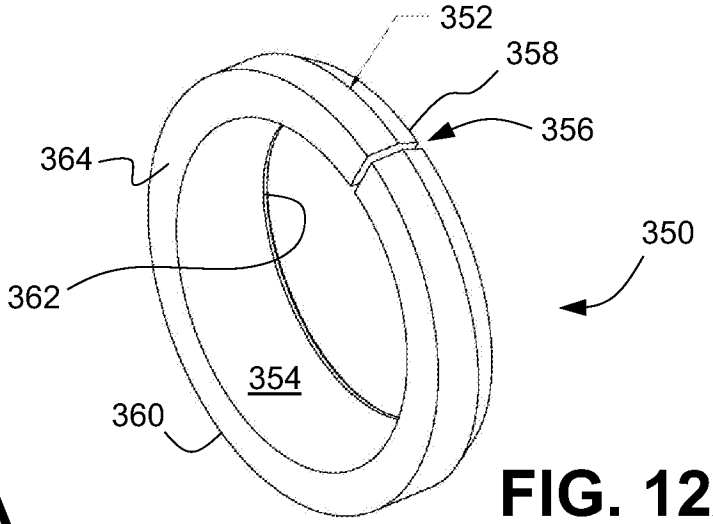
FIG. 12A is a perspective view of a second support ring of the engagement mechanism of FIG. 8, according to one embodiment.
Figure 12B:
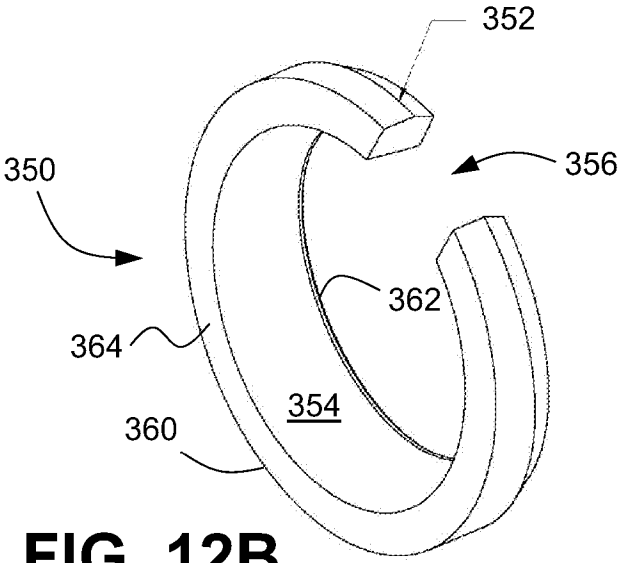
FIG. 12B is a perspective view of the second support ring of the engagement mechanism of FIG. 10, according to one embodiment.
Figure 11A:
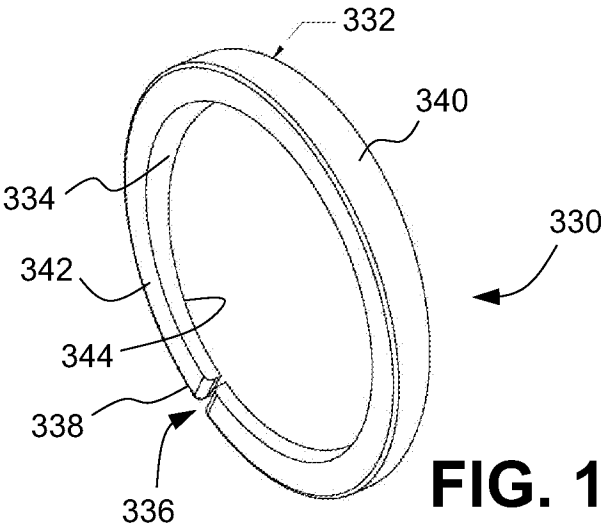
FIG. 11A is a perspective view of a first support ring of the engagement mechanism of FIG. 8, according to one embodiment.
Figure 11B:
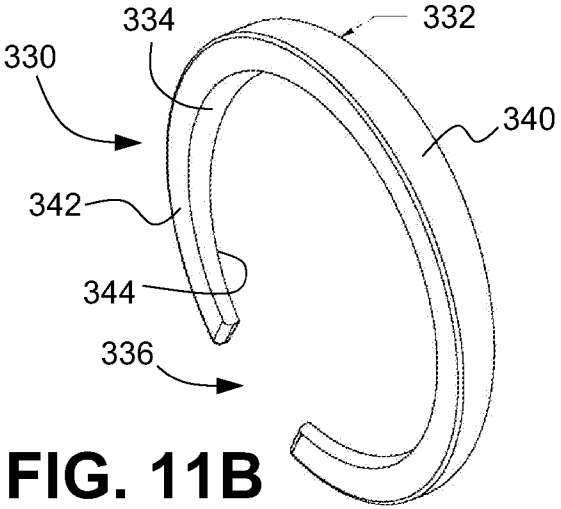
FIG. 11B is a perspective view of the first support ring of the engagement mechanism of FIG. 10, according to one embodiment.

With further reference to FIGS. 11 and 12, each support ring 330,350 has a respective outer surface 332,352 and a respective inner surface 334,354, the latter defining a central opening for receiving a portion of the cone 268 therethrough. In some embodiments, the inner surface 334,354 of each ring 330,350 may be frustoconically shaped for matingly abutting against the outer surface of cone 268. The first and second support rings 330,350 are expandable radially to allow the rings to be slidably movable from a first axial location to a second axial location of the cone 268, wherein the outer diameter of the second axial location is greater than that of the first axial location. To allow for radial expansion to accommodate the greater outer diameter of the second axial location, the first and second support rings 330,350 each have a respective gap 336,356 that can be widened when a radially outward force is exerted on the inner surface 334,354, respectively, thereby increasing the size of the central opening and the effective outer diameter of each of the rings 330,350. When the gaps 336,356 are widened (as shown for example in FIGS. 11B and 12B), the inner surfaces 334,354 may remain in abutting engagement with the outer surface of cone 268 (as shown for example in FIG. 9A). In some embodiments, the first and second support rings 330,350 are positioned on the cone 268 such that the gaps 336,356 are azimuthally offset from one another. In one embodiment, as shown for example in FIGS. 8C and 10C, the gaps 336,356 are azimuthally spaced apart by about 180°.

In some embodiments, the axial length of the first and/or second support rings 330,350 is substantially uniform around the circumference of the ring. In some embodiments, the axial length of the first support ring 330 may be less than, about the same as, or greater than the axial length of the second support ring 350.

Figure 8B:
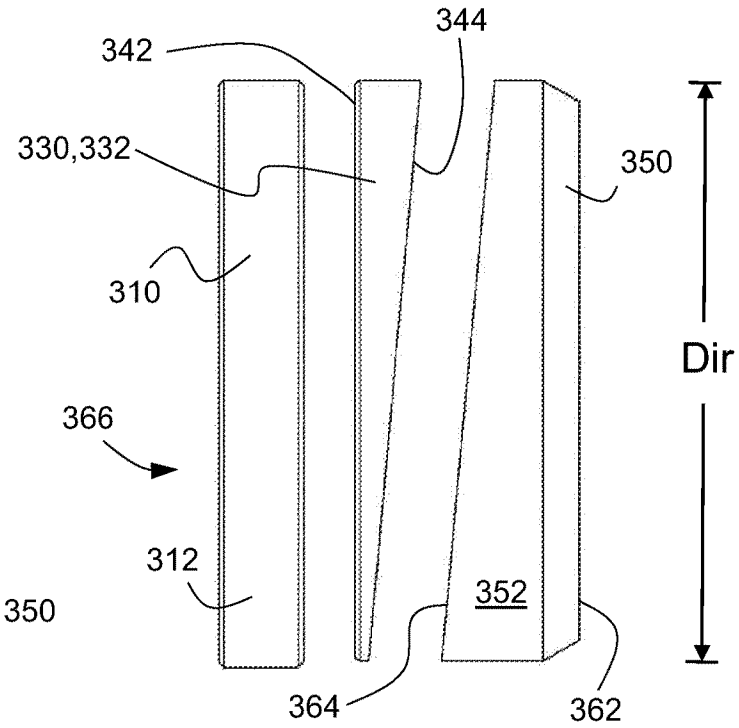
FIGS. 8A, 8B, and 8C are a side view, an exploded side view, and a perspective view, respectively, of the engagement mechanism of FIG. 7, shown without the cone.
Figure 8A:
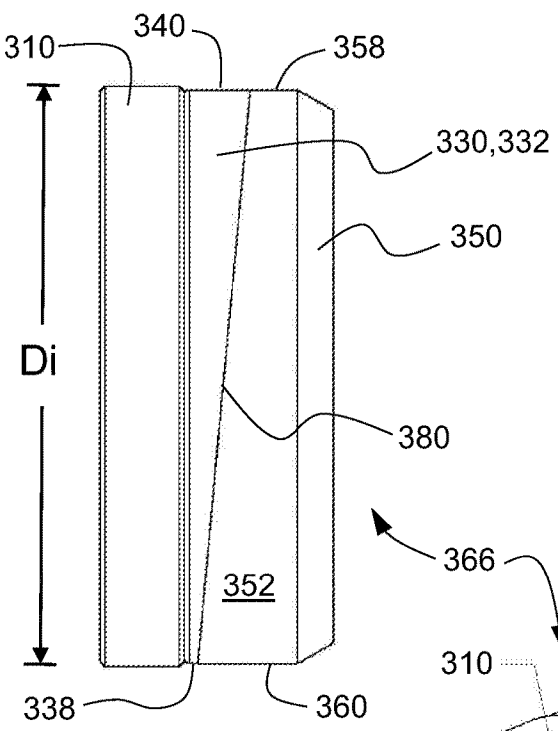
Figure 8C:
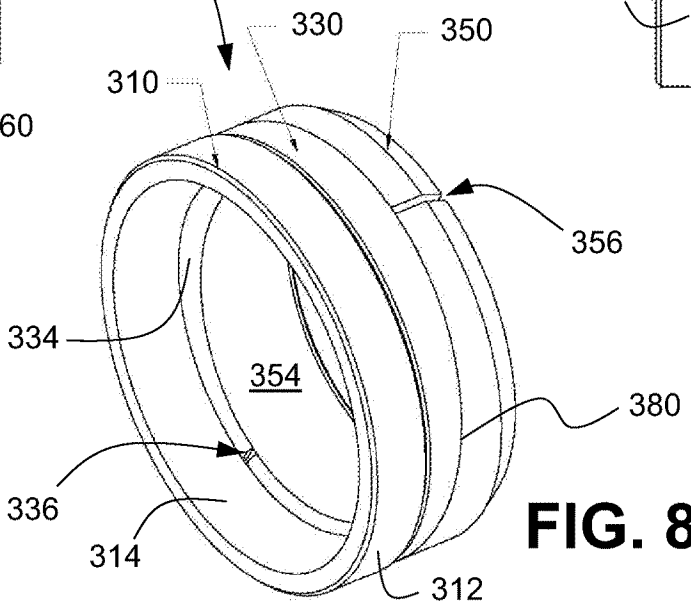
Figure 10B:
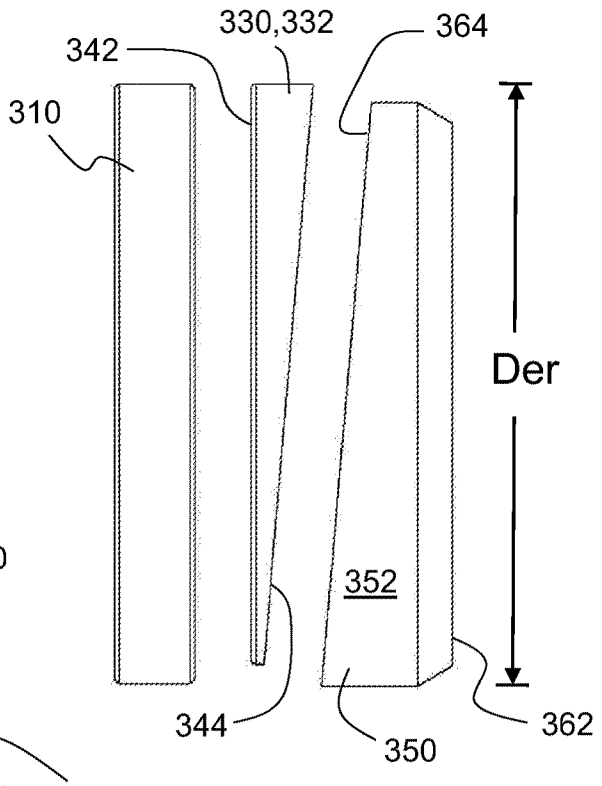
FIGS. 10A, 10B, and 10C are a side view, an exploded side view, and a perspective view, respectively, of the engagement mechanism of FIG. 9, shown without the cone.

In the illustrated embodiment, the axial length of the first support ring 330 varies around its circumference. In the illustrated embodiment, as best shown in FIGS. 8, 10, and 11, the first support ring 330 has a short side 338 and a long side 340, where the long side 340 has a longer axial length than the short side 338. The first support ring 330 has a first face 342 at a first end, extending between the short side 338 and the long side 340; and an elliptical face 344 at a second end, extending between the short side 338 and the long side 340. In some embodiments, the axial length of the first ring 330 around its circumference gradually increases from the short side 338 to the long side 340, and correspondingly gradually decreases from the long side 340 to the short side 338, to define the first face 342 on one end and the elliptical face 344 on the other end. In a sample embodiment, the plane of elliptical face 344 is inclined at an angle ranging from about 1° to about 30° relative to the plane of first face 342. In some embodiments, the elliptical face 344 is inclined at about 5° relative to the plane of the first face 342. In some embodiments, the gap 336 of the first ring 330 is positioned at or near the short side 338, to minimize the axial length of gap 336. While first face 342 is shown in the illustrated embodiment to be substantially circular, first face 342 may not be circular in shape in other embodiments.

In the illustrated embodiment, the axial length of the second support ring 350 varies around its circumference. In the illustrated embodiment, as best shown in FIGS. 8, 10, and 12, the second support ring 350 has a short side 358 and a long side 360, where the long side 360 has a longer axial length than the short side 358. The second support ring 350 has a second face 362 at a first end, extending between the short side 358 and the long side 360; and an elliptical face 364 at a second end, extending between the short side 358 and the long side 360. In some embodiments, the axial length of the second ring 350 around its circumference gradually increases from the short side 358 to the long side 360, and correspondingly gradually decreases from the long side 360 to the short side 358, to define the second face 362 on one end and the elliptical face 364 on the other end. In a sample embodiment, the plane of elliptical face 364 is inclined at an angle ranging from about 1° to about 30° relative to the plane of second face 362. In some embodiments, the elliptical face 364 is inclined at about 5° relative to the second face 362. In some embodiments, the gap 356 of the second ring 350 is positioned at or near the short side 358, to minimize the axial length of gap 356. While second face 362 is shown in the illustrated embodiment to be substantially circular, second face 362 may not be circular in shape in other embodiments.

In some embodiments, the axial length of the long side 360 of the second ring 350 is greater than, about the same as, or less than that of the long side 340 of the first ring 330. In some embodiments, the axial length of the short side 358 of the second ring 350 is greater than, about the same as, or less than that of the short side 338 of the first ring 330. In some embodiments, the axial length of the short side 358 of the second ring 350 may be less than, about the same as, or greater than that of the long side 340 of the first ring 330. In sample embodiments, the axial length of the short side 338 of first support ring 330 is: about 10% to about 30% of the axial length of the long side 340; about 18% to about 38% of the axial length of the short side 358 of second support ring 350; and about 3% to about 23% of the axial length of the long side 360 of second support ring 350. In sample embodiments, the axial length of the short side 338 of first support ring 330 is about 6% to about 26% of the axial length of the seal 310. In some embodiments, the axial length of the long side 360 of the second support ring 350 is about 109% to about 129% of the axial length of the seal 310. In other embodiments, the axial length of the short side 358 of second support ring 350 is: about 10% to about 30% of the axial length of the long side 360; about 18% to about 38% of the axial length of the short side 338 of first support ring 330; and about 3% to about 23% of the axial length of the long side 340 of first support ring 330. As a person skilled in the art can appreciate, other configurations are possible.

With reference to FIGS. 7 to 10, in some embodiments, the elliptical faces 344,364 are configured for mating abutment with one another to define an elliptical interface 380 between the first and second rings, when the first and second rings are engaged with each other. In some embodiments, the first and second rings 330,350 are arranged in engagement mechanism 366 so that the short side 338 of the first ring 330 is positioned adjacent to the long side 360 of the second ring 350; and the short side 358 of the second ring 350 is positioned adjacent to the long side 340 of the first ring 330. In some embodiments, as illustrated in FIGS. 8C and 10C, the gaps 336,356 are positioned at the short sides 338,358, of the first and second support rings 330,350, respectively, such that the gaps 336,356 are azimuthally aligned with the long sides 360,340, respectively, and are offset azimuthally by about 180°.

Figure 7B:
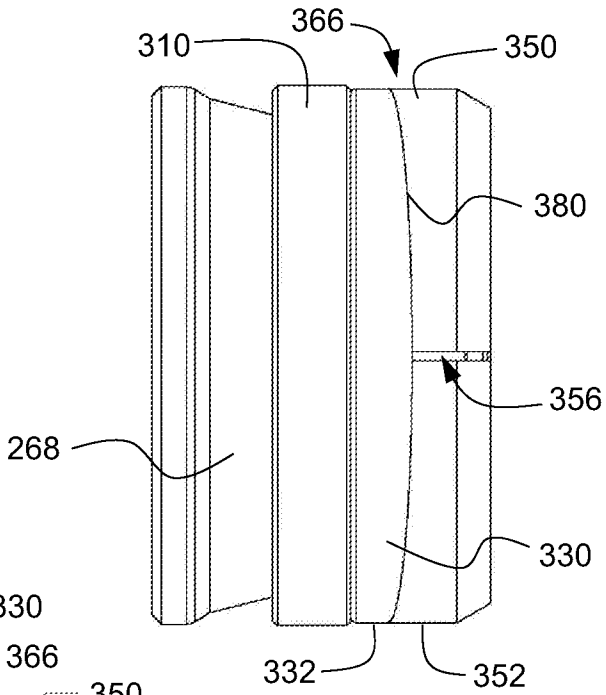
FIGS. 7A, 7B, and 7C are a side cross-sectional view, a side plan view, and a perspective view, respectively, of an engagement mechanism and a cone of a dart, shown in an inactivated position, according to one embodiment of the present disclosure.
Figure 7C:
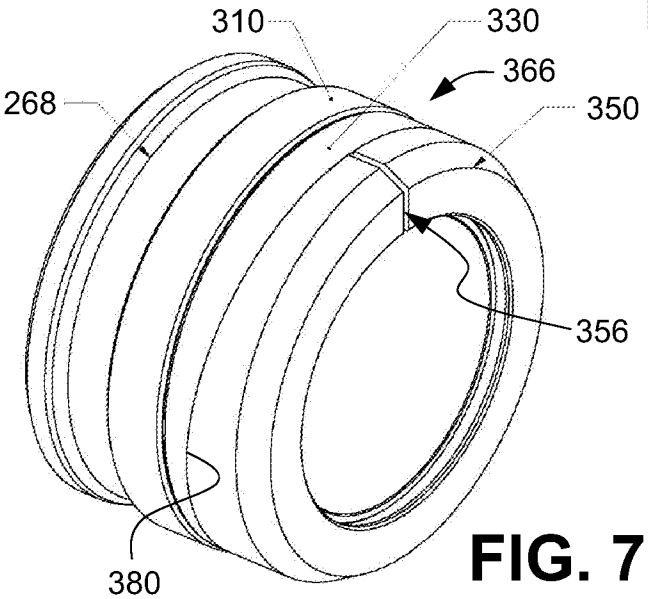
Figure 7A:
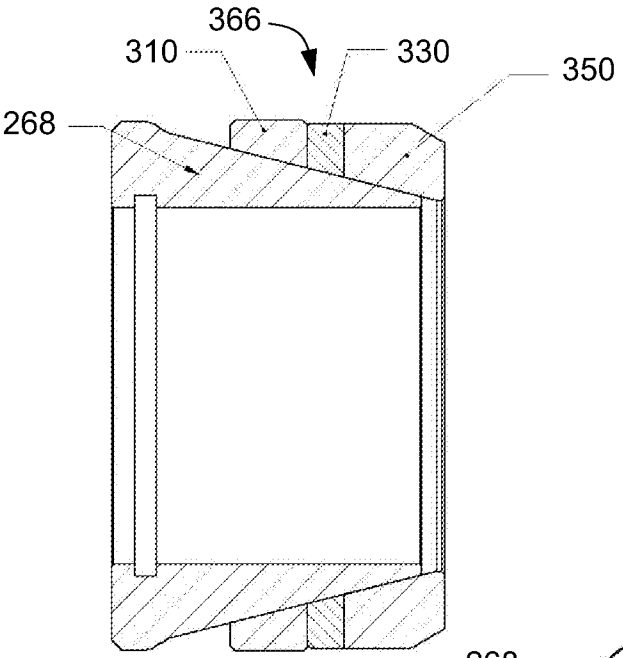

When the dart 300 is in the inactivated position, the engagement mechanism is in the initial position, as shown in FIGS. 7 and 8, wherein the seal 310, the first support ring 330, and the second support ring 350 are supported on either the piston 252 (FIG. 5A) or a first axial location of the cone 268. In some embodiments, the second ring 350 is positioned adjacent to (and may abut against) a shoulder 274 of the piston 252 (FIG. 5A) such that the second face 362 faces the shoulder 274. The shoulder 274 limits the axial movement of the engagement mechanism 366 in the direction towards the leading end 140. In some embodiments, at least a portion of the inner surface 314,334,354 of the seal 310, the first ring 330, and/or the second ring 350, respectively, may abut against the outer surface of cone 268. In some embodiments, the seal 310 and the rings 330,350 are concentrically positioned on the cone and relative to one another. In the initial position, the effective outer diameter of the engagement mechanism 366 is smaller than the inner diameter of the features (i.e., constrictions) in the tubing string, thereby allowing the dart 300 to travel down the tubing string without interference. In some embodiments, in the initial position, the outer surface 312 of the seal 310 has an outer diameter Di and the outer surfaces 332,352 of the first and second rings 330,350 each have an effective outer diameter Dir. The outer diameter Dir of the first and second rings 330,350 may be the same in some embodiments and may be different in other embodiments. In some embodiments, outer diameter Di of the seal 310 is slightly greater than outer diameter Dir of the first and second rings 330,350. In some embodiments, the outer diameters Di and Dir are smaller than the inner diameter of the features in the tubing string. In the inactivated position, the gaps 336,356 each have an initial width.

To transition the engagement mechanism 366 to the expanded position, the cone 268 is pushed axially towards the engagement mechanism, for example, by operation of the actuation mechanism 224 as described above with respect to dart 300. When the second ring 350 abuts against the shoulder 274 of the piston 252 (FIG. 5A), the axial movement of the cone 268 relative to the engagement mechanism 366 slidably shifts the engagement mechanism 366 from the first axial location of the cone to a second axial location of the cone, wherein the second axial location has a greater outer diameter than that of the first axial location. When the engagement mechanism 366 engages a larger outer diameter of the cone 268, the increase in outer diameter of the cone from the first axial location to the second axial location exerts a force on the inner surfaces 314,334, 354 of the seal 310, the first ring 330, and the second ring 350, respectively. Due to the frustoconically shaped outer surface of the cone 268 and the matingly shaped inner surfaces 314,334,354, the force exerted on the seal 310 and the rings 330,350 may be a combination of a radially outward force and an axial compression force. In some embodiments, the exerted force causes the seal 310 to expand radially and the gaps 336,356 of the first and second rings 330,350 to widen to accommodate the larger diameter portion of the cone, thereby placing the engagement mechanism 366 into the expanded position.

Figure 9B:
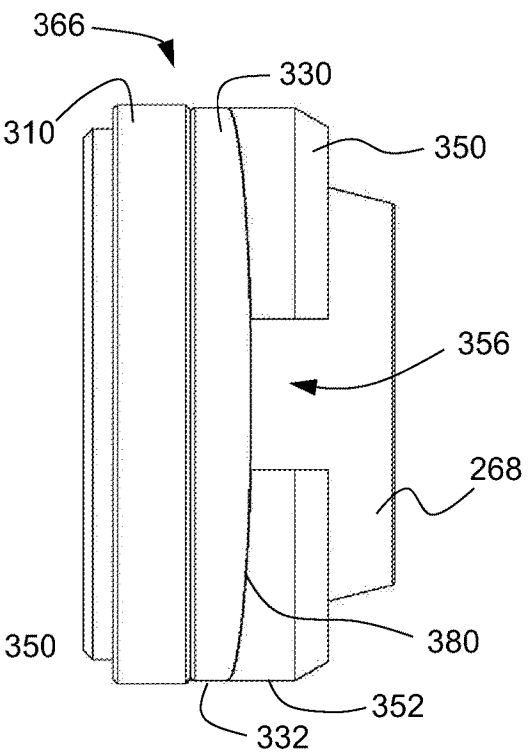
FIGS. 9A, 9B, and 9C are a side cross-sectional view, a side plan view, and a perspective view, respectively, of the engagement mechanism and the cone of FIG. 7, shown in an activated position, according to one embodiment of the present disclosure.
Figure 9C:
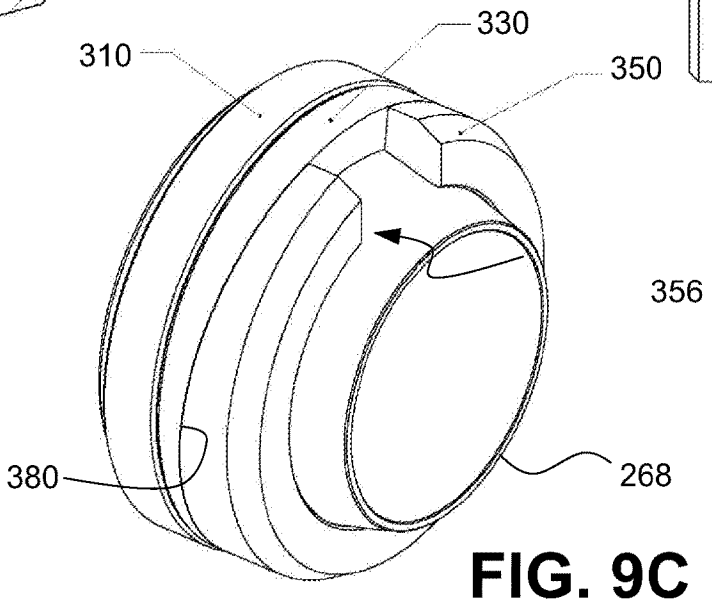
Figure 9A:
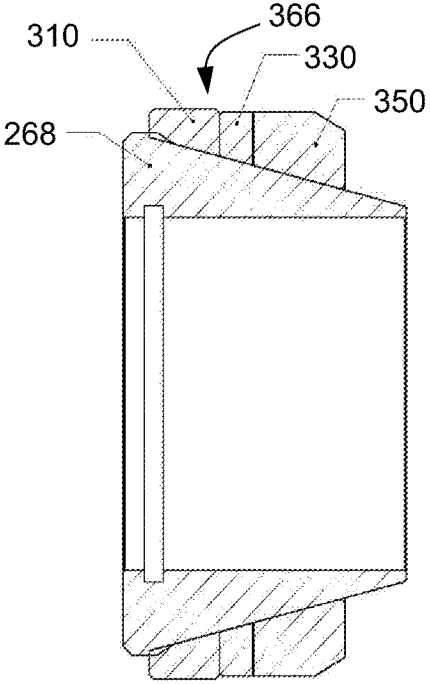

In the expanded position, as shown in FIGS. 9 and 10, the seal 310, the first support ring 330, and the second support ring 350 are supported on the second (larger outer diameter) axial location of the cone 268. In some embodiments, at least a portion of the inner surface 314,334,354 of the seal 310, the first ring 330, and/or the second ring 350, respectively, may abut against the outer surface of cone 268. In the expanded position, the effective outer diameter of the engagement mechanism 366 is greater than the inner diameter of the features (i.e., constrictions) in the tubing string, thereby allowing the dart 300 to be caught by the next feature in the dart's path.

In some embodiments, in the expanded position, the outer surface 312 of the seal 310 has an outer diameter De which is greater than the outer diameter Di at the initial position. In the expanded position, the gaps 336,356 of rings 330,350 are widened, as best shown in FIGS. 10C, 11B, and 12B, such that the width of each of the gaps 336,356 is greater than their respective initial width (shown in FIGS. 8C, 11A, and 12A). The widening of gaps 336,356 may increase the effective outer diameters of the first and second rings 330, 350. The effective outer diameter of the first and second rings 330,350 in the expanded is denoted by "Der". The outer diameter Der of the rings 330,350 is greater than the outer diameter Dir at the initial position. The outer diameter Der of the first and second rings 330,350 may be the same in some embodiments and may be different in other embodiments. In some embodiments, outer diameter De of the seal 310 is slightly greater than outer diameter Der of the first and second rings 330,350. In the expanded position, one or both of the outer diameters De, Der are greater than the inner diameter of at least one feature in the tubing string.

Figure 10A:
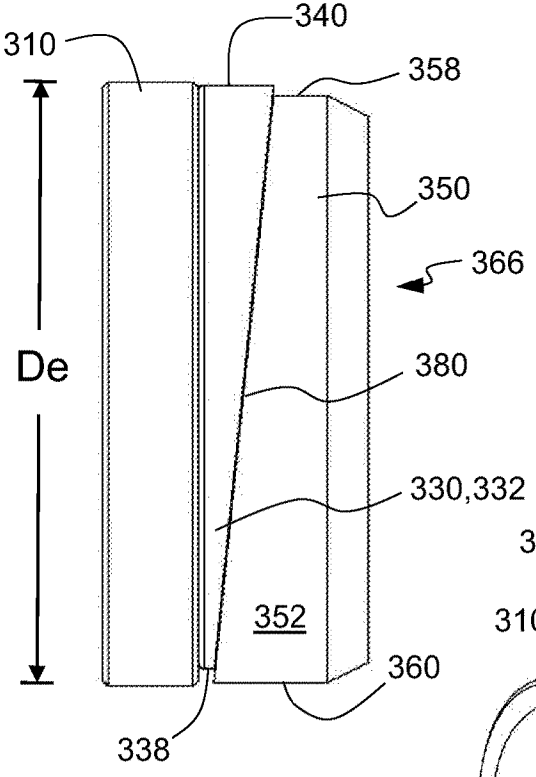

In some embodiments, as best shown in FIG. 10A, the shift to a larger outer diameter portion of the cone 268 forces the seal 310 to abut against the first face 342 of the first ring 330 and/or the elliptical face 344 of the first ring 330 to abut against the elliptical face 364 of the second ring 350. The engagement of the elliptical faces 344,364 forms the elliptical interface 380 between the rings 330,350. When under axial compression, the elliptical interface 380 may cause the rings 330,350 to offset radially relative to one another, which may help maximize the effective outer diameter Der across the rings, between the long side 340 to the long side 360. The radial offsetting of the rings 330,350 may cause the rings to become eccentrically positioned relative to one another. As best shown in FIG. 10C, the rings 330,350, together, provide structural support for the seal 310, especially in the expanded position. In some embodiments, a majority portion of the seal 310 around its circumference is supported by the combined axial length of material of the first and second rings 330,350. The portions of the seal 310 that are not supported by the combination of the first and second rings are the areas of the seal that are azimuthally aligned with the gaps 336,356. The area of the seal 310 that is aligned with gap 356 of the second ring 350 is supported by the first ring 330 (e.g., the long side 340 of the first ring 330).

As best shown in FIG. 10, where the gaps 336,356 are positioned at or near the short sides 338,358 of the rings 330,350, respectively, and where the rings 330,350 are arranged such that each short side 338,358 is positioned adjacent to the long side 360,340 of the other ring, the longest axial section of each ring 330,350 provides structural support to the other ring at the widened gap 356,336. When the rings are so arranged, the areas of the seal 310 that are azimuthally aligned with the gaps 336,356 are also aligned with the longest axial sections (i.e., long sides 360,340, respectively) of the rings 330,350.

In some embodiments, where the length of short side 338 is less than that of short side 358, the widened gap 336 is shorter axially than the widened gap 356 even if the circumferential width of the gaps 336,356 may be about the same. As a result, the gap 336 has less volume than the gap 356. By configuring and arranging the rings 330,350 as described above and placing the seal 310 against the first ring 330, the amount of space into which the expanded seal 310 may extrude can be minimized without compromising the overall support of the seal by the rings 330,350. Minimizing the amount of extrusion of the expanded seal 310 may help reduce structural damage to the seal that may affect its sealing function.

In some embodiments, the first and/or second support rings 330,350 may be made of one or more of: metal, such as aluminum; and alloy, such as brass, steel, aluminum, magnesium alloy, etc. In some embodiments, the first and/or second support rings 330,350 are made, at least in part, of a dissolvable material such as dissolvable magnesium alloy. In some embodiments, the first and/or second support rings 330,350 are configured to at least partially dissolve in the presence of one or more of flowback fluids, frac fluids or other wellbore treatment fluids, load fluids, and production fluids.

In some embodiments, the material of seal 310 comprises one or more polymers, such as for example polyglycolic acid (PGA), polyvinyl acetate (PVA), polylactic acid (PLA), or a copolymer comprising PGA and PLA. In some embodiments, the seal 310 is configured to at least partially dissolve in the presence of production fluid and/or water.

While engagement mechanisms 266,366 are described above with respect to an untethered dart, it can be appreciated that the engagement mechanisms disclosed herein can also be used in other downhole tools, including a tethered device that is conveyed into the tubing string by wireline, coiled tubing, or other methods known to those in the art.

In other embodiments, the engagement mechanism of the dart may be retractable dogs, a resilient bladder, a packer, etc. For example, instead of slips or an annular seal, the dart may include retractable dogs that protrude radially outwardly from the body 120 but are collapsible when the dart is inactivated in order to allow the dart to squeeze through non-target constrictions. When the dart is activated, a back support (for example, a portion of the first housing 250 in FIG. 5A) is moved against the dogs such that the dogs are no longer able to collapse. The effective outer diameter of the dogs, when not collapsed, is greater than the inner diameter of the constrictions. As a result, when the dart is inactivated, the dogs can collapse to allow the dart to pass through a constriction and can re-extend radially outwardly after passing through the constriction. When the dart is activated, the dogs cannot collapse, and the dart can thus engage the constriction of the target tool as the dart cannot pass therethrough. In this manner, fluid pressure can be applied against the dart to actuate the target tool as described above. In some embodiments, protrusions 128 of the dart (see FIG. 2B) serve as the retractable dogs. In other embodiments, the retractable dogs are separate from protrusions 128.

In another sample embodiment, the deployment element may be a resilient bladder having an outer diameter that is greater than the inner diameter of the constrictions. In embodiments, the outer diameter of the bladder is greater than the remaining portion of the body 120 of the dart so only the bladder has to squeeze through each constriction as the dart passes therethrough. The bladder can resiliently collapse inwardly to allow the dart to pass through the constriction and can regain its shape after passing therethrough. The bladder can be formed of various resilient materials know to those skilled in the art that are usable in downhole conditions. When the dart is activated, the bladder can no longer collapse. This may be achieved, for example, by the bladder defining the atmospheric chamber of the dart and the bladder becomes un-collapsible as a result of incompressible fluid entering the bladder from the hydrostatic chamber after the actuation mechanism is activated. When the bladder is deployed (i.e. becomes un-collapsible) and the dart can then engage a constriction of the target tool downhole therefrom as the deployed bladder can no longer squeeze through the constriction. In this manner, fluid pressure can be applied against the dart to actuate the target tool as described above. In some embodiments, the bladder acts as protrusions 128 of the dart (see FIG. 2) and the rare-earth magnets 130 are embedded in the bladder. In other embodiments, the bladder is separate from protrusions 128.

Flowback Mechanism

Figure 16A:
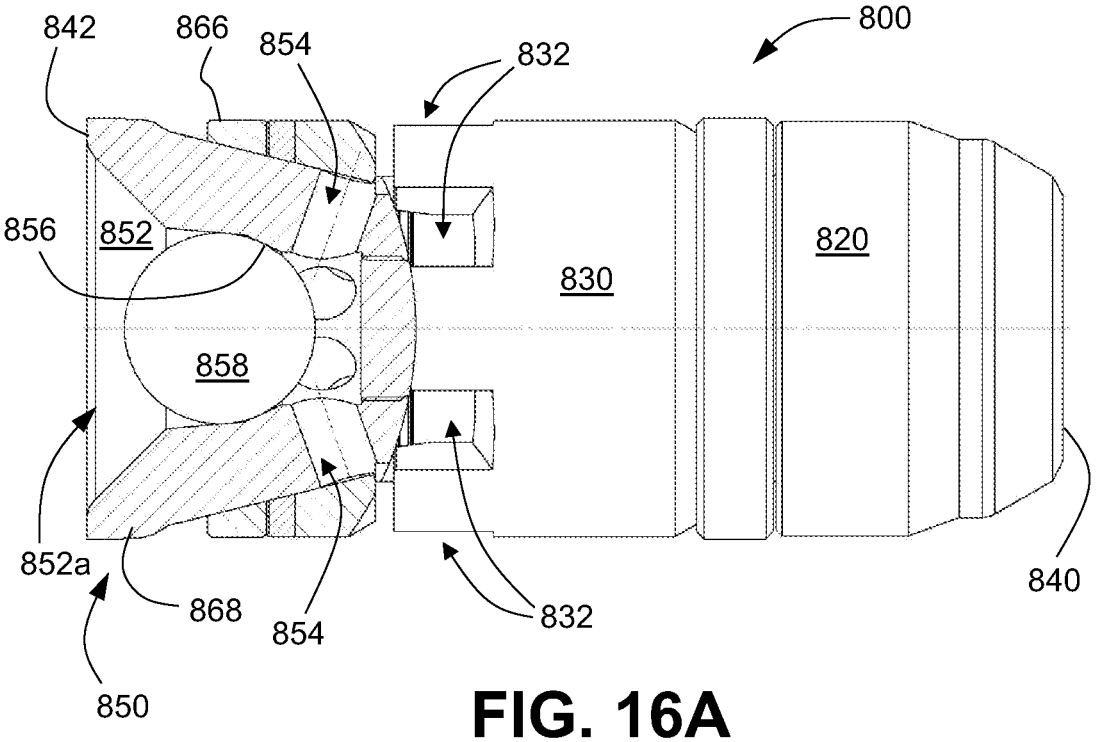
FIG. 16A is a partial cross-sectional side view of a dart according to another embodiment of the present disclosure. The dart has a flowback valve and is shown in the inactivated position.
Figure 16B:
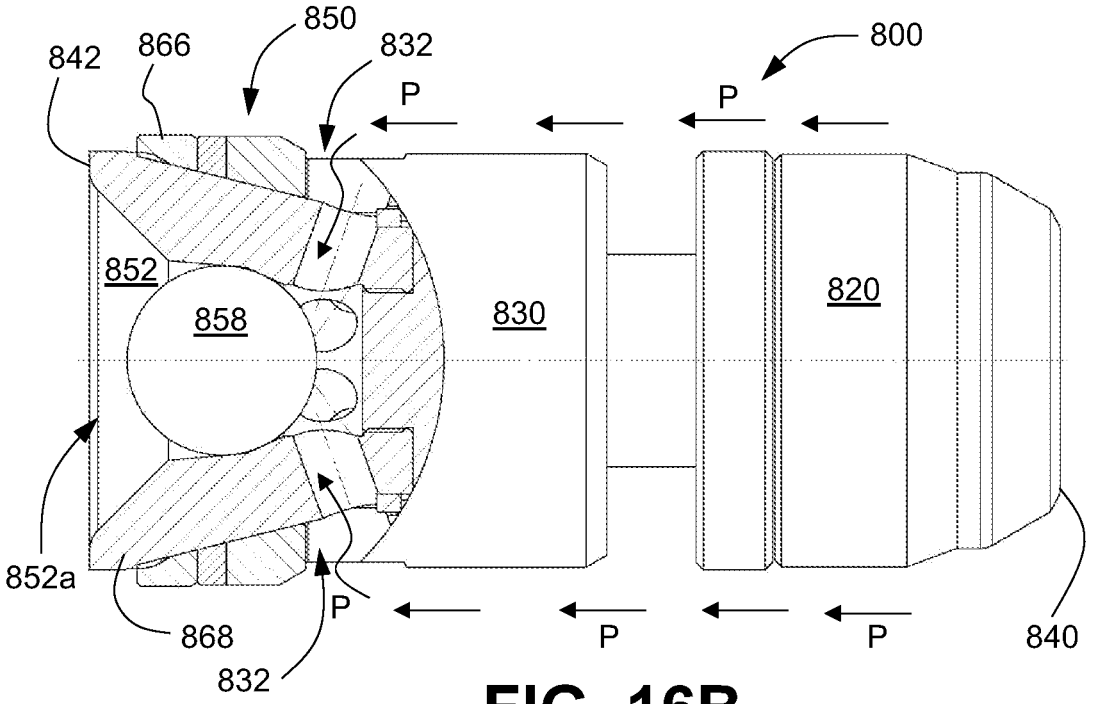
FIG. 16B is a partial cross-section side view of the dart in FIG. 16A, shown in the activated position.

In some embodiments, the dart comprises a mechanism to allow fluid to flow through the dart via an inner flow path of the dart in the direction from the leading end to the trailing end when the dart is activated. FIG. 16 shows one embodiment of a dart 800 having a sample of such a mechanism: flowback valve 850. The flowback valve 850 is configured to permit fluid flow from one side (i.e., downhole side) of the dart's engagement mechanism 866 to the other side (i.e., uphole side) thereof when the dart is activated and caught by a constriction (not shown in FIG. 16). The dart 800 is shown in the inactivated position in FIG. 16A and in the activated position in FIG. 16B. For simplicity, some components such as the control module and actuation mechanism of the dart 800 are not shown in FIG. 16.

Dart 800 has a body 820, which may be elongated and generally cylindrical in shape in some embodiments. The body 820 has a leading end 840 and a trailing end 842. The leading end 840 and the trailing end 842 may also be referred to as the downhole end (or lower end) and the uphole end (or upper end), respectively. The leading end 842 may be tapered or frustoconically-shaped in some embodiments.

In the illustrated embodiment, at the trailing end 842, the dart 800 has a cone 868, similar to cone 268 of dart 300, as described above with respect to FIGS. 5 and 6. The cone 868 has a lower end and an upper end, the lower end being closer to the leading end 840 than the upper end. In the illustrated embodiment, the upper end of the cone 868 coincide with the trailing end 842 of the dart 800. The outer diameter of the cone 868 increases gradually from the lower end to the upper end such that the upper end has a larger outer diameter than the lower end. In some embodiments, the cone 868 may be part of the body 820 or attached to the body 820, at or near the trailing end 842. In some embodiments, no matter which position the dart 800 is in, cone 868 remains stationary relative to the body 820.

In the illustrated embodiment, the flowback valve 850 is disposed in the cone 868 and is a one-way ball valve. The flowback valve 850 has an inner bore 852 which is defined by the inner surface of the cone 868. The inner bore 852 opens at one end 852*a* at the upper end of the cone 868 (or the trailing end 842). The other end of the inner bore 852 is in communication with a plurality of flow passages 854. The flow passages 854 extend radially outwardly through the wall of the cone 868, from the inner bore 852 to the outer circumference of the cone 868, thereby allowing fluid communication between the inner bore 852 and the outer surface of the cone 868. In the illustrated embodiment, the flow passages 854 are positioned at an axial location of the cone 868 that is closer to the lower end than the upper end of the cone 868. In the illustrate embodiment, the flow passages 854 are positioned in a lower portion of the cone 868. In some embodiments, the flow passages 854 are angled towards the leading end 840 for receiving fluid flowing from the leading end 840 towards the trailing end 842 of the dart.

The flowback valve 850 comprises a ball 858. A ball seat 856 is defined in the inner bore 852 by the inner surface of the cone 868 and is positioned axially above the flow passages 854, i.e., the ball seat 856 is closer to the trailing end 842 than the flow passages 854. In other words, when the dart 800 is travelling downhole, the ball seat 856 is uphole from the flow passages 854. The ball seat 856 may be a narrower part (or smaller inner diameter portion) of the inner bore 852. The ball seat 856 is configured to receive the ball 858. When ball 858 is received in the ball seat 856, the ball is restricted from moving axially inside inner bore 852 towards the lower end of the cone 868. Further, when the ball 858 is seated in ball seat 856, the ball 858 blocks fluid communication between the open end 852*a* of the inner bore 852 and the plurality of flow passages 854. When the ball 858 is unseated from ball seat 856, fluid communication is permitted between the open end 852*a* of inner bore 852 and the plurality of flow passages 854. The flowback valve operates as a one-way valve which restricts fluid flow from the open end 852*a* to the flow passages 854 but permits fluid flow in the reverse direction, i.e., from the flow passages 854 to the open end 852*a*.

In some embodiments, at least part of the ball seat 856 is made of a dissolvable material and may dissolve in the presence of one or more of flowback fluids, frac fluids or other wellbore treatment fluids, load fluids, and production fluids. In some embodiments, the material of the ball seat 856 is selected to have less strength than the material of a typical sleeve seat of the conventional ball-activated sleeve system. In some embodiments, the ball seat 856, or at least a portion thereof, is made of a magnesium alloy.

In some embodiments, the ball seat 856 and the ball 858 are configured such that there is a sufficiently large contact area therebetween when the ball 858 is seated in ball seat 856 to allow the ball to be easily lifted off of seat 856. In some embodiments, the contact stress between the ball 858 and the ball seat 856 is about 100 ksi or less, so that less than 100 psi is required to lift the ball 858 off the seat 856.

Between the leading end 840 and the trailing end 842, the dart 800 has an engagement mechanism 866, similar to engagement mechanism 366, as described above with respect to FIGS. 7 to 12. The engagement mechanism 866 is supported on the outer surface of cone 868 in both the activated and inactivated positions and is slidably movable relative to the body 820 and the cone 868. The engagement mechanism 866 is shiftable in the direction from the lower end to the upper end of the cone 868, i.e., from the lower portion of the cone 868 in the inactivated position to an upper portion of the cone 868 in the activated position. The shifting of the engagement mechanism 866 from the lower portion to the upper portion of the cone 868 causes the engagement mechanism 866 to expand radially, thus increasing the outer diameter of the engagement mechanism 868, for engagement with a constriction, for example.

In the illustrated embodiment, the dart 800 has a middle housing 830 that is slidably supported on the body 820, between the leading end 840 and the trailing end 842, such that the middle 830 can move axially relative to the body 820 and the cone 868. In the illustrate embodiment, the middle housing 830 is in the form of an annular sleeve. The middle housing 830 is shiftable axially in the direction from the leading end 840 to the trailing end 842 for a predetermined distance relative to the body 820 and the cone 868. In the illustrated embodiment, the middle housing 830 is positioned below the engagement mechanism 866, i.e., the middle housing is closer to the leading end 840 than the engagement mechanism 866.

In some embodiments, the middle housing 830 and the engagement mechanism 866 are configured to move together, almost synchronously. In some embodiments, to transition the dart 800 from the inactivated position to the activated position, the dart 800 is actuated to shift the middle housing 830 upwards towards the trailing end 842 relative to the body 820, to push up against and in turn urge the engagement mechanism 866 to move to the upper portion of the cone 868. In some embodiments, prior to actuation of the dart 800, the middle housing 830 may be held in place and secured to the body 820 by a shear pin (not shown) or the like.

In some embodiments, the middle housing 830 has a plurality of slots 832 intermittently positioned and circumferentially spaced apart around the upper end of the middle housing 830. The slots 832 extend through the wall of the middle housing 830 to permit communication between the inner surface and outer surface of the middle housing 830 through the slots 832. In some embodiments, the spacing and positioning of the slots 832 are selected for alignment with the flow passages 854 of the cone 868 to permit fluid communication therebetween when the dart 800 is activated.

Other configurations of the middle housing 830 are possible. For example, in other embodiments, the middle housing 830 may have apertures or axial channels instead of slots 832. In alternative or additional, the middle housing 830 may be rotationally supported on the body 820 such that the middle housing 830 is rotated as the dart transitions from the inactivate position to the activated position.

In some embodiments, in its inactivated position, at least a portion of the outer surface of the dart 800 (or any component thereof) is coated with a protective coating to help shield the dart 800 in case the dart is exposed to treatment fluids (e.g., acid) while the dart is conveyed downhole. In some embodiments, at least a portion of the outer surface of the cone 868 and/or the engagement mechanism 866 is coated with the protective coating. In some embodiments, the protective coating can be at least partially removed by friction, i.e., movement between the cone and the engagement mechanism against one another during the transition from the inactivated position to the activated position. In alternative or additional embodiments, the protective coating can be at least partially removed by exposure to brine or water and/or by erosion caused by the dart's passage through fluid or by the flow of high velocity fluids around the dart. In some embodiments, the protective coating is a thin film ceramic coating and/or polymer coating, such as Xylan®, Teflon™, etc.

In the illustrated embodiment, when the dart is not activated as shown in FIG. 16A, the engagement mechanism 866 is positioned on the cone 868 to block the plurality of flow passages 854, such that little or no fluid can enter the flow passages 854 from the outer surface of the cone 868. Also, in the inactivated position, the slots 832 of the middle housing 830 are below the flow passages 854.

When the dart is activated as shown in FIG. 16B, the engagement mechanism 866 is shifted to the upper portion of the cone, thereby unblocking the flow passages 854 to allow fluid to enter the flow passages 854 from the outer surface of the cone 868. In the activated position, the middle housing is also shifted axially relative to the body 820 toward the trailing end 842. Once shifted, the slots 832 of the middle housing 830 coincide with the openings of the flow passages 854 on the outer surface of the cone 868, so that fluid external to body 820 can flow into the inner bore 852 of the cone via slots 832 and flow passages 854. In the illustrated embodiment, when the slots 832 are aligned with the flow passages 854, each flow passage opens to a circumferential location at a lengthwise side of the dart 800 so fluid around the circumference of the dart can enter the dart from the side through the radially extending flow passages 854. The circumferential location is positioned at an axial location between the leading end 840 and the trailing end 842 of the dart. The flow passages 854 and inner bore 852, together, may be referred to as an inner flow path of the dart 800. The flow path of fluid that is permitted through the dart when the dart 800 is in the activated position is shown by arrows P. Flow passages 854 may be referred to as the inlets of the inner flow path, and the flow passages are configured to receive fluid from the sides of the dart 800 in the illustrated embodiment. The open end 852*a* of the inner bore 852 may be referred to as the outlet of the inner flow path.

Figure 17:
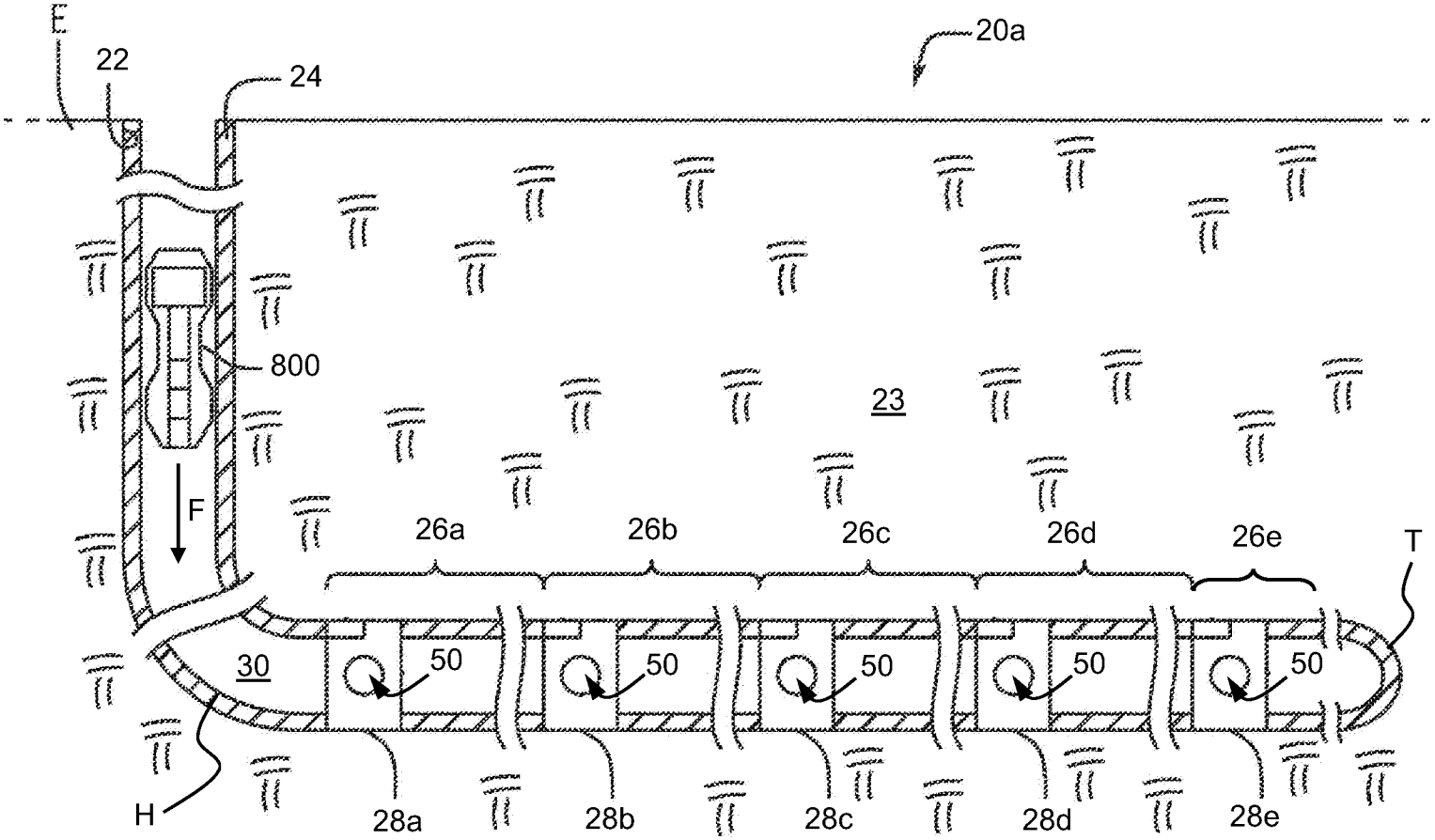
FIG. 17 is a schematic drawing of a multiple stage well according to another embodiment of the present disclosure, wherein the well comprises one or more constrictions and one or more darts of FIG. 16 can be deployed therein.

The operation of dart 800 is now described with reference to FIG. 17. FIG. 17 illustrates the multistage well 20*a* as described above with respect to FIG. 1B and dart 100. In operation, dart 800 is deployed in its inactivated position into the passageway 30 of tubing string 24. Prior to deployment, the dart 800 may be preprogrammed to engage with a specific target tool, for example tool 28*d*, in accordance with the above description. In some embodiments, fluid is pumped into the passageway 30 to convey the dart 800 downhole towards the target tool 28*d*. The dart 800 may autonomously determine its location in the tubing string 24 and its impending arrival at the target tool 28*d* by any of the abovementioned methods. In the inactivated position, the flow passages 854 of the flowback valve 850 are blocked by the engagement mechanism 866, as the engagement mechanism is in its initial position on the lower portion of the cone 868. In the inactivated position, the ball 858 is seated in the ball seat 856, whether by fluid pressure above (i.e., uphole from) the dart 800 and/or by other methods, such as adhesives. With ball 858 received in the ball seat 856 above flow passages 854, fluid communication between the open end 852*a* and the flow passages 854 is restricted. In the inactivated position, the dart 800 is configured to freely pass through the constrictions 50 in the tubing string 24.

In some embodiments, the dart 800 is configured such that in its inactivated position, its nominal outer diameter is small enough to allow the dart to pass through not only constrictions 50 but also any deformations and/or over-torqued connections in the tubing string 24 that can cause irregularities in the inner diameter of the tubing string 24. For example, deformations and/or over-torque connections may cause the lateral cross-sectional profile of the corresponding sections in the tubing string 24 to become oval in shape rather than circular. In further embodiments, the outer diameter of the inactivated dart 800 is selected to minimize slippage, i.e., to minimize the volume of pumped fluid needed to propel the dart 800 downhole at the desired velocity. If the outer diameter of the dart 800 is too small, it will require more fluid to be pumped into the passageway 30 to move the dart at the desired velocity. In some embodiments, the nominal outer diameter of the dart 800 is about 0.25" to about 0.5" smaller than the nominal inner diameter of the casing.

After passing through tool 28*c* immediately uphole from the target tool 28*d*, the dart 800 determines that it is about to arrive at the target tool 28*d*. Somewhere between tool 28*c* and tool 28*d*, the dart 800 self-activates and transitions from the inactivated position to the activated position. In the activated position, the middle housing 830 and the engagement mechanism 866 are shifted upwards towards the trailing end 842 relative to the body 820 and the cone 868, thereby aligning the slots 832 of the housing 830 with the flow passages 854 and radially expanding the engagement mechanism 866. As fluid is pumped down the passageway 30 from surface E to convey the dart 800, fluid pressure above the dart 800 is greater than that below the dart, which helps to keep the ball 858 in the ball seats 856.

When the dart 800 arrives at the constriction 50 of the target tool 28*d*, the dart 800 is caught by the constriction 50 as the outer diameter of the radially expanded engagement mechanism 866 is too large to fit through the constriction 50. A fluid seal is thus created by the engagement mechanism 866 and the constriction 50 such that substantially no fluid can flow further downhole past the dart 800 at the location of target tool 28*d*. As fluid is continuously being pumped down the passageway 30, the fluid pressure above the dart 800 increases until the target tool 28*d* is actuated, for example, to shift a sleeve thereof to open a port in the wall of the tubing string 24. Once the port in the tubing string 24 is opened, fluid can enter the wellbore through the open port. For example, treatment fluid may be pumped into the passageway 30 from surface E and introduced into the wellbore via the open port in the tubing string 24.

In some embodiments, the target tool 28*d* and the dart 800 are configured and sized such that when the port in the tubing string 24 is opened by dart 800, there is an axial distance between the open port and the trailing end 842 of the dart 800 and this axial distance may be referred to as the "shift distance". The size of the shift distance is selected to allow a volume of buffer fluid to remain above the dart 800 while treatment fluid (e.g., frac fluid) is introduced into the formation through the open port. In some embodiments, the shift distance is about the same as or greater than the inner diameter of the target tool 28*d*.

In the activated position, the slots 832 are aligned with the flow passages 854 to allow fluid from the outer surface of the dart below the engagement mechanism 866 to enter the flowback valve 850 via open flow passages 854; however, when the fluid pressure above the dart is greater than that below the dart (e.g. while the dart 800 is being conveyed downhole by fluid pumped into the passageway 30 from surface or during wellbore treatment operation when treatment fluid is pumped downhole from surface, etc.), the ball 858 is maintained in the ball seat 856 and, in some embodiments, the ball 858 may be further secured in the seat 856 initially by, for example, adhesives. With the ball 858 in seat 856, fluid communication between the flow passages 854 and the open end 852*a* is blocked by the ball 858, and the inner flow path of the dart 800 is therefore closed.

When the fluid pressure below the dart 800 is greater than that above the dart (e.g., during the flowback process), and fluid in passageway 30 below the dart can enter the flow passages 854 via flow path P, which may exert a sufficient upward force on the ball 858 to lift the ball away from the ball seat 856. Once ball 858 is unseated, the inner flow path of dart 800 is opened to allow fluid downhole from the engagement mechanism 866 to flow through the dart and exit at open end 852*a*, uphole from the engagement mechanism. Therefore, when the inner flow path of the dart 800 is open (or unblocked), fluid can flow through the dart in the uphole direction. In some embodiments, once unseated, the ball 858 may separate completely from the dart 800 and may be conveyed by fluid in the passageway 30, separately from the dart 800, in the uphole direction. In some embodiments, the difference in pressure above and below the dart 800 may be sufficient to unseat the engagement mechanism 866 from constriction 50 of tool 28*d*, thus allowing the dart 800 to be conveyed uphole.

Figure 18:
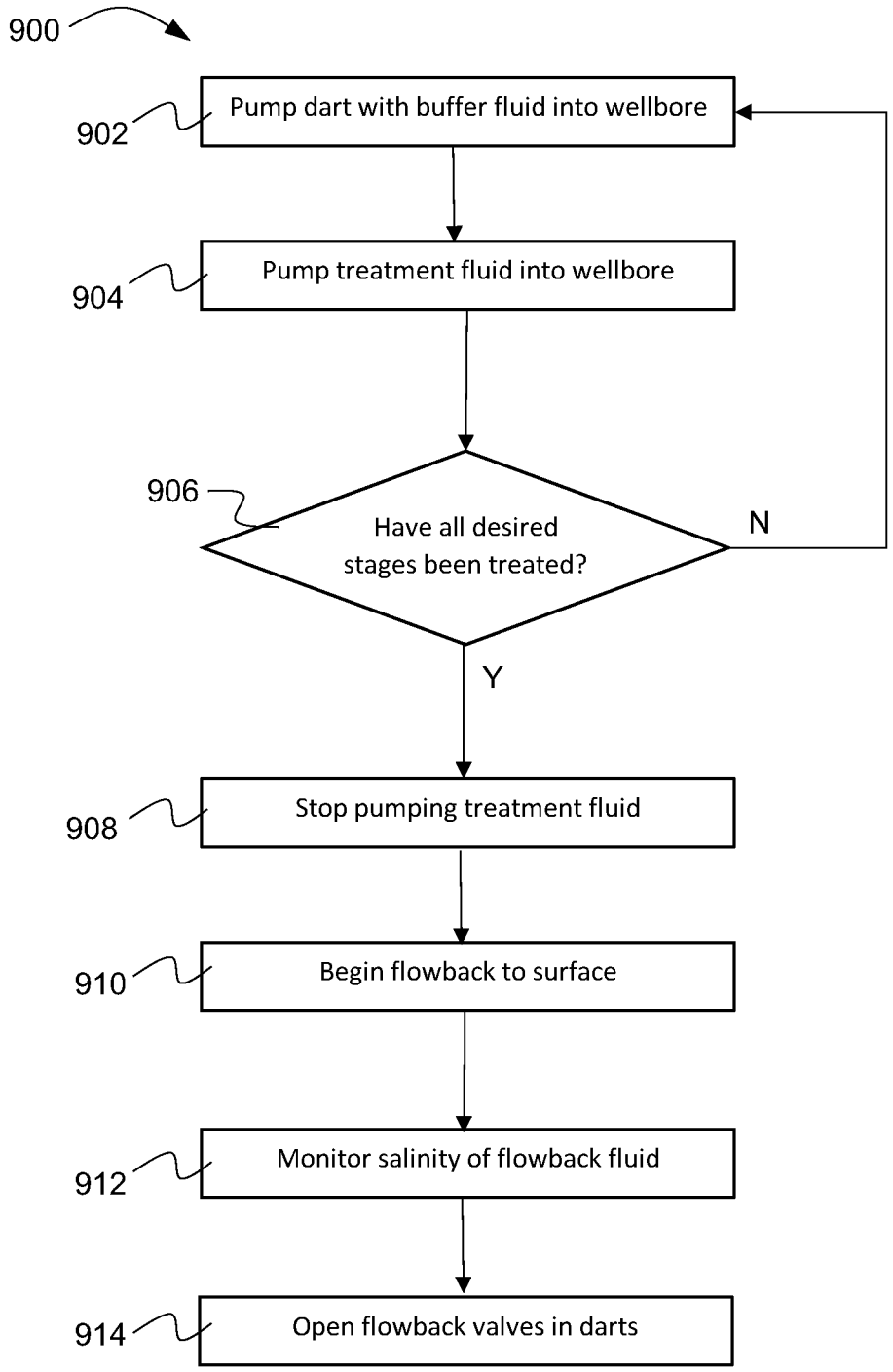
FIG. 18 is a flowchart of a method of fracking, according to one embodiment.

FIG. 18 shows a sample process 900 using a plurality of darts 800 to effect a multi-stage fracking operation. Process 900 is described with further reference to FIGS. 16 and 17. The process 900 starts at step 902 where a first dart 800 is conveyed downhole in the passageway 30 with a buffer fluid. At step 904, wellbore treatment fluid is then pumped into the passageway 30, following the buffer fluid. The composition of the wellbore treatment fluid may be different from that of the buffer fluid. In some embodiments, the wellbore treatment fluid may contain substances (e.g., acid) that are highly reactive with the materials of the dart, which may prematurely dissolve the dart before the dart reaches the desired target tool. The composition of the buffer fluid is selected to be less reactive with the dart 800 than the treatment fluid to help prevent premature dissolution of the dart. The salinity of the treatment fluid is measured and/or is known before the treatment fluid is pumped downhole.

In this sample process 900, the first dart 800 self-activates after passing through the constriction 50 in downhole tool 28*d* but before reaching the lowermost downhole tool 28*e*. When it reaches the constriction 50 of the downhole tool 28*e*, the engagement mechanism 866 of the first dart 800 engages the constriction 50 to create a fluid seal. The increasing pressure of the fluid above the dart 800 eventually shifts a sleeve of the downhole tool 28 to open one or more ports in the tubing string 24 in the first stage 26*e*. The treatment fluid following the dart 800 can then enter the formation 23 surrounding the wellbore 22 through the open ports to generate fractures in the formation. When the one or more ports are open, the shift distance between the ports and the trailing end of the dart 800 allows a volume of the buffer fluid to remain above the dart, thereby helping to shield the dart from direct contact with the treatment fluid. Once the desired volume of treatment fluid is delivered to the first stage 26*e*, the treatment of the first stage 26*e* is complete. The flowback valve 850 of the first dart 800 is closed (i.e., the ball 858 is seated in ball seat 856) during the treatment of the first stage 26*e*.

At step 906, if more stages of the wellbore 22 are to be treated, a second dart 800 is conveyed from surface E with a buffer fluid into the passageway 30 (step 902), followed by a volume of treatment fluid (step 904). In this sample process 900, the second dart 800 is preprogrammed to engage with the constriction 50 in downhole tool 28*d*. The second dart 800 self-activates after passing through downhole tool 28*c* but before reaching downhole tool 28*d*. As the second dart 800 approaches the downhole tool 28*d*, the portion of the passageway 30 below the tool 28*e* is fluidly sealed by the first dart 800, with the flowback valve 850 of the first dart still closed. When the second dart 800 reaches the constriction 50 of the downhole tool 28*d*, the engagement mechanism 866 of the second dart engages the constriction 50 to create a fluid seal and shifts a sleeve in tool 28*d* to open one or more ports in the second stage 26*d*. When the treatment of the second stage 26*d* is complete but there are further stages of the wellbore 22 to be treated (step 906), steps 902 and 904 are repeated with additional darts 800 until all the desired stages 28*a*,28*b*,28*c*,28*d*,28*e* are treated. In some embodiments, the flowback valves 850 of all the darts 800 remain closed during the treatment of the stages. In further embodiments, the flowback valves 850 of the all the darts 800 remain closed, at least for some time, after the treatment of the stages.

After all the desired stages have been treated, the pumping of treatment fluid downhole is stopped (step 908). In some embodiments, wellbore 22 may have one or more stages that are left untreated at step 908. In some embodiments, the one or more darts 800 in the passageway 30 may begin to dissolve, at least in part, while wellbore 22 is being treated or after all the desired stages have been treated.

After step 908, a valve (not shown) at surface is opened to begin the flowback process of the wellbore 22 whereby fluid in the passageway 30 ("flowback fluid") can flow back to surface E (step 910), starting with the uppermost stage 26*a*. The flowback fluid may comprise frac fluid and any other treatment fluid that was introduced into the passageway 30 during the fracking operation and/or wellbore fluids from the formation 23. Wellbore fluids may contain water, gas, and/or hydrocarbons.

At surface, the salinity of the flowback fluid is measured and monitored continuously or sporadically (step 912). Since the salinity of the treatment fluid is known, the presence of fluids other than the treatment fluid can be determined by monitoring the salinity of the flowback fluid. For example, wellbore fluids from the formation 23 may be higher in salinity than the treatment fluid so an increase in salinity in the flowback fluid may indicate that wellbore fluids are being drawn into the passageway 30 through the open ports in the tubing string 24. Further, knowing the salinity of the flowback fluid may help estimate and/or optimize the rate of dissolution of the darts 800 in the passageway 30, since the darts can dissolve quicker in a higher salinity environment. In a sample embodiment, if a decrease in salinity is detected in the flowback fluid, the flowback process may be paused and the well may be shut in to allow the darts to dissolve before resuming the flowback process.

As the flowback process progresses, the pressure above the dart in the uppermost stage 26*a* decreases and is eventually less than the pressure below the dart. The difference in pressure lifts the ball 858 of the flowback valve 850 off the ball seat 856 to allow flowback fluid below the dart to flow through the inner flow path of the dart and exit above the dart (step 914). The unseated ball 858, separated from the dart 800, may dissolve, at least in part, in the presence of the flowback fluid and/or be conveyed uphole by the flowback fluid.

The upward flow of flowback fluid through the dart in stage 26*a* in turn causes a decrease in pressure in the adjacent stage 26*b* downhole from stage 26*a*, above the dart seated in constriction 50 of downhole tool 28*b*. When the pressure above the dart in stage 26*b* is less than that below, the flowback valve 850 of the dart opens (i.e., the ball 858 is unseated from ball seat 856) to permit fluid below the dart to flow through the dart's inner flow path and exit above the dart (step 914). The upward flow of flowback fluid in stage 26*b* in turn cases a decrease in pressure the adjacent stage 26*c* downhole from stage 26*b*, thereby opening the flowback valve of the next downhole dart seated in constriction 50 of the downhole tool 28*c*. In this manner, all the flowback valves of the darts in the tubing string 24 are opened sequentially from the uppermost dart to the lowermost dart (step 914), and fluid communication throughout the entire length of passageway 30 can therefore be established.

The unseated balls 858 may be conveyed uphole by the flowback fluid. In some embodiments, an unseated ball 858 may come into contact with a dart 800 uphole therefrom. For example, the ball 858 from the dart seated in constriction 50 of tool 28*c* may separate from the dart and flow uphole to reach the dart seated in constriction 50 of tool 28*b*. However, even if the downhole ball 858 comes into contact with the uphole dart 800, fluid flow through the inner flow path of the uphole dart 800 is not obstructed by the downhole ball because the flow passages 854 receive fluid from the sides of the dart rather than from the leading end 840.

In embodiments where a least a portion of the dart 800 is configured to dissolve in the presence of wellbore fluids, the opening of flowback valve 850 during the above-described flowback process may help accelerate the dissolution of the darts 800 in the tubing string 24 by allowing fresh, unreacted, wellbore fluid to reach the inside and upper portion of the dart via the dart's inner flow path. The opening of the flowback valve 850 allows the inner surface and outer surface of the dart 800 to be exposed to wellbore fluids simultaneously. Any remaining undissolved parts of the dart 800 may be conveyed to surface E by the flowback fluid. When the darts 800 are dissolved and/or removed, the passageway 30 becomes unobstructed, with substantially uniform inner diameter throughout its length, and the tubing string 24 can be used to produce wellbore fluids from formation 23.

Figure 19:
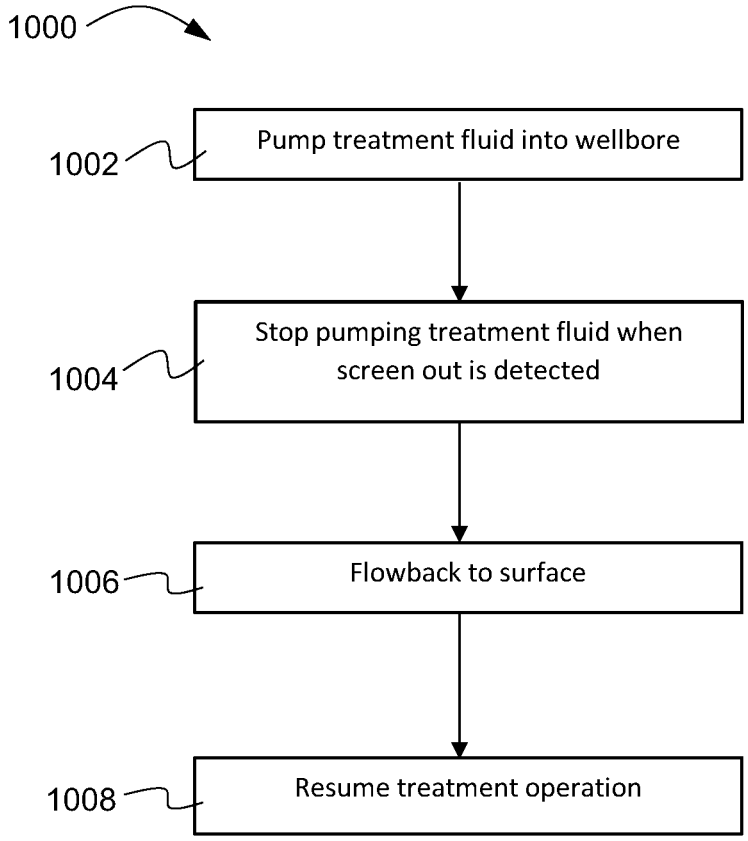
FIG. 19 is a flowchart of a method of addressing a screen out event during a wellbore treatment operation, according to one embodiment.

FIG. 19 illustrates a sample process 1000 for addressing a screen out event during a wellbore treatment (e.g., fracking) operation for a single stage in a wellbore. Process 1000 will be described with further reference to FIGS. 16 and 17. Process 1000 starts at step 1002 where treatment fluid is pumped into the passageway 30 in wellbore 22. At step 1002, there may be one or more activated darts 800 seated in the downhole tools in the tubing string 24. In some embodiments, there may be an inactivated dart 800 in the passageway 30 at step 1002.

At step 1004, when a screen out is detected (e.g., as indicated by a sudden drop in the treatment fluid flowrate and/or a sudden spike in the wellbore pressure), the pumping of treatment fluid into the passageway 30 is stopped. One example of a screen out event is when the treatment fluid is not entering the formation 23 as quickly as usual due to, for example, blockage of the open ports in the tubing string 24 by proppants in the treatment fluid. The reduction of flow rate in the passageway 30 may cause proppants in the treatment fluid to come out of suspension and settle at the bottom of tubing string 24.

At step 1006, flowback to surface is initiated by opening a valve (not shown) at surface to allow the pressurized formation to push flowback fluid in the passageway 30 and the formation 23 uphole. The upward flow of flowback fluids may help unblock any blocked open ports. Also, as discussed above with respect to process 900 in FIG. 18, the upward flow of flowback fluid can open the flowback valve 850 of any of the activated darts 800 seated in the downhole tools in the tubing string 24, thereby reestablishing fluid communication between two or more adjacent stages in the wellbore 22. Opening the flowback valve 850 of the seated darts 800 in the tubing string 24 helps increase the flow rate of the flowback fluid in the passageway 30, which may assist in redistributing and/or resuspending the settled proppant.

Where there is an inactivated dars 800 in the tubing string 24 that has not yet reached the corresponding target downhole tool at step 1006, the inactivated dart 800 will flow upwards with the flowback fluids. In some embodiments, the inactivated dart 800 is configured to self-deactivate when the dart senses that it is moving uphole rather than downhole. By deactivating and remaining in the inactivated position, the inactivated dart 800 is prevented from inadvertently engaging a tool in the tubing string when it subsequently flows downhole again.

At step 1008, the valve at surface is closed to stop flowback in the passageway 30 and the wellbore treatment operation is resumed by, for example, pumping treatment fluid downhole. The treatment fluid may initially contain little or no proppant, and proppant may be subsequently added to the treatment fluid. As treatment fluid is pumped downhole again (step 1008), the self-deactivated dart in the passageway 30 can pass through one or more constrictions 50 without engaging the constrictions and may begin to dissolve, at least in part, in the presence of the treatment fluid. In some embodiments, as treatment fluid is pumped downhole (step 1008), each open backflow valve 850 is closed when the flow of treatment fluid in the downhole direction is sufficient to urge the ball 858 of valve 850 back to its corresponding seat 856, thereby fluidly separating the stages on either side of the corresponding dart. Once the wellbore treatment operation resumes at step 1008, a second inactivated dart 800 may be introduced into the passageway 30 to, for example, replace the self-deactivated dart and engage the target downhole tool that the deactivated dart was supposed to engage.

Pass-Through Constriction

Figure 20A:
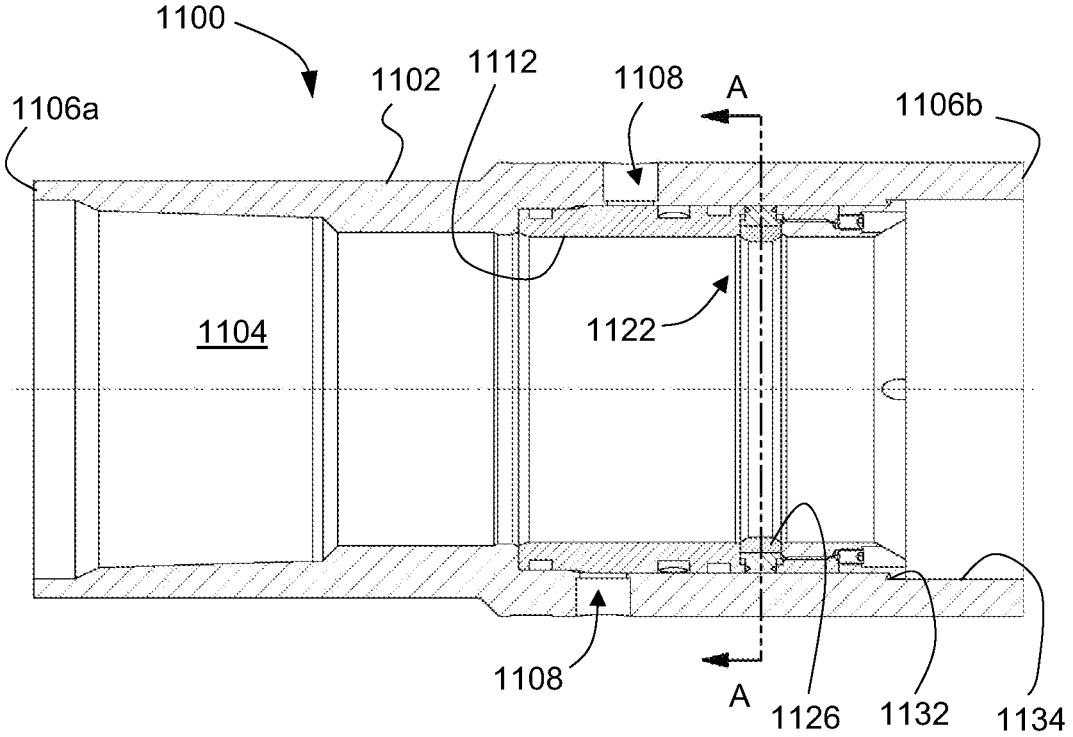
FIG. 20A is an axial cross-sectional view of a downhole tool, shown in an inactivated position, according to one embodiment of the present disclosure. The downhole tool has a pass-through constriction.
Figure 20B:
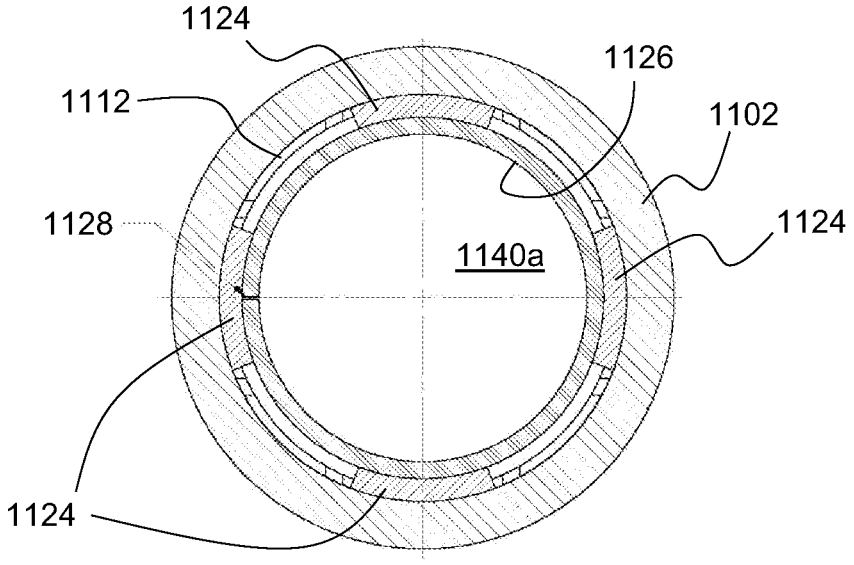
FIG. 20B is a lateral cross-sectional view of the downhole tool of FIG. 20A, taken along line A-A.
Figure 21A:
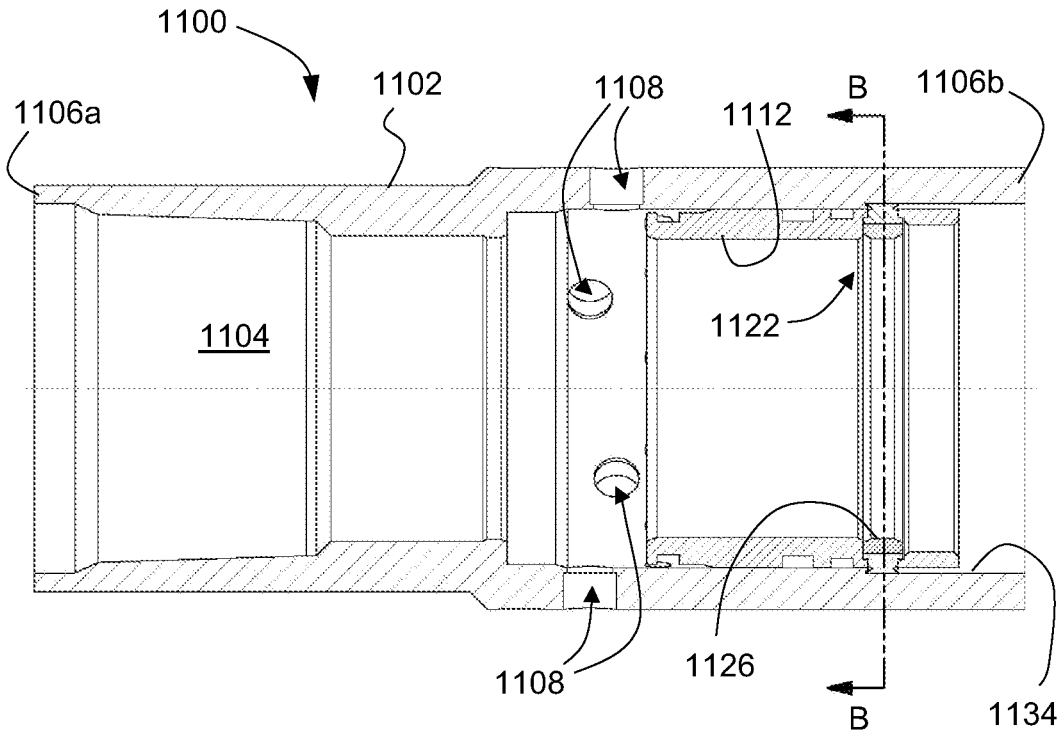
FIG. 21A is an axial cross-sectional view of the downhole tool of FIG. 20A, shown in an activated position, according to one embodiment of the present disclosure.
Figure 21B:
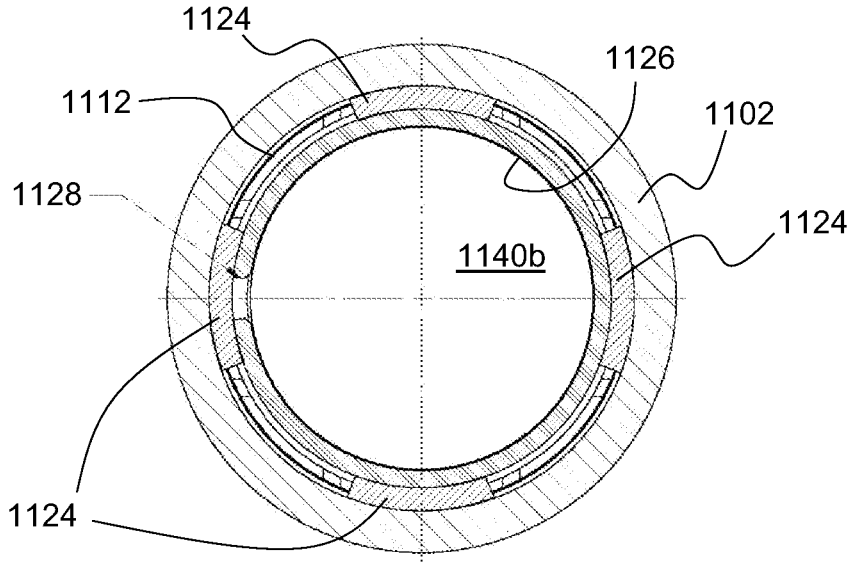
FIG. 21B is a lateral cross-sectional view of the downhole tool of FIG. 21A, taken along line B-B.

Referring to FIGS. 20 and 21, a downhole tool 1100 is configured to be overcome: to catch a device (not shown) such as an untethered dart, be actuated by the device, and then release the device to allow the device to travel through the downhole tool. The downhole tool 1100 may be referred to as a pass-through tool. The pass-through tool 1100 may be deployed in a stage 26*a*,26*b*,26*c*,26*d*,26*e* of the tubing string 24 described above with respect to FIG. 1. In some embodiments, the pass-through tool 1100 can be installed in the tubing string 24 immediately uphole from one of the tools 28*a*,28*b*,28*c*,28*d*,28*e* or immediately uphole from another pass-through tool 1100.

In some embodiments, the pass-through tool 1100 comprises an outer housing 1102 having an inner surface defining an axially extending inner bore 1104 and upper end 1106*a* and lower end 1106*b* for coupling to the tubing string 24. Towards the lower end 1106*b*, the inner surface of the outer housing 1102 has defined thereon a shoulder 1132 and a recessed lower portion 1134 immediately below the shoulder 1132. The recessed lower portion 1134 has an inner diameter that is greater than the inner diameter of an upper portion of the inner surface of housing 1102 above shoulder 1132. The pass-through tool 1100 also comprises an actuable mechanism 1112 that is movably coupled to the inner surface of the outer housing 1102 and is configured to transition from a first position (e.g., a closed position shown in FIG. 20A) to a second position (e.g., an open position shown in FIG. 21A) when actuated by the device.

In the illustrated embodiment, the outer housing 1102 has a plurality of ports 1108 extending through its wall, from the inner bore 1104 to its outer surface. In some embodiments, the plurality of ports 1108 are positioned above shoulder 1132, i.e., the ports 1108 are closer to the upper end 1106*a* than the shoulder 1132. In the illustrated embodiment, the actuable mechanism 1112 is a shiftable sleeve slidably coupled to the inner surface of the outer housing 1102. In the closed position (FIG. 20A), the sleeve 1112 blocks the plurality of ports 1108. In some embodiments, the sleeve 1112 may have one or more seals (not shown) on its outer surface for fluidly sealing the interface between the sleeve 1112 and the inner surface of the outer housing 1102. In the closed position, fluid communication between the inner bore 1104 and the ports 1108 is restricted by the sleeve 1112. In the open position, the sleeve 1112 is shifted towards the lower end 1106*b* to unblock the ports 1108, thereby permitting fluid communication between the inner bore 1104 and the ports 1108.

In the illustrated embodiment shown in FIGS. 20 and 21, tool 1100 comprises a pass-through constriction 1122 operably coupled to the sleeve 1112. In some embodiment, the sleeve 112 is actuated (e.g., shifted) by interaction between the device and the pass-through constriction 1122. In some embodiments, the pass-through constriction 1122 comprises a plurality of retractable dogs 1124 and an expandable C-ring 1126. In some embodiments, the sleeve 1112 has defined through its wall a plurality of slots that are circumferentially spaced apart from one another. Each dog 1124 is received in and extends through a respective slot in the sleeve 1112. Each dog 1124 is movable radially in its respective slot. While four dogs 1124 and corresponding slots are shown in the illustrated embodiment, the tool 1100 may have fewer or more dogs and slots in other embodiments.

The expandable C-ring 1126, positioned in between the dogs 1124, is supported at its outer surface by the plurality of dogs 1124. The C-ring 1126 has a gap 1128 at a circumferential location of the ring 1126, such that the wall of the ring is discontinued at that circumferential location. The C-ring 1126 is spring-biased to expand, i.e., to increase the size of gap 1128 and the effective inner diameter of the C-ring 1126. In some embodiments, the upper inner edge of the C-ring 1126 adjacent the upper end 1106*a* is beveled. In further embodiments, the lower inner edge of the C-ring 1126 adjacent the lower end 1106*b* is also beveled.

The tool 1100 has an initial inactivated position, shown in FIG. 20, wherein sleeve 1112 is in the closed position, blocking the ports 1108. In the inactivated position, the dogs 1124 extend radially inwardly through the slots in the sleeve 1112, with the dogs' outer faces abutting against the inner surface of the housing 1102, and the dogs' inner faces abutting the outer surface of the C-ring 1126. In the inactivated position, the dogs 1124 are positioned at an axial location of the housing 1102, somewhere in the smaller inner diameter upper portion of the inner surface of the housing 1102 above the recessed lower portion 1134, in between the shoulder 1132 and the ports 1108. The sleeve 1112, or at least an axial portion thereof, is positioned inside the housing 1102 above the shoulder 1132 and the recessed lower portion 1134. To secure the sleeve 1112 initially to the housing 1102 in the closed position, the tool 1100 may include a catch (not shown), which may be for example a shear pin, shear ring, or the like.

The C-ring 1126 is held in a closed position by the dogs 1124 where the dogs 1124 urge the C-ring 1226 against its spring-biased position to minimize the size of gap 1128. In some embodiments, when the C-ring 1126 is in the closed position, the size of gap 1128 is zero, close to zero, or negligible, such that the wall of the C-ring 1126 is substantially continuous around its circumference. The C-ring 1126 helps secure the dogs 1124 in the slots of the sleeve 1112 by preventing the dogs from sliding out of the slots and into the inner bore 1104. In the closed position, the C-ring 1126 has defined therethrough a restricted opening 1140*a*.

To transition the tool 1100 to the activated positioned, an activated device (e.g., a dart) is conveyed into the inner bore 1104 of the tool 1100 via the upper end 1106*a*. The device is configured such that in its activated position, the outer diameter of at least a portion of the device is greater than the size of the restricted opening 1140*a* of the closed C-ring 1126. To move the sleeve 1112, the device engages the C-ring 1126 at the upper inner (beveled) edge because the device is too large to pass through the restricted opening 1140*a*. When the device is engaged with the closed C-ring 1126 of the pass-through constriction 1122, a fluid seal is formed between the device and the constriction 1122 and fluid pressure above the device then exerts a downward force on the device. Eventually, the force is sufficient to break the catch 1136 that initially holds the sleeve 1112 in its closed position, thereby releasing the sleeve 1112. Continued fluid pressure from above the device shifts the released sleeve 1112 downwards towards the lower end 1106*b* into the open position shown in FIG. 21.

With reference to FIG. 21, as the sleeve 1112 is shifted down, the pass-through constriction 1122 eventually moves below shoulder 1132 to the recessed lower portion 1134 of the housing 1102, where the C-ring 1126 can expand radially outwardly to push the dogs 1124 radially outwardly into the larger inner diameter of the lower portion 1134. The radial expansion of the C-ring 1126 thus causes the dogs 1124 to retract away from the central longitudinal axis of the inner bore 1104. When C-ring 1126 is expanded, the size of gap 1128 is increased compared to that in the ring's closed position and an expanded opening 1140*b* is defined through the C-ring 1126. The size of the expanded opening 1140*b* is greater the size of the restricted opening 1140*a*. The expanded opening 1140*b* is large enough to allow the activated device to pass therethrough and exit the tool 1100 at the lower end 1106*b*.

In the open position shown in FIG. 21, the sleeve 1112 is shifted down to unblock the ports 1108 in the housing 1102. In some embodiments, the sleeve 1112 and/or housing 1102 may comprise a lock mechanism (not shown) to secure the sleeve 1112 in the open position once the sleeve has shifted down. Once the ports 1108 are unblocked, fluid in the inner bore 1104 can communicate through the open ports 1108 to the surrounding annulus outside the tool 1100.

In some embodiments, the illustrated pass-through constriction 1122 provides an almost circumferentially-continuous seat for engaging the activated device, which may cause less damage to the outer surface of the device as the device passes through the constriction 1122. In some embodiments, the substantial continuity of the seat of constriction 1122 may exert a more uniform load on the device as the device engages the constriction 1122 than prior art dogs or pins. In some embodiments, the C-ring 1126 of the pass-through constriction 1122 provides a seat that is made of a single piece of material, which may be less prone to misalignment and malfunction and may withstand higher impact forces than a seat made up of a plurality of spaced apart dogs or pins. In some embodiments, the C-ring 1126 in its closed position, where the gap 1128 is small and the inner edges are beveled, may be less prone to erosion by the flow of fluid in the inner bore 1104. In some embodiments, the pass-through constriction 1122, or at least a portion thereof, is dissolvable so that the inner diameter of the pass-through tools 1100 can be maximized, for example, sometime after the sleeve 1112 is shifted open.

Where a plurality of pass-through tools 1100 are installed consecutively on the tubing string to provide a "cluster" of pass-through tools 1100, an activated dart can pass through the cluster of pass-through tools 1100, sequentially actuating each of the pass-through tools 1100 (e.g., shifting each of the sleeves 1104), without being permanently caught by any of the tools 1100. In this manner, one dart can be deployed down the tubing string 24 to sequentially open the ports 1108 of a cluster of pass-through tools 1100 to, for example, treat the wellbore 23 at a plurality of locations.

It is noted that the foregoing devices, systems, and methods do not require any electronics or power supplies in the tubing string or in the wellbore to operate. As such, the tubing string may be run into the wellbore ahead of the deployment of the devices, as there is no concern of battery charge, component damage, etc. Also, the tubing string itself requires little special preparation ahead of installation, as all features (i.e., tools, sleeves, etc.) therein can be substantially the same, can be interchangeable, and/or can be installed in the tubing string in no particular order. Further, the number of features, although likely known ahead of run in, can be readily determined even after the tubing string is installed downhole.

For wellbore treatment operations such as multi-stage fracking operations, the foregoing devices, systems, and methods only require fluid being pumped down from surface to actuate the downhole tools (i.e., sleeves) in the tubing string prior to the treatment and do not require any post-treatment intervention (e.g., milling out darts) for the production of wellbore fluids. Accordingly, the foregoing devices, systems, and methods may be used in lengthy wellbores that may extend a long distance (e.g., about 5 km) horizontally and/or may allow a higher number (e.g., greater than 100) of stages to be included the corresponding tubing string in the wellbore than previous techniques.

According to a broad aspect of the present disclosure, there is provided a method comprising: measuring an initial rotation of a dart while the dart is stationary; measuring an acceleration and a rotation of the dart as the dart travels through a downhole passageway defined by a tubing string; adjusting the rotation using the initial rotation to provide a corrected rotation; adjusting the acceleration using the corrected rotation to provide a corrected acceleration; and integrating the corrected acceleration twice to obtain a distance value.

In some embodiments, the method comprises comparing the distance value with a target location and if the distance value is the same as the target location, activating the dart.

According to another broad aspect of the present disclosure, there is provided a method comprising detecting a change in magnetic field or magnetic flux as a dart travels through a downhole passageway defined by a tubing string; determining, based on the change in magnetic field or magnetic flux, a location of the dart relative to a target location.

In some embodiments, the change in magnetic field or magnetic flux is caused by a movement of a magnet in the dart.

In some embodiments, the change in magnetic field or magnetic flux is caused by the dart's proximity to or passage through a feature in the tubing string.

In some embodiments, the change in magnetic field or magnetic flux has an x-axis component, a y-axis component, and a z-axis component.

In some embodiments, the movement of the magnet is caused by a constriction in the tubing string.

In some embodiments, the method comprises activating the dart upon determining that the location of the dart is the same as the target location.

In some embodiments, the method comprises engaging, by the activated dart, a downhole tool.

In some embodiments, activating the dart comprises deploying a deployment element of the dart.

In some embodiments, the method comprises creating a fluid seal inside the passageway by engaging the deployed deployment element with a constriction in the tubing string downhole from the target location.

According to another broad aspect of the present disclosure, there is provided a dart comprising: a body; a control module in the body; an accelerometer in the body, the accelerometer being in communication with the control module and configured to measure an acceleration of the dart; a gyroscope in the body, the gyroscope being in communication with the control module and configured to measure a rotation of the dart; wherein the control module is configured to determine a location of the dart relative to a target location based on the acceleration and the rotation of the dart.

According to another broad aspect of the present disclosure, there is provided a dart comprising: a body; a control module inside the body; a magnetometer in the body, the magnetometer being in communication with the control module and configured to measure magnetic field or magnetic flux; wherein the control module is configured to identify a change in magnetic field or magnetic flux based on the measured magnetic field or magnetic flux, and to determine a location of the dart relative to a target location based on the change.

In some embodiments, the magnetic field or magnetic flux has an x-axis component, a y-axis component, and a z-axis component.

In some embodiments, the dart comprises a rare-earth magnet in the body.

In some embodiments, the dart comprises one or more retractable protrusions extending radially outwardly from the body; and a rare-earth magnet embedded in each of the one or more retractable protrusions.

In some embodiments, the dart comprises an actuation mechanism and the control module is configured to activate the actuation mechanism when the location is the same as the target location.

In some embodiments, the actuation mechanism comprises a deployment element deployable upon activation of the actuation mechanism.

In some embodiments, the deployment element is configured to radially expand when deployed.

In some embodiments, the deployment element is collapsible when not deployed and is un-collapsible when deployed.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A dart for deployment into a passage defined by a wellbore flow conductor of a wellbore, the wellbore flow conductor including a stop, the dart comprising:

a body having a leading end, a trailing end, a ball seat defined therein, and an inner flow path defined therein, the inner flow path having:

one or more inlets, each inlet of the one or more inlets extending radially in the body and opening to a respective circumferential location at a lengthwise side of the body, the respective circumferential location being between the leading end and the trailing end; and an outlet at the trailing end of the body, the ball seat being positioned between the one or more inlets and the outlet;

a ball releasably receivable in the ball seat, wherein when the ball is received in the ball seat, the ball blocks fluid communication between the one or more inlets and the outlet, and when the ball is released from the ball seat, fluid communication is permitted between the one or more inlets and the outlet; and an engagement mechanism slidably supported on an outer surface of the body, the engagement mechanism being movable relative to the body from a first position to a second position, wherein in the first position, the engagement mechanism blocks the one or more inlets at the respective circumferential locations, and in the second position, the one or more inlets are unblocked by the engagement mechanism, the dart being actuable to transition from an inactivated configuration to an activated configuration, wherein:

in the inactivated configuration, the engagement mechanism is in the first position, the ball is received in the ball seat, there is an absence of flow communication between the passage and the one or more inlets by the occluding of the one or more inlets by the engagement mechanism, and there is an absence of co-operability of the dart with an opposing surface of the stop such that there is an absence of preventing downhole travel of the dart, relative to the wellbore flow conductor, by the stop; and in the activated configuration, the engagement mechanism is in the second position with effect that downhole travel of the dart, relative to the stop is prevented by co-operation between the engagement mechanism and the stop wherein an engageable surface of the engagement mechanism is disposed in abutting engagement with an opposing surface of the stop, and flow communication between the passage, downhole from the stop, and the one or more inlets at the respective circumferential locations, for releasing the ball from the ball seat, is established.

2. The dart of claim 1 wherein the ball is configured to exit the body at the trailing end when released from the ball seat.

3. The dart of claim 1 wherein at least a portion of an outer surface of the dart is coated with a protective coating.

4. The dart of claim 3 wherein the protective coating is a ceramic coating or a polymer coating.

5. The dart of claim 1 wherein at least a portion of the dart is made of a material that dissolves in the presence of one or more of: flowback fluids, frac fluids, wellbore treatment fluids, load fluids, and production fluids.

6. The dart of claim 1 wherein at least a portion of the dart is made of one or more of: aluminum, a brass alloy, a steel alloy, an aluminum alloy, a magnesium alloy.

7. The dart of claim 1 wherein at least a portion of the dart is made of one or more of: polyglycolic acid (PGA), polyvinyl acetate (PVA), polylactic acid (PLA), and a copolymer comprising PGA and PLA.

* * * * *